US005474624A

United States Patent [19]

Suzuki et al.

[11] Patent Number: 5,474,624

[45] Date of Patent: Dec. 12, 1995

[54] METHOD OF MANUFACTURING FE-BASE SOFT MAGNETIC ALLOY

[75] Inventors: Kiyonori Suzuki; Akihiro Makino, both of Nagaoka; Tsuyoshi Masumoto; Akihisa Inoue, both of Sendai, all of Japan

[73] Assignee: Alps Electric Co., Ltd., Tokyo, Japan

[21] Appl. No.: 121,715

[22] Filed: Sep. 14, 1993

[30] Foreign Application Priority Data

Sep. 14, 1992 [JP] Japan ..... 4-245182
Jul. 30, 1993 [JP] Japan ..... 5-190674

[51] Int. Cl.[6] ..... H01F 1/147

[52] U.S. Cl. ..... 148/121; 148/120; 148/122

[58] Field of Search ..... 148/121, 120, 148/122

[56] References Cited

U.S. PATENT DOCUMENTS

| | | | |
|---|---|---|---|
| 4,623,387 | 11/1986 | Masumoto et al. | 420/41 |
| 4,842,657 | 6/1989 | Masumoto et al. | 148/403 |
| 4,889,568 | 12/1989 | Datta et al. | 148/108 |
| 4,918,555 | 4/1990 | Yoshizawa et al. | 360/125 |
| 4,985,089 | 1/1991 | Yoshizawa et al. | 148/303 |
| 5,069,731 | 12/1991 | Yoshizawa et al. | 148/405 |
| 5,160,379 | 11/1992 | Yoshizawa et al. | 148/108 |

FOREIGN PATENT DOCUMENTS

| | | | |
|---|---|---|---|
| 0072893 | 3/1983 | European Pat. Off. | 148/121 |
| 0271657 | 6/1988 | European Pat. Off. . | |

OTHER PUBLICATIONS

Y. Yoshizawa and K. Yamauchi, "Fe-Based Soft Magnetic Alloys Composed of Ultrafine Grain Structure", *Materials Transaction,* JIM, vol. 31, No. 4 (1990), pp. 307–314.

C. Hargitai, I. Bakonyi, and T. Kemeny, "Conference on Metallic Glasses: Science and Technology", *Organizing Committee, Central Research Institute for Physics, Budapest,* pp. 217–221. Budapest 1980.

*Primary Examiner*—John Sheehan

*Attorney, Agent, or Firm*—Guy W. Shoup; Patrick T. Bever

[57] ABSTRACT

The present invention relates to a method of stably manufacturing a Fe-base soft magnetic alloy having steps of subjecting an amorphous alloy mainly composed of Fe to heat treatment in which the amorphous alloy is heated to 400° to 750° C. at a heating rate of 1.0° C./minute or higher so that at least 50% or more of the structure of the amorphous alloy is made of fine crystalline grains formed into a body-centered cubic structure and having an average grain size of crystal of 30 nm or smaller as to have a high magnetic permeability and saturation magnetic flux density.

27 Claims, 36 Drawing Sheets

200°C/MIN $Fe_{90}Zr_7B_3$

100nm 2.5°C/MIN $Fe_{90}Zr_7B_3$

METHOD OF MANUFACTURING FE-BASE SOFT MAGNETIC ALLOY

BACKGROUND OF THE INVENTION

The present invention relates to a method of manufacturing a soft magnetic alloy for use in a magnetic head, a transformer, or a choke coil or the like, and more particularly to a method of manufacturing a Fe-base soft magnetic alloy having a high saturation magnetic flux density and excellent soft magnetic characteristics.

A soft magnetic alloy for use in a magnetic head, a transformer, or a choke coil or the like must have the following characteristics:

(1) high magnetic flux density;

(2) high magnetic permeability;

(3) small coercive force;

(4) low magnetostriction; and (5) a thin shape which can easily be formed.

The magnetic head must have the following characteristics in order to improve the wear resistance in addition to the foregoing characteristics (1) to (5):

(6) excellent hardness.

Therefore, materials for a variety of alloy systems have been studied to satisfy the foregoing characteristics when a soft magnetic alloy or a magnetic head is manufactured. Hitherto, crystalline alloys such as sendust, permalloy and iron-silicon steel and the like have been employed for use in the foregoing purposes. Recently, a Fe-base or a Co-base amorphous alloy has been used.

Under the foregoing circumstances, the magnetic head must be adaptable to a magnetic recording medium of a type having large coercive force required to record information at a high density by employing further suitable magnetic material to form the magnetic head that exhibits excellent performance. Further, the size of the transformer and the choke coil must be further reduced to be adaptable to the trend of reducing electronic equipment by using magnetic material having further satisfactory performance.

However, sendust suffers from unsatisfactorily low saturation magnetic flux density of about 11 KG although it has excellent soft magnetic characteristics. Also permalloy encounters a problem of an unsatisfactorily low saturation magnetic flux density of about 8 KG when it is formed into an alloy structure that exhibits excellent soft magnetic characteristics. The iron-silicon steel (Fe—Si Alloy) has a problem of unsatisfactory soft magnetic characteristics although it exhibits a high saturation magnetic flux density.

As for the amorphous alloy, the Co-base alloy has an unsatisfactory saturation magnetic flux density of about 10 KG although it has excellent soft magnetic characteristics. Although the Fe-base alloy exhibits a high saturation magnetic flux density of 15 KG or higher, the attained soft magnetic characteristics are unsatisfactory. The stability of the amorphous alloy against heat is insufficient, resulting in a problem to be solved. Therefore, it is difficult to simultaneously realize the high saturation magnetic flux density and excellent soft magnetic characteristics.

An alloy for a transformer having a high saturation magnetic flux density and exhibiting a low core loss has been disclosed in U.S. Pat. No. 5,069,731, the composition of which is expressed by a general formula:

$$(Fe_{1-a}M_{1a})_{100-x-y-z-t}Cu_xSi_yB_zM_{2t}$$

where $M_1$ is Co and/or, $M_2$ is at least one element selected from a group consisting of Nb, W, Ta, Mo, Zr, Hr and Ti, and a, x, y, z and t respectively satisfy, by atom %, $0 \leqq a \leqq 0.3$, $0.1 \leqq x \leqq 3$, $0 \leqq y \leqq 17$, $4 \leqq z \leqq 17$, $10 \leqq y+z \leqq 28$ and $0.1 \leqq t \leqq 5$.

At least 50% of the structure is made of fine crystalline grains and the average grain size obtained by measuring the maximum crystalline grain is 1000 Å or less.

The foregoing fine crystalline alloy has been developed while making a Fe—Si—B amorphous alloy, disclosed in U.S. Pat. No. 5,160,379, as a starting material. In the Fe—Si—B alloy, elements for making the structure to be amorphous are Si and B and the content of Fe in an alloy having sufficient heat stability in terms of practical use is 70 to 80 atom %. The foregoing amorphous alloy has magnetic characteristics superior to that of the conventional Fe—Si alloy (iron-silicon alloy). The fine crystalline alloy disclosed above is a Fe—$M_1$—Cu—Si—B—$M_3$ alloy made by adding Cu and M elements to a Fe—Si—B alloy, where the element $M_3$ is at least one element selected from a group consisting of Nb, W, Ta, Zr, Hf, Ti and Mo.

It is necessary for the alloy of the foregoing type to contain Cu because it has been said that the addition of Cu causes fluctuation to occur in the amorphous to generate fine crystalline grains and, accordingly, the structure can be made fine. It has been disclosed in the foregoing application that the omission of the addition of Cu cannot easily produce fine crystalline grains, a compound phase can easily be generated and therefore the magnetic characteristics deteriorate.

In the alloy of the foregoing system, the mutual action between Cu and Nb is able to prevent the enlargement of the crystalline grains. Therefore, it has been considered that composite addition of Nb and Cu is required because sole addition of Nb or Cu cannot prevent the enlargement of the crystalline grains. The foregoing fact has been disclosed by the inventors of the foregoing disclosure in Journal of Materials Transaction, JIM, Vol. 31, No. 4 (1990), pp. 307–314.

A fact can be understood from FIG. 20, which is a composition view, of U.S. Pat. No. 5,160,379 that the low magnetostriction cannot be obtained from the alloy of the foregoing system if Si=0. Since Si acts to reduce the magnetostriction, Si must be added to reduce the magnetostriction.

The inventors of the present invention have been developing soft magnetic material by using material of a component system which is completely different from an extremely different viewpoint. Among others, there is a Fe (Co, Ni)—Zr alloy system previously disclosed in U.S. Pat. No. 4,623,387 and 4,842,657 established while considering the conventional technologies about sendust, permalloy and iron-silicon steel.

The Fe (Co, Ni)—Zr alloy system contains Zr having excellent performance of forming amorphous added thereto and, accordingly, amorphous alloy can be formed even if the amount of the addition of Zr is reduced. Therefore, the concentration of Fe can be made about 90% or higher. Further, Hf can be used as an element for forming an amorphous alloy similar to Zr. However, the Curie temperature of the alloy of a type containing Fe at a high concentration is in the vicinity of the room temperature and, therefore, the alloy of the foregoing type is not a practical alloy as the material for the magnetic core.

The inventors of the present invention have found a fact that partial crystallization of Fe—Hf amorphous alloy by a special method enables a fine crystalline structure having an average crystalline grain size of about 10 to 20 nm and disclosed this in "CONFERENCE ON METALLIC SCI- ENCE AND TECHNOLOGY BUDAPEST", 1980, p.p. 217 to 221. It can be considered from the disclosed technology that fining of the structure of the Fe—M alloy can be enabled even if elements such as Cu are not added. Although the mechanism of this has not been clarified yet, fluctuation of the structure is already present in a rapidly solidified state in a case where the amorphous phase is formed and the fluctuation becomes nucleation site resulting in that a multiplicity of uniform and fine nuclei are generated.

As described above, the Fe—M (Zr, Hf) alloy system do not have excellent magnetic characteristics in an amorphous state because of their low Curie temperatures. However, consideration of a fact that the foregoing alloy can be finely crystallized without addition of the non-magnetic element resulted in that making of the Fe—M amorphous alloy to be a starting material enables a fine crystalline alloy to be obtained which contains a Fe at a concentration that is considerably higher than that of the conventional alloy and, therefore, an alloy can be expected to be obtained which has a saturation magnetic flux density which is higher than that of the conventional Fe—Si—B based fine crystalline alloy.

SUMMARY OF THE INVENTION

Accordingly, the inventors of the present invention have intensely studied, resulting in that the grain enlargement can be prevented by improving the heat stability of a Fe—M fine crystalline alloy. Further, an amorphous phase must be left in the grain boundary, the amorphous phase being a thermally stable which is able to serve as a barrier for the grain coarsening. On the foregoing viewpoint, the study carried out while paying attention to B, which is an element capable of improving the thermal stability of the amorphous alloy, resulted in the present invention to be found.

An object of the present invention is to provide a method of stably manufacturing a Fe-base soft magnetic alloy having high saturation magnetic flux density and high magnetic permeability, and also exhibiting satisfactory mechanical strength and excellent thermal stability.

In order to achieve the foregoing object, according to one aspect of the present invention, there is provided a method of manufacturing a Fe-base soft magnetic alloy comprising a step of: subjecting an amorphous alloy mainly composed of Fe to heat treatment in which the amorphous alloy is heated at a heating rate of 1.0° C./minute or higher so that at least 50% or more of the structure of the amorphous alloy is made of fine crystalline grains formed into a body-centered cubic structure and having an average grain size of crystal of 30 nm or smaller.

According to a second aspect of the present invention, there is provided a method of manufacturing a Fe-base soft magnetic alloy having an arrangement that the heat treatment is so arranged that the heating at the heating rate is performed and then the temperature is maintained at 400° to 750° C.

It is preferable that the method of manufacturing a Fe-base soft magnetic alloy is so arranged that the composition of the Fe-base soft magnetic alloy is as follows, that is, the first composition is expressed by the following formula:

$$Fe_bB_xM_y$$

where M is one or more elements selected from a group consisting of Ti, Zr, Hf, V, Nb, Ta, Mo and W and contains Zr and/or Hf, b=75 to 93 atom %, x=0.5 to 10 atom % and y=4 to 9 atom %.

A second composition is expressed by:

$$Fe_bB_xM_yX_u$$

where M is one or more elements selected from a group consisting of Ti, Zr, Hf, V, Nb, Ta, Mo and W and contains Zr and/or Hf, X is one or more elements selected from a group consisting of Cr, Ru, Rh and Ir, b=75 to 93 atom %, x=0.5 to 10 atom %, y=4 to 9 atom % and u≦5 atom %.

A third composition is expressed by:

$$(Fe_{1-a}Z_a)_bB_xM_y$$

where Z is Co and/or Ni, M is one or more elements selected from a group consisting of Ti, Zr, Hf, V, Nb, Ta, Mo and W and contains Zr and/or Hf, a≦0.1, b=75 to 93 atom %, x=0.5 to 10 atom % and y=4 to 9 atom %.

A fourth composition is expressed by:

$$(Fe_{1-a}Z_a)_bB_xM_yX_u$$

where Z is Co and/or Ni, M is one or more elements selected from a group consisting of Ti, Zr, Hf, V, Nb, Ta, Mo and W and contains Zr and/or Hf, X is one or more elements selected from a group consisting of Cr, Ru, Rh and Ir, a≦0.1, b=75 to 93 atom %, x=0.5 to 10 atom % and y=4 to 9 atom %.

A fifth composition is expressed by:

$$Fe_bB_xM'_y$$

where M' is one or more elements selected from a group consisting of Ti, V, Nb, Ta, Mo and W and contains Nb, b=75 to 93 atom %, x=6.5 to 14 atom % and y=4 to 9 atom %.

A sixth composition is expressed by:

$$Fe_bB_xM'_yX_u$$

where M' is one or more elements selected from a group consisting of Ti, V, Nb, Ta, Mo and W and contains Nb, X is one or more elements selected from a group consisting of Cr, Ru, Rh and Ir, b=75 to 93 atom %, x=6.5 to 14 atom %, y=4 to 9 atom % and u≦5 atom %.

A seventh composition is expressed by:

$$(Fe_{1-a}Z_a)_bB_xM'_y$$

where Z is Co and/or Ni, M' is one or more elements selected from a group consisting of Ti, V, Nb, Ta, Mo and W and contains Nb, a≦0.1, b=75 to 93 atom %, x=6.5 to 14 atom % and y=4 to 9 atom %.

An eighth composition is expressed by:

$$(Fe_{1-a}z_a)_bB_xM'_yX_u$$

where Z is Co and/or Ni, M' is one or more elements selected from a group consisting of Ti, V, Nb, Ta, Mo and W and contains Nb, X is one or more elements selected from a group consisting of Cr, Ru, Rh and Ir, a≦0.1, b=75 to 93 atom %, x=6.5 to 14 atom %, y=4 to 9 atom % and u≦5 atom %.

A ninth composition is expressed by:

$$Fe_bB_xM_yT_z$$

where M is one or more elements selected from a group consisting of Ti, Zr, Hf, V, Nb, Ta, Mo and W and contains Zr and/or Hf, T is one or more elements selected from a group consisting of Cu, Ag, Au, Pd, Pt and Bi, 75≦ to ≦93 atom %, x=0.5 to 18 atom %, 4≦y≦10 atom % and z≦4.5 atom %.

A tenth composition is expressed by:

$$Fe_bB_xM_yT_zX_u$$

where M is one or more elements selected from a group consisting of Ti, Zr, Hf, V, Nb, Ta, Mo and W and contains Zr and/or Hf, T is one or more elements selected from a group consisting of Cu, Ag, Au, Pd, Pt and Bi, X is one or more elements selected from a group consisting of Cr, Ru, Rh and Ir, b≦75 to 93 atom %, x=0.5 to 18 atom %, y=4 to 10 atom %, z≦4.5 atom % and u≦5.0 atom %.

An eleventh composition is expressed by:

$$(Fe_{1-a}Z_a)_bB_xM_yT_z$$

where Z is Co and/or Ni, M is one or more elements selected from a group consisting of Ti, Zr, Hf, V, Nb, Ta, Mo and W and contains Zr and/or Hf, T is one or more elements selected from a group consisting of Cu, Ag, Au, Pd, Pt and Bi, a≦0.1, 75≦b≦93 atom %, x=0.5 to 18 atom %, y=4 to 10 atom % and z≦4.5 atom %.

A twelfth composition is expressed by:

$$(Fe_{1-a}Z_a)_bB_xM_yT_zX_u$$

where Z is Co and/or Ni, M is one or more elements selected from a group consisting of Ti, Zr, Hf, V, Nb, Ta, Mo and W and contains Zr and/or Hf, T is one or more elements selected from a group consisting of Cu, Ag, Au, Pd, Pt and Bi, X is one or more elements selected from a group consisting of Cr, Ru, Rh and Ir, a≦0.1, 75≦b≦93 atom %, x=0.5 to 18 atom %, y=4 to 10 atom %, z≦4.5 atom % and u≦5 atom %.

A thirteenth composition is expressed by:

$$Fe_bB_xM'_yT_z$$

where M' is one or more elements selected from a group consisting of Ti, V, Nb, Ta, Mo and W and contains any one of Ti, Nb and Ta, T is one or more elements selected from a group consisting of Cu, Ag, Au, Pd, Pt and Bi, 75≦b≦93 atom %, x=6.5 to 18 atom %, y=4 to 10 atom % and z≦4.5 atom %.

A fourteenth composition is expressed by:

$$Fe_bB_xM'_yT_zX_u$$

where M' is one or more elements selected from a group consisting of Ti, V, Nb, Ta, Mo and W and contains any one of Ti, Nb and Ta, T is one or more elements selected from a group consisting of Cu, Ag, Au, Pd, Pt and Bi, X is one or more elements selected from a group consisting of Cr, Ru, Rh and Ir, 75≦b≦93 atom %, x=6.5 to 18 atom %, y=4 to 10 atom %, z≦4.5 atom % and u≦5 atom %.

A fifteenth composition is expressed by:

$$(Fe_{1-a}Z_a)_bB_xM'_yT_z$$

where Z is Co and/or Ni, M' is one or more elements selected from a group consisting of Ti, V, Nb, Ta, Mo and W and contains any one of Ti, Nb and Ta, T is one or more elements selected from a group consisting of Cu, Ag, Au, Pd, Pt and Bi, a≦0.1, 75≦b≦93 atom % , x=6.5 to 18 atom %, y=4 to 10 atom % and z≦4.5 atom %.

A sixteenth composition is expressed by:

$$(Fe_{1-a}Z_a)_bB_xM'_yT_zX_u$$

where Z is Co and/or Ni, M' is one or more elements selected from a group consisting of Ti, V, Nb, Ta, Mo and W and contains any one of Ti, Nb and Ta, T is one or more elements selected from a group consisting of Cu, Ag, Au, Pd, Pt and Bi, X is one or more elements selected from a group consisting of Cr, Ru, Rh and Ir, a≦0.1, 75≦b≦93 atom %, x=6.5 to 18 atom %, y=4 to 10 atom %, z≦4.5 atom % and u≦5 atom %.

It is further preferable that the ninth to sixteenth compositions be so arranged that z=0.2 to 4.5 atom %.

BRIEF DESCRIPTION OF THE DRAWINGS

FIG. 33 (*b*) is a graph which shows the relationship between the quantity of Co and the magnetostriction of an example of an alloy system according to the present invention;

FIG. 33 (*c*) is a graph which shows the relationship between the quantity of Co and the magnetic permeability of an example of an alloy system according to the present invention;

DETAILED DESCRIPTION OF THE INVENTION

Figure 1:
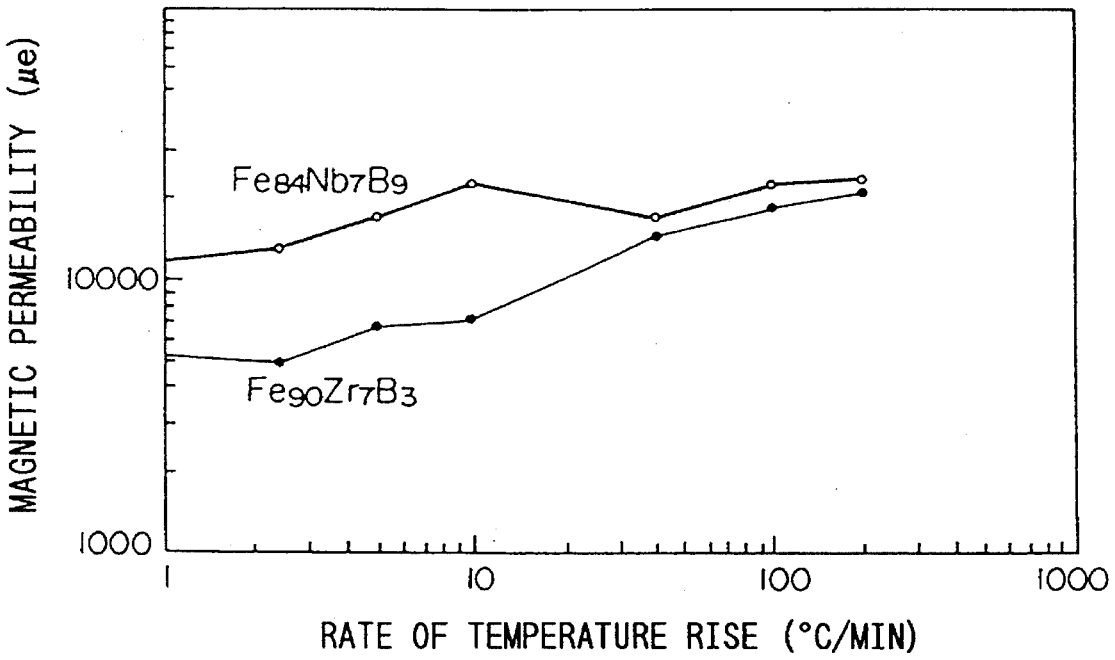
FIG. 1 a double logarithmic graph which shows the relationship between the heating rate and the magnetic permeability of an example of an alloy according to the present invention.

The present invention will now be described in detail.

A Fe-base soft magnetic alloy according to the present invention can be usually obtained by a process in which the amorphous alloy having the foregoing composition or a crystalline alloy including an amorphous phase is rapidly cooled from a melted state, a process in which the same is obtained by a rapid cooling method, such as a sputtering method or an evaporation method, and a heat treatment process in which the material obtained by the foregoing processes is annealed for formation of fine crystalline grains through crystallization of an amorphous phase. The material obtained by the foregoing rapid cooling method may be formed into a ribbon or powder. The heat treatment may, of course, be performed after the obtained material has been molded or machined into a desired shape.

When the soft magnetic alloy according to the present invention is manufactured, the material obtained by the rapid cooling method must be subjected to heat treatment in which it is heated at a desired heating rate, the temperature is maintained at a predetermined temperature range, and the material is cooled. It is preferable that the heat treatment temperature be 400° to 750° C. It is also preferable that the heating rate at the time of performing the heat treatment is 1.0° C./minute or higher. The inventors of the present invention found that the heating rate at the time of performing the heat treatment affects the magnetic permeability of the soft magnetic alloy subjected to the heat treatment. By determining the heating rate to be 1.0° C./minute or higher, a soft magnetic alloy having a high magnetic permeability can stably be manufactured.

The "heating rate" is a value obtained by, with time, differentiating the time change which takes from a moment at which an alloy to be processed is injected into a heating furnace, to a moment at which a predetermined heat treatment temperature is realized.

The soft magnetic alloy according to an embodiment of the present invention necessarily contains B added thereto. Boron has an effect of improving the performance of the soft magnetic alloy for forming amorphous alloys and an effect of improving the thermal stability of a Fe—M (=Zr, Hf, Nb or the like) microcrystalline alloy to serve as a barrier against the grain coarsening. Further, it has an effect of leaving an amorphous phase, which is thermally stable, in the grain boundary. As a result, a structure mainly composed of fine crystalline grains having a grain size of 30 nm or less and formed into a body-centered cubic structure (bcc structure) can be obtained in the foregoing heat treatment under a wide heat treatment condition from 400° to 750° C., the grain size of 30 nm being the size that does not adversely affect the magnetic characteristics. Similarly to B, Al, Si, C and P and the like are usually used as elements for forming amorphous structure. The arrangements to which the foregoing elements are added can be considered to be the same as the present invention.

The soft magnetic alloy according to a first aspect of the present invention must contain Zr or Hf exhibiting the performance of forming the amorphous structure in order to easily obtain the amorphous phase. A portion of Zr and that of Hf may be substituted by Ti, V, Nb, Ta, Mo or W among group 4A to 6A elements of the periodic table. In this case the quantity of B is 0.5 to 10 atom % or the same is 0.5 to 18 atom % if element T is contained to obtain satisfactory performance of forming the amorphous structure. By dissolving Zr and Hf, which are elements that are not dissolved in Fe in the equilibrium state, the magnetostriction can be reduced. That is, the dissolved quantity of Zr and Hf can be adjusted by the heat treatment conditions. Therefore, the magnetostriction can be adjusted and reduced.

Hence, a low magnetostriction can be obtained by obtaining fine crystalline structure under wide heat treatment conditions. The fact that the fine crystalline structure can be obtained under the wide heat treatment conditions by adding B enables both reduced magnetostriction and small magnetocrystalline anisotropy to be possessed, resulting in that excellent magnetic characteristics can be obtained.

If Cr, Ru, Rh or Ir is added to the foregoing composition if necessary, the corrosion resistance can be improved. In order to maintain the saturation magnetic flux density at 10 kG or more, the quantity of the element added must be 5 atom % or less.

The capability that a fine crystalline structure can be obtained by partially crystallizing the Fe—M (=Zr, Hf) amorphous alloy by a special method has been disclosed by the inventors of the present invention on p.p. 217 to 221 of "CONFERENCE ON METALLIC SCIENCE AND TECHNOLOGY BUDAPEST", 1980. A fact has been found due to the studies made since then that the compositions disclosed this time enables a similar effect to be obtained, resulting in the present invention. The reason why the fine crystalline structure can be obtained is that fluctuation of the composition takes place in the rapidly solidified state in the process for forming the amorphous phase for manufacturing the alloy, the fluctuation brings about an increase of the frequency of nucleation resulting in a multiplicity of uniform and fine nuclei to be generated.

The content of Fe in the soft magnetic alloys according to the embodiment of the present invention or the quantity of Fe, Co or Ni is 93 atom %. If the content is larger than 93 atom %, a high magnetic permeability cannot be obtained. However, it is preferable that the content be 75 atom % or more in order to obtain a saturation magnetic flux density of 10 kG or more.

It is preferable that the soft magnetic alloys according to a second aspect of the present invention contain one or more elements selected from a group consisting of Cu, its homolog elements Ag, Au, Pd, Pt and Bi by a quantity of 4.5 atom % or less. If the quantity of addition of the elements is smaller than 0.2 atom %, excellent soft magnetic characteristics cannot easily be obtained from the foregoing heat treatment process. By raising the heating rate, the magnetic permeability can be improved and the saturation magnetic flux density can be somewhat improved. Therefore, the contents of the foregoing elements may be made 0.2 atom % or less. By determining the contents of the foregoing elements to be 0.2 to 4.5 atom %, excellent soft magnetic characteristics can be obtained even if the heating rate is not raised considerably. Therefore, it is further preferable that the content of 0.2 to 4.5 atom % be employed.

Among the foregoing elements, Cu is very effective. Although a mechanism of considerably improving the soft magnetic characteristics by the addition of Cu or Pd has not been clarified yet, measurements of the crystallizing temperature by a differential thermal analysis method resulted a fact to be confirmed that the crystallization temperature of the alloy, to which Cu or Pd is added, is somewhat lower than that of an alloy to which Cu or Pd is not added. It can be considered that the addition of the foregoing element enhances the fluctuation in the amorphous phase, causing the stability of the amorphous phase to deteriorate. As a result, the crystalline phase can easily be precipitated.

If nonhomogeneous amorphous phase is crystallized, a multiplicity of regions, in which partial crystallization can easily be taken place, are generated and, accordingly, a large number of nuclei are generated. Therefore, the obtainable structure is made to be fine crystalline grain structure, causing excellent magnetic characteristics to be obtained. If the heating rate is further raised, formation of the fine crystalline structure is enhanced. Therefore, if the heating rate is very high, element Cu or Pd may be contained by a quantity smaller than 0.2 atom %. Since Cu is an element which displays very low solid solubility with respect to Fe and which therefore shows a phase separation tendency, the micro-structure encounters fluctuation due to heat application. Therefore, the tendency of the nonhomogeneity in amorphous phase is further enhanced, resulting in contribution to refine down the structure. Therefore, elements capable of lowering the crystallization temperature are expected to enable a similar effect to be obtained as well as Cu, its homolog element, Pd and Pt. Further, an element, such as Bi, having a small solid solubility with respect to Fe, is, as well as Cu, expected to enable a similar effect to be obtained.

In order to cause the soft magnetic alloys according to a third aspect of the present invention to easily obtain the amorphous phase, Nb and B must be contained which has performance for forming the amorphous structure.

Among a group consisting of Ti, V, Ta, Mo and W, each of which enables a similar effect to be obtained, V, Nb and Mo displays a restricted tendency of generating an oxide and, accordingly, a satisfactory manufacturing yield can be realized. Therefore, the addition of the foregoing element relaxes the manufacturing conditions, the manufacturing cost can be reduced and therefore an advantage can be obtained in the cost reduction. Specifically, while partially supplying inactive gas to the leading portion of the nozzle, manufacturing can be performed in the atmosphere or under the ambience of the atmosphere.

However, since the foregoing elements suffers from unsatisfactory performance of forming the amorphous structure as compared with Zr and Hf, the soft magnetic alloys according to the third aspect are so arranged that the quantity of B is increased and its limit is made to be 6.5 atom %. If element T is added, the effect obtainable from the addition of T enables the upper limit of the quantity of B can be set to 18 atom %. However, if T is not added, the magnetic characteristics deteriorate in a case where the quantity is larger than 14 atom %. Therefore, the upper limit in this case is determined to be 14 atom %.

The reason why the alloy elements contained in the soft magnetic alloy according to the present invention is as described above. A platinum group element, such as Ru, Rh or Ir or Cr may be added in order to improve the corrosion resistance as well as the foregoing elements. If necessary, Y, a rare earth metal, Zn, Cd, Ga, In, Ge, Sn, Pb, As, Sb, Se, Te, Li, Be, Mg, Ca, Sr or Ba or the like may be added to adjust the magnetostriction. As for the unavoidable impurity such as H, N, O or S or the like, a composition which contains it by a quantity that does not deteriorate the desired characteristics can, of course, be considered to be the same as the composition of the Fe-base soft magnetic alloy according to the present invention.

EXAMPLES

Alloys according to the following examples were manufactured by a single roller melt spinning method. Namely, melted alloy is, by the pressure of argon gas, jetted out from a nozzle placed on one rotating Cu or steel roll onto the foregoing roll, and the temperature is rapidly lowered so that a ribbon is obtained. The ribbon thus made has a width of about 15 mm and a thickness of about 8 to 40 μm.

The magnetic permeability was measured in such a manner that the foregoing ribbon was machined to be formed into an annular shape having, in Examples 1 to 17, an outer diameter of 10 mm and an inner diameter of 6 mm, then a coil is formed around a structure formed by stacking the foregoing annular members and an inductance method was employed to measure the magnetic permeability.

Example 1

The relationship between the heating rate at the time of the heat treatment and the magnetic permeability of a soft magnetic alloy obtained after the foregoing heat treatment had been performed was examined. The examinations were performed such that the heat treatment was applied to the alloys respectively having the compositions shown in Table 1 while changing the heating rate (°C./minute), and the magnetic permeability (μ) of the alloy applied with the heat treatment was measured. The heat treatment was performed under the following conditions: an infrared-ray image furnace was used; and a temperature of 650° C. is maintained for one hour in a vacuum atmosphere. The cooling rate after the heat treatment had been performed was made to be a constant rate of 10° C./minute. The magnetic permeability was measured by using an impedance analyzer under conditions of 1 kHz and 0.4 A/m (5 mOe). Results of the foregoing measurements are shown in Table 1 and FIG. 1.

Further, the relationship between the various heating rate and the magnetic permeabilities of the alloys was obtained by measuring the magnetic permeability of the samples subjected to isothermal annealing at a temperature of Ta for 1 hour. Table 2 shows the results of the measurements of the magnetic permeabilities of the samples in a case where the heating rate was made to be 0.5° C./minute. Table 3 shows the results of the measurements of the magnetic permeabilities of the samples, the compositions of which are the same as those of the samples shown in Table 2, in a case where the heating rate was made to be 5° C./minute. Table 4 shows the results of the measurements of the magnetic permeabilities of the samples, the compositions of which are the same as those of the samples shown in Table 2, in a case where the heating rate was made to be 80° C./minute. Table 5 shows the results of the measurements of the magnetic permeabilities of the samples, the compositions of which are the same as those of the samples shown in Table 2, in a case where the heating rate was made to be 160° C./minute. The residual measuring conditions were the same as those of the foregoing measurements.

TABLE 1

| Temperature Raising Speed | $Fe_{90}Zr_7B_3$ | $Fe_{89}Zr_7B_4$ | $Fe_{89}Zr_6B_5$ | $Fe_{89}Hf_7B_4$ | $Fe_{84}Nb_7B_9$ |
|---|---|---|---|---|---|
| 0.5 | 1800 | | | 4500 | 5500 |
| 1.5 | 5100 | | | 8800 | 12100 |
| 2.5 | 5000 | | | 11700 | 14300 |
| 5 | 6800 | 5600 | | 13600 | 17500 |
| 10 | 7400 | | 9200 | 13400 | 23000 |
| 40 | 15100 | 10900 | | 21500 | 17300 |
| 100 | 19000 | | | 20600 | 23500 |
| 200 | 22000 | 15000 | 18400 | 32000 | 24000 |

TABLE 2

| Sample No. | Composition of Alloy (at %) | Ta (°C.) | μ(1 kHz) |
|---|---|---|---|
| 1 | $Fe_{91}Zr_7B_2$ | 650 | 2100 |
| 2 | $Fe_{90}Zr_7B_3$ | 650 | 1800 |
| 3 | $(Fe_{99.5}Co_{0.5})_{90}Zr_7B_3$ | 650 | 1810 |
| 4 | $(Fe_{99}Co_1)_{90}Zr_7B_3$ | 650 | 2250 |
| 5 | $(Fe_{98.5}Co_{1.5})_{90}Zr_7B_3$ | 650 | 1840 |
| 6 | $(Fe_{98}Co_2)_{90}Zr_7B_3$ | 650 | 1780 |
| 7 | $(Fe_{95}Co_5)_{90}Zr_7B_3$ | 650 | 1690 |
| 8 | $(Fe_{99.5}Ni_{0.5})_{90}Zr_7B_3$ | 600 | 1450 |
| 9 | $(Fe_{95}Ni_5)_{90}Zr_7B_3$ | 600 | 1900 |
| 10 | $Fe_{89}Zr_7B_3Cu_1$ | 600 | 14500 |
| 11 | $Fe_{89}Zr_7B_3Ru_1$ | 600 | 1760 |
| 12 | $Fe_{89.5}Zr_7B_3Pd_{0.5}$ | 650 | 2400 |
| 13 | $Fe_{89}Zr_7B_3Pd_1$ | 650 | 5010 |
| 14 | $(Fe_{99}Co_1)_{84}Nb_7B_9$ | 650 | 5850 |
| 15 | $(Fe_{95}Co_5)_{84}Nb_7B_9$ | 650 | 4670 |
| 16 | $(Fe_{99}Ni_1)_{84}Nb_7B_9$ | 650 | 5160 |
| 17 | $Fe_{81}Ti_7B_{11}Cu_1$ | 600 | 7300 |
| 18 | $Fe_{81}Ta_7B_{11}Cu_1$ | 600 | 6620 |
| 19 | $Fe_{87}Ti_1Zr_2Hf_2V_1Nb_1B_6$ | 600 | 3720 |
| 20 | $Fe_{89}Zr_7B_3Bi_1$ | 600 | 1520 |
| 21 | $(Fe_{99}Ni_1)_{90}Zr_7B_3$ | 600 | 1590 |

Heating rate: 0.5° C./m
Shape of sample: annular (inner diameter: 6 mm, outer diameter: 10 mm)
Measuring magnetic field: 5 mOe

TABLE 3

| Sample No. | Composition of Alloy (at %) | Ta (°C.) | μ(1 kHz) |
|---|---|---|---|
| 22 | $Fe_{91}Zr_7B_2$ | 650 | 4700 |
| 23 | $Fe_{90}Zr_7B_3$ | 650 | 6800 |
| 24 | $(Fe_{99.5}Co_{0.5})_{90}Zr_7B_3$ | 650 | 4000 |
| 25 | $(Fe_{99}Co_1)_{90}Zr_7B_3$ | 650 | 4100 |
| 26 | $(Fe_{98.5}Co_{1.5})_{90}Zr_7B_3$ | 650 | 4700 |
| 27 | $(Fe_{98}Co_2)_{90}Zr_7B_3$ | 650 | 5000 |
| 28 | $(Fe_{95}Co_5)_{90}Zr_7B_3$ | 650 | 4400 |
| 29 | $(Fe_{99.5}Ni_{0.5})_{90}Zr_7B_3$ | 600 | 6100 |
| 30 | $(Fe_{95}Ni_5)_{90}Zr_7B_3$ | 600 | 7900 |
| 31 | $Fe_{89}Zr_7B_3Cu_1$ | 600 | 20400 |
| 32 | $Fe_{89}Zr_7B_3Ru_1$ | 600 | 5600 |
| 33 | $Fe_{89.5}Zr_7B_3Pd_{0.5}$ | 650 | 7400 |
| 34 | $Fe_{89}Zr_7B_3Pd_1$ | 650 | 9300 |
| 35 | $(Fe_{99}Co_1)_{84}Nb_7B_9$ | 650 | 9100 |
| 36 | $(Fe_{95}Co_5)_{84}Nb_7B_9$ | 650 | 5010 |
| 37 | $(Fe_{99}Ni_1)_{84}Nb_7B_9$ | 650 | 7900 |
| 38 | $Fe_{81}Ti_7B_{11}Cu_1$ | 600 | 8100 |
| 39 | $Fe_{81}Ta_7B_{11}Cu_1$ | 600 | 8200 |
| 40 | $Fe_{87}Ti_1Zr_2Hf_2V_1Nb_1B_6$ | 600 | 5500 |
| 41 | $Fe_{89}Zr_7B_3Bi_1$ | 600 | 5600 |
| 42 | $(Fe_{99}Ni_1)_{90}Zr_7B_3$ | 600 | 6800 |

Heating rate: 5° C./m
Shape of sample: annular (inner diameter: 6 mm, outer diameter: 10 mm)
Measuring magnetic field: 5 mOe

TABLE 4

| Sample No. | Composition of Alloy (at %) | Ta (°C.) | μ(1 kHz) |
|---|---|---|---|
| 43 | $Fe_{91}Zr_7B_2$ | 650 | 17900 |
| 44 | $Fe_{90}Zr_7B_3$ | 650 | 19200 |
| 45 | $(Fe_{99.5}Co_{0.5})_{90}Zr_7B_3$ | 650 | 24300 |
| 46 | $(Fe_{99}Co_1)_{90}Zr_7B_3$ | 650 | 17300 |
| 47 | $(Fe_{98.5}Co_{1.5})_{90}Zr_7B_3$ | 650 | 18100 |
| 48 | $(Fe_{98}Co_2)_{90}Zr_7B_3$ | 650 | 18400 |
| 49 | $(Fe_{95}Co_5)_{90}Zr_7B_3$ | 650 | 8220 |
| 50 | $(Fe_{99.5}Ni_{0.5})_{90}Zr_7B_3$ | 600 | 28000 |
| 51 | $(Fe_{95}Ni_5)_{90}Zr_7B_3$ | 600 | 9040 |
| 52 | $Fe_{89}Zr_7B_3Cu_1$ | 600 | 45200 |
| 53 | $Fe_{89}Zr_7B_3Ru_1$ | 600 | 16200 |
| 54 | $Fe_{89.5}Zr_7B_3Pd_{0.5}$ | 650 | 17700 |
| 55 | $Fe_{89}Zr_7B_3Pd_1$ | 650 | 20800 |
| 56 | $(Fe_{99}Co_1)_{84}Nb_7B_9$ | 650 | 14700 |
| 57 | $(Fe_{95}Co_5)_{84}Nb_7B_9$ | 650 | 8520 |
| 58 | $(Fe_{99}Ni_1)_{84}Nb_7B_9$ | 650 | 14800 |
| 59 | $Fe_{81}Ti_7B_{11}Cu_1$ | 600 | 16500 |
| 60 | $Fe_{81}Ta_7B_{11}Cu_1$ | 600 | 14500 |
| 61 | $Fe_{87}Ti_1Zr_2Hf_2V_1Nb_1B_6$ | 600 | 9130 |
| 62 | $Fe_{89}Zr_7B_3Bi_1$ | 600 | 16500 |
| 63 | $(Fe_{99}Ni_1)_{90}Zr_7B_3$ | 600 | 23400 |

Heating rate: 80° C./m
Shape of sample: annular (inner diameter: 6 mm, outer diameter: 10 mm)
Measuring magnetic field: 5 mOe

TABLE 5

| Sample No. | Composition of Alloy (at %) | Ta (°C.) | μ(1 kHz) |
|---|---|---|---|
| 64 | $Fe_{91}Zr_7B_2$ | 650 | 18700 |
| 65 | $Fe_{90}Zr_7B_3$ | 650 | 24100 |
| 66 | $(Fe_{99.5}Co_{0.5})_{90}Zr_7B_3$ | 650 | 27000 |
| 67 | $(Fe_{99}Co_1)_{90}Zr_7B_3$ | 650 | 22100 |
| 68 | $(Fe_{98.5}Co_{1.5})_{90}Zr_7B_3$ | 650 | 23300 |
| 69 | $(Fe_{98}Co_2)_{90}Zr_7B_3$ | 650 | 19600 |
| 70 | $(Fe_{95}Co_5)_{90}Zr_7B_3$ | 650 | 10300 |
| 71 | $(Fe_{99.5}Ni_{0.5})_{90}Zr_7B_3$ | 600 | 17300 |
| 72 | $(Fe_{95}Ni_5)_{90}Zr_7B_3$ | 600 | 18700 |
| 73 | $Fe_{89}Zr_7B_3Cu_1$ | 600 | 44200 |
| 74 | $Fe_{89}Zr_7B_{3Ru1}$ | 600 | 19800 |
| 75 | $Fe_{89.5}Zr_7B_3Pd_{0.5}$ | 650 | 22000 |
| 76 | $Fe_{89}Zr_7B_3Pd_1$ | 650 | 22400 |
| 77 | $(Fe_{99}Co_1)_{84}Nb_7B_9$ | 650 | 18300 |
| 78 | $(Fe_{95}Co_5)_{84}Nb_7B_9$ | 650 | 9750 |
| 79 | $(Fe_{99}Ni_1)_{84}Nb_7B_9$ | 650 | 16100 |
| 80 | $Fe_{81}Ti_7B_{11}Cu_1$ | 600 | 16800 |
| 81 | $Fe_{81}Ta_7B_{11}Cu_1$ | 600 | 16500 |
| 82 | $Fe_{87}Ti_1Zr_2Hf_2V_1Nb_1B_6$ | 600 | 10800 |
| 83 | $Fe_{89}Zr_7B_3Bi_1$ | 600 | 18900 |
| 84 | $(Fe_{99}Ni_1)_{90}Zr_7B_3$ | 600 | 19200 |

Heating rate: 160° C./m
Shape of sample: annular (inner diameter: 6 mm, outer diameter: 10 mm)
Measuring magnetic field: 5 mOe It is apparent from the results of the measurements shown in Tables 1 to 5 and FIG. 1 that the magnetic permeabilities of the samples of the soft magnetic alloys considerably depend upon the heating rate at the time of the heat treatment and the magnetic permeability is raised substantially in proportion to the heating rate. A fact was found from the results shown in Tables 1 to 5 and FIG. 1 that the preferable heating rate (°C./minute) is 1.0 or higher to maintain the magnetic permeability at 5000 or more.

Then, the actual magnetic permeability (μe) was measured in each example under conditions of 5 mOe and 1 kHz. The coercive force (Hc) was measured by a DC B-H loop tracer, and the saturation magnetic flux density (Bs) was calculated in accordance with the magneticization measured at 10 kOe with a VSM.

In the following Examples 2 to 6, the magnetic characteristics were obtained by maintaining the temperature at 600° C. or 650° C. for one hour, followed by performing a water quenching. In Examples 7 to 17, the magnetic characteristics were obtained by maintaining the temperature at 500° to 700° C. for one hour. The heating rate was set to 80° to 100° C./minute.

Example 2

The effect of the heat treatment acting on the magnetic characteristics and the structure of a fourth aspect of the present invention will now be described in such a manner that a $Fe_{90}Zr_7B_3$ alloy which is one of the basic composition of the foregoing alloy is explained as an example. The temperature at which the crystallization of the $Fe_{90}Zr_7B_3$ alloy obtained from a differential thermal analysis at a heating rate of 10° C./minute was 480° C.

Figure 2:
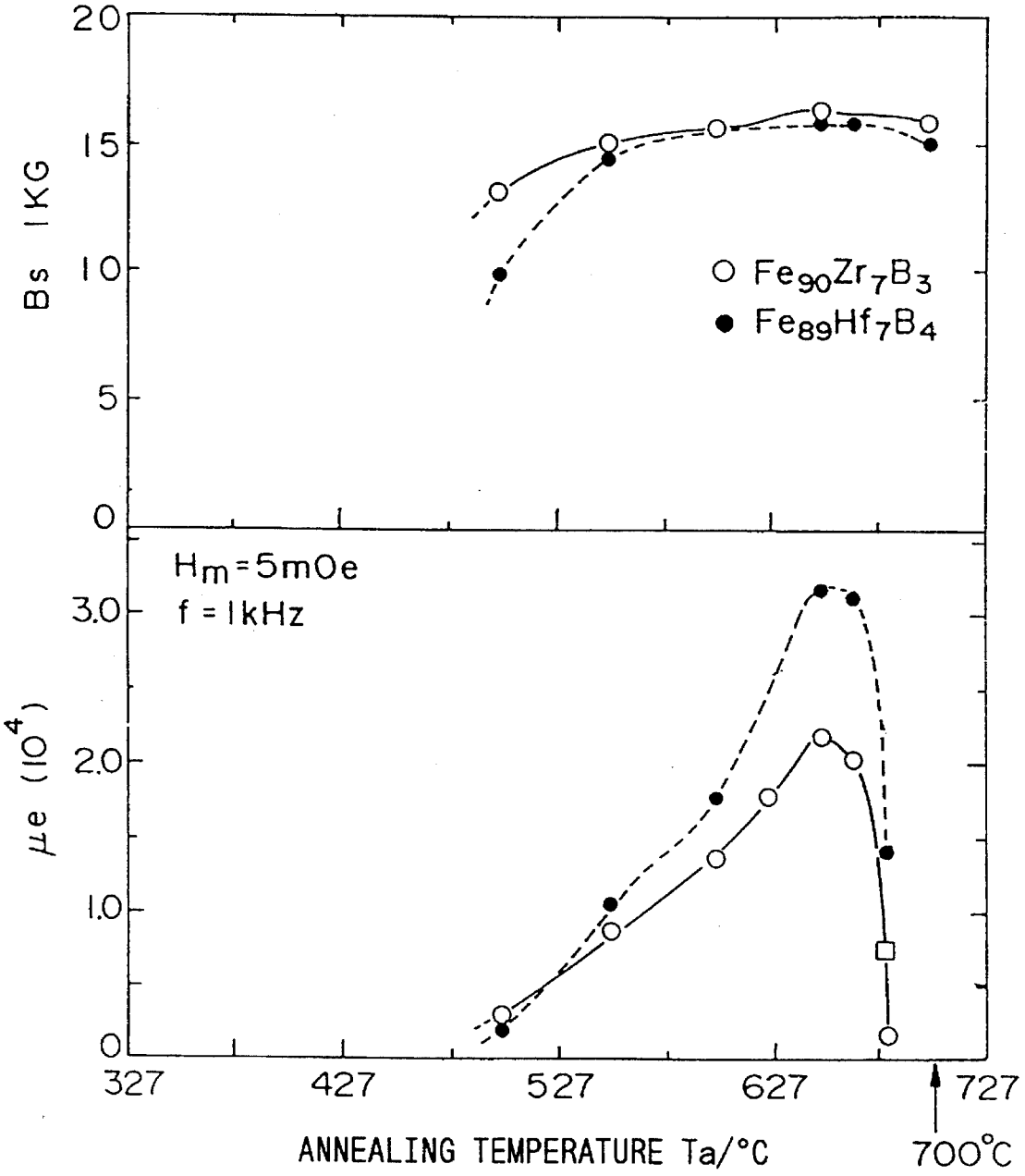
FIG. 2 is a graph which shows both the relationship between the saturation magnetic flux density and the annealing temperature and the relationship between the effective magnetic permeability and the annealing temperature of the example of an alloy according to the present invention.

FIG. 2 illustrates an effect of annealing (maintained at each temperature for one hour) upon the effective magnetic permeability of the $Fe_{90}Zr_7B_3$ alloy. As can be understood from FIG. 2, the effective magnetic permeability becomes low in proportion to the annealing temperature and it is rapidly increased by performing the annealing at 500° to 650° C.

The dependency of the magnetic permeability upon the frequency of a sample subjected to the heat treatment performed at 650° C. and having a thickness of about 20 μm was examined, resulting in that excellent soft magnetic characteristics were attained even at high measuring frequencies such that 26500 was attained at 1 KHz, 19800 was attained at 10 KHz and 7800 was attained at 100 KHz.

Then, the change in the structure of the $Fe_{90}Zr_7B_3$ alloy subjected to the heat treatment was examined by an X-ray analysis method, and the structure formed after the heat treatment had been performed was observed by using a transmission electronic microscope. Results of the examination is shown in FIGS. 3 and 4.

Figure 3:
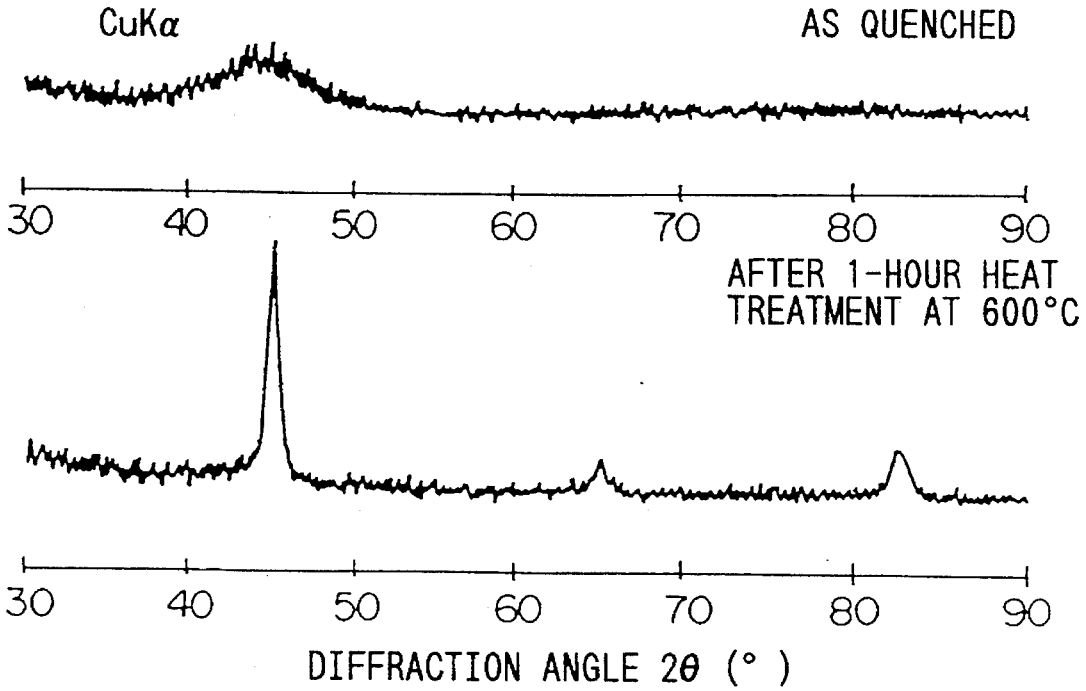
FIG. 3 is a graph which shows results of an X-ray diffractometry showing the structural change of an alloy according to the present invention taken place before and after the heat treatment.
Figure 4:
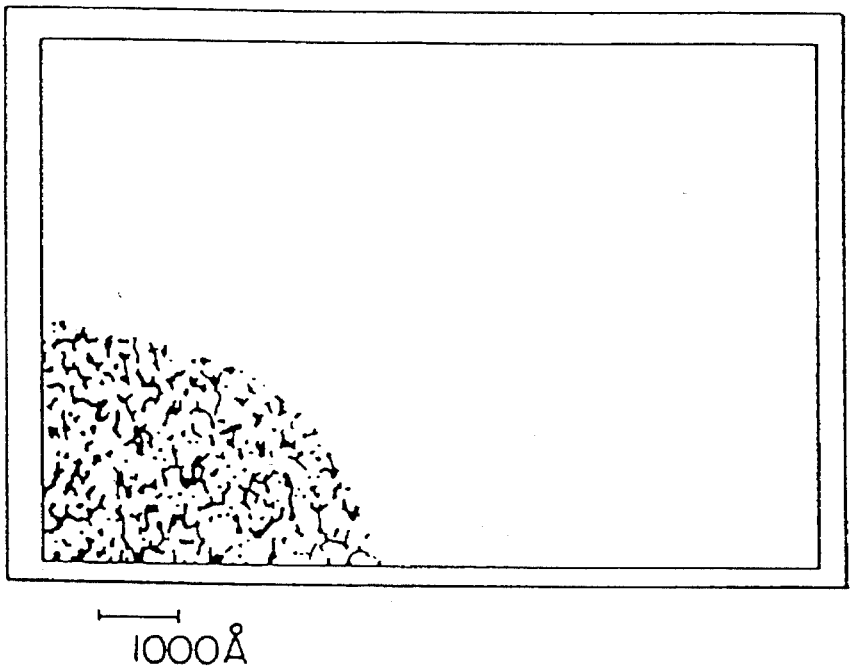
FIG. 4 is a schematic view of a microscope photograph showing the structure of an example of an alloy according to the present invention after the heat treatment has been performed.
Figure 5:
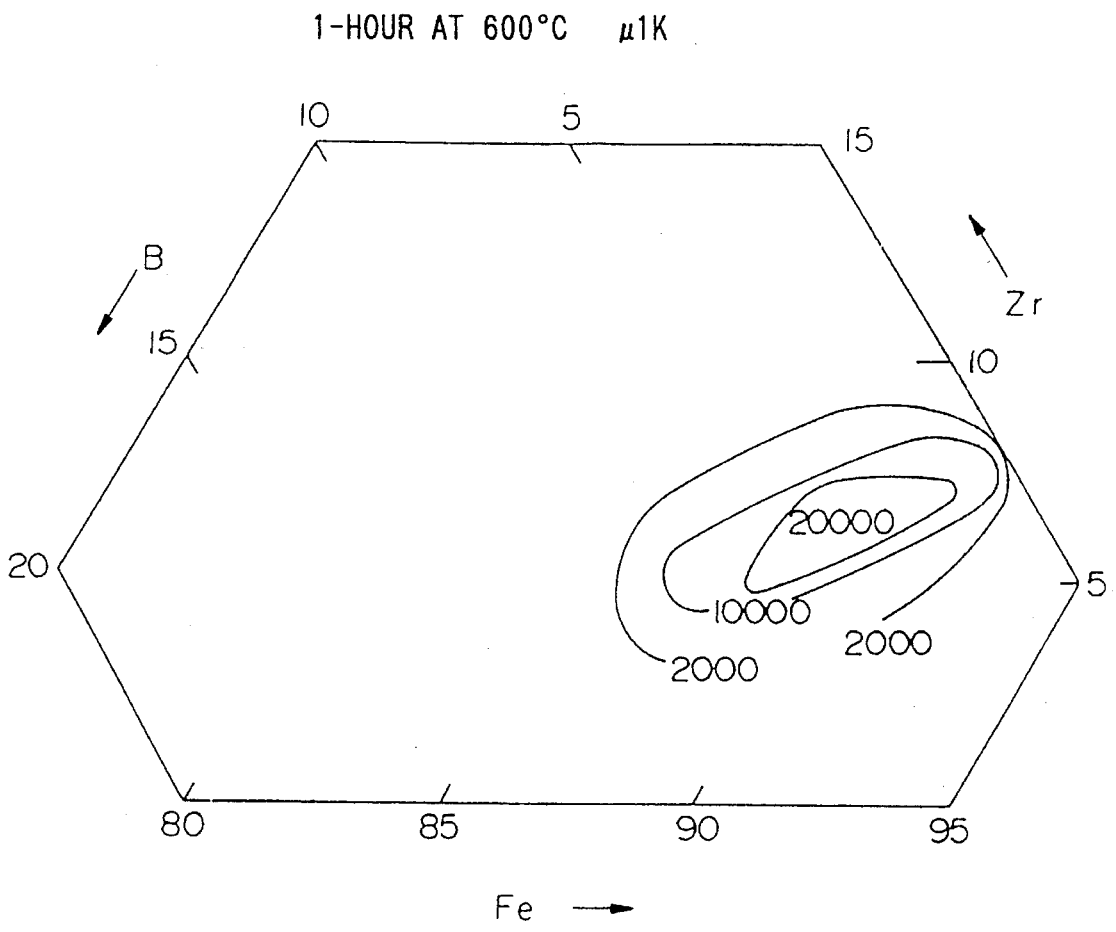
FIG. 5 is a triangular composition view which shows the magnetic permeability of an example of an alloy system according to the present invention subjected to isothermal annealing for 1 hour at 600° C. in a case where the quantities of Zr, B and Fe are changed.
Figure 6:
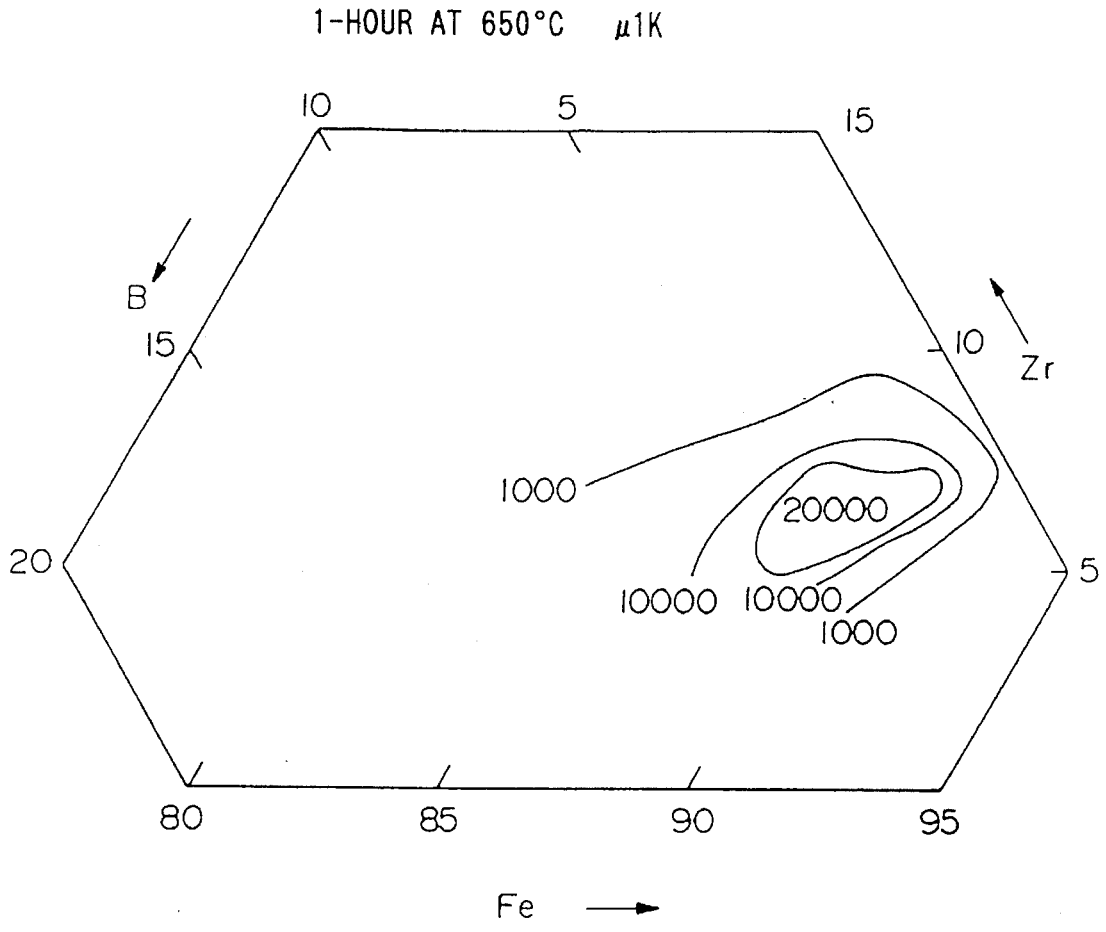
FIG. 6 is a triangular composition view which shows the magnetic permeability of an example of an alloy system according to the present invention subjected to isothermal annealing for 1 hour at 650° C. in a case where the quantities of Zr, B and Fe are changed.
Figure 7:
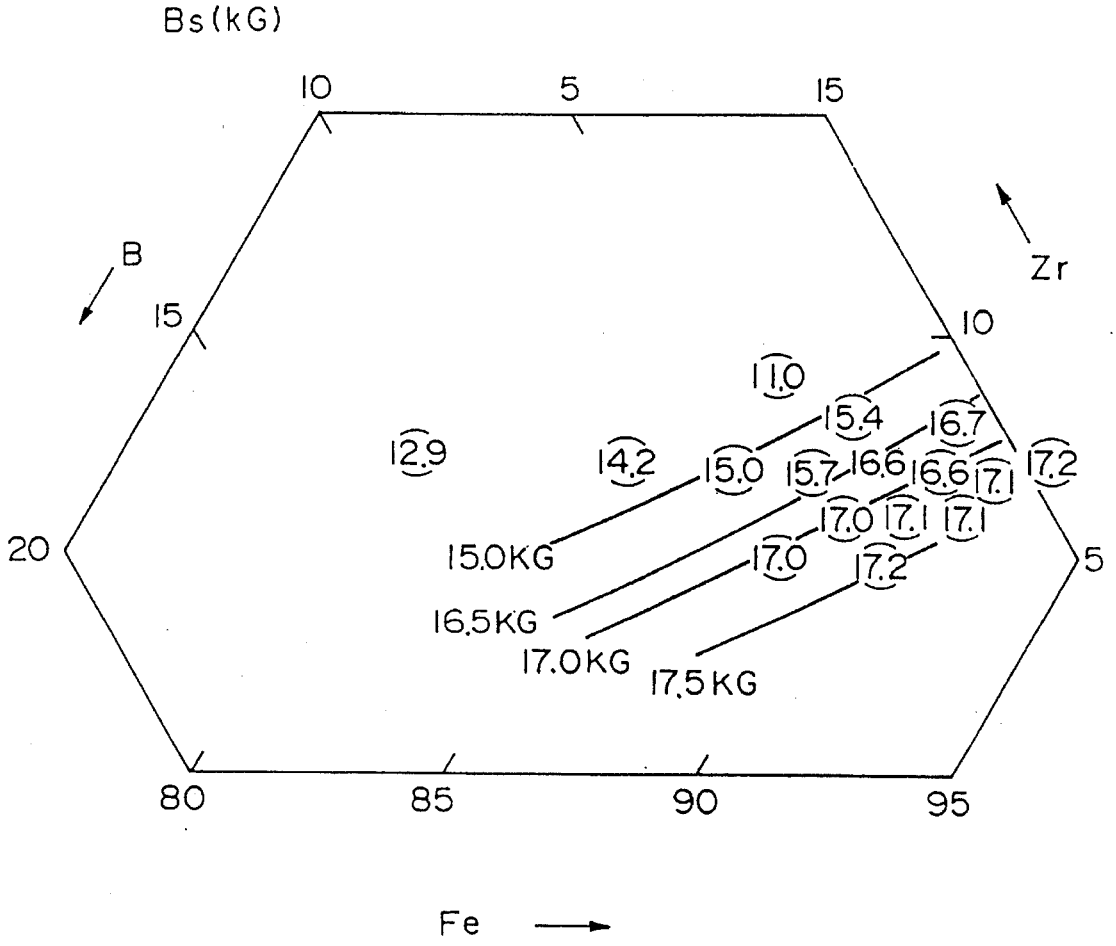
FIG. 7 is a triangular composition view which shows the saturation magnetic flux density in a case where the quantities of Zr, B and Fe are changed.
Figure 8:
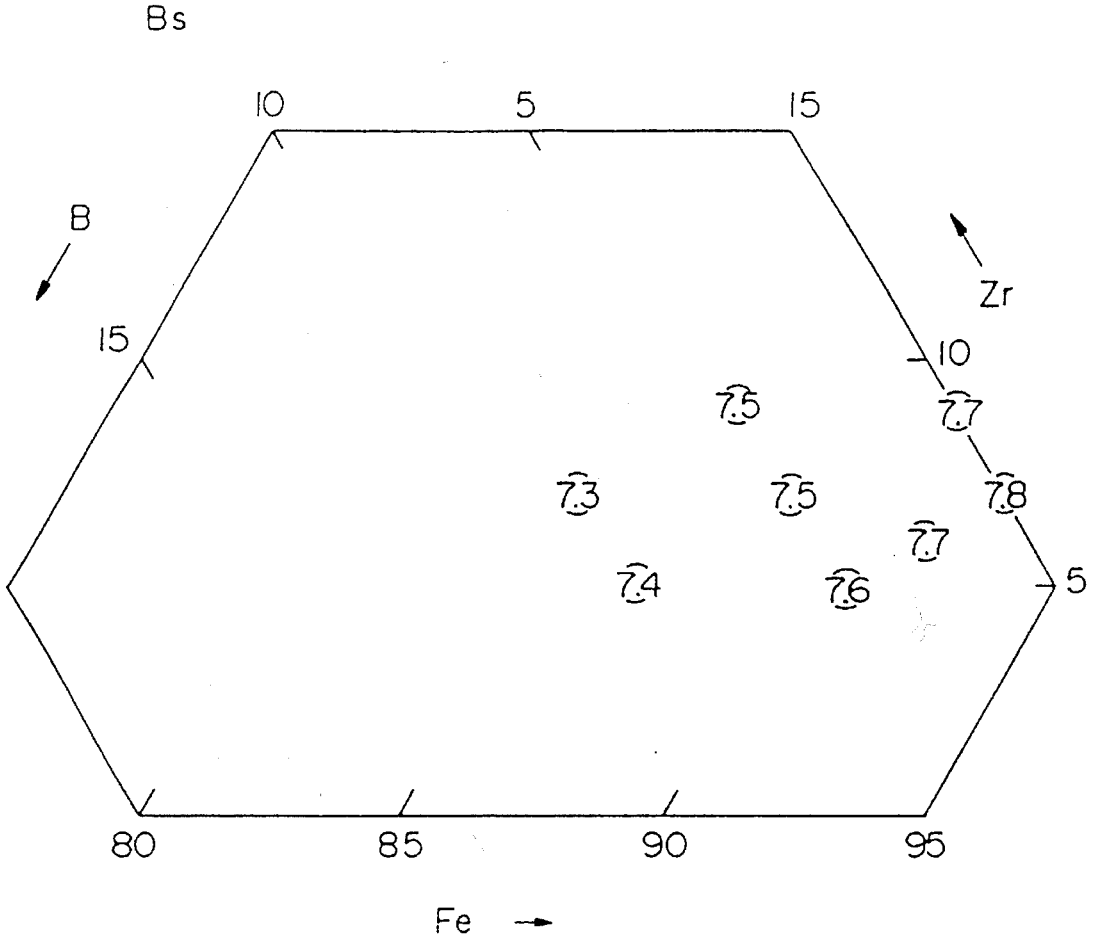
FIG. 8 is a triangular composition view which shows the saturation magnetic flux density in a case where the quantities of Zr, B and Fe are changed.

As can be understood from FIG. 3, a halo diffraction pattern corresponding to the amorphous was observed in a rapidly solidified state, and a diffraction pattern corresponding to a body-centered cubic structure was observed after the heat treatment had been performed. Therefore, it has been understood that the structure of the alloy according to the present invention has been changed from amorphous to the body-centered cubic structure (bcc crystal). Further, another fact can be understood from the results of the observation of the structure shown in FIG. 4 that the structure realized after the heat treatment had been performed was composed of fine crystal, the grain size of which was about 10 to 20 nm.

The change of the hardness of the $Fe_{90}Zr_7B_3$ alloy before and after the heat treatment was examined, resulting in that the Vickers hardness was, due to the heat treatment performed at 600° C., improved from 750 DPN in the rapidly solidified state to 1400 DPN, which is excellent hardness that cannot be obtained from a conventional material. Therefore, the foregoing alloy is suitable as the material for the magnetic head.

As described above, the alloy according to this embodiment has a structure mainly composed of very small crystalline grains by crystallizing the amorphous alloys having the foregoing compositions by the heat treatment. Therefore, excellent characteristics can be attained such that the saturation magnetic flux density is very high, excellent soft magnetic characteristics, satisfactory hardness and excellent heat stability are attained.

Examples in which the quantities of Zr and B in the foregoing alloy are changed will now be described. Tables 6 and FIGS. 5, 6, 7 and 8 show the magnetic characteristics realized after annealing has been performed.

TABLE 6

| Sample No. | Composition of Alloy (atom %) | Heat Treatment °C. 1h | Magnetic Permeability μ (1 kHz) | Saturation Magnetic Flux Density Bs (G) |
|---|---|---|---|---|
| 85 | $Fe_{91}Zr_8B_1$ | 600 | 12384 | 16700 |
| 86 | $Fe_{91}Zr_9$ | 600 | 1056 | 16500 |
| 87 | $Fe_{89}Zr_9B_4$ | 600 | 1901 | 14900 |
| 88 | $Fe_{91}Zr_5B_4$ | 600 | 3390 | 17300 |
| 89 | $Fe_{89}Zr_5B_6$ | 600 | 24384 | 17000 |
| 90 | $Fe_{87}Zr_5B_8$ | 600 | 10829 | 16000 |
| 91 | $Fe_{87}Zr_3B_{10}$ | 600 | 296 | 17200 |
| 92 | $Fe_{87}B_{13}$ | 600 | 192 | 18000 |
| 93 | $Fe_{81}Zr_7B_{12}$ | 600 | 230 | 12900 |
| 94 | $Fe_{85}Zr_{11}B_4$ | 600 | 2 | 9000 |
| 95 | $Fe_{93}Zr_7$ | 600 | 4550 | 17300 |
| 96 | $Fe_{91}Zr_7B_2$ | 600 | 24384 | 16600 |
| 97 | $Fe_{89}Zr_7B_4$ | 600 | 20554 | 16000 |
| 98 | $Fe_{92}Zr_7B_1$ | 600 | 17184 | 17100 |
| 99 | $Fe_{90}Zr_7B_3$ | 600 | 23808 | 16600 |
| 100 | $Fe_{88}Zr_7B_5$ | 600 | 8794 | 15500 |
| 101 | $Fe_{91}Zr_7B_3$ | 600 | 19776 | 17100 |
| 102 | $Fe_{90}Zr_6B_4$ | 600 | 22464 | 17000 |
| 103 | $Fe_{90}Zr_8B_2$ | 600 | 10944 | 15900 |
| 104 | $Fe_{89}Zr_8B_3$ | 600 | 8083 | 15400 |

80° C./minute to 100° C./minute
Note) Sample Nos. 91, 92, 93, 94 and 95 are comparative examples.

As can be understood from Table 6, and FIGS. 5, 6, 7 and 8, high magnetic permeability and high saturation magnetic flux density can easily be obtained if the quantity of Zr ranges from 4 to 9 atom %. If the quantity of Zr is 4 atom % or less, an effective magnetic permeability higher than 10000 cannot be obtained. If the quantity is larger than 9 atom %, the magnetic permeability is rapidly lowered and the saturation magnetic flux density is also lowered. Therefore, the range of the quantity of Zr in the alloy according to a fifth aspect of the present invention is made to be 4 to 9 atom %.

As for the quantity of B, a fact was found that high magnetic permeability of 5000 or more of an effective magnetic permeability, preferably 10000 or more, can easily be obtained in a range from 0.5 atom % to 10 atom %. Therefore, the quantity of B is determined to be 0.5 to 10 atom %. If the quantity of Fe is larger than 93 atom %, high magnetic permeability cannot be obtained although the quantities of Zr and B are in the foregoing ranges. Therefore, the basic quantity of Fe to be contained in the alloy according to the embodiment of the present invention is determined to be 93 atom %.

Example 3

A Fe—Hf—B alloy system obtained by substituting Zr of the Fe—Zr—B alloy system according to Example 2 by Hf will now be described.

Results of examples, in which the quantity of Hf in the Fe—Hf—B alloy system was changed in a range from 4 to 9 atom %, are shown in Table 7.

TABLE 7

| Sample No. | Composition of Alloy (atom %) | Magnetic Permeability μ (1 KHz) | Saturation Magnetic Flux Density Bs (G) |
|---|---|---|---|
| 105 | $Fe_{88}Hf_4B_8$ | 8200 | 16200 |
| 106 | $Fe_{89}Hf5_4B_6$ | 17200 | 16000 |
| 107 | $Fe_{90}Hf5_6B_4$ | 24800 | 15500 |
| 108 | $Fe_{89}Hf5_7B_4$ | 28000 | 15000 |
| 109 | $Fe_{88}Hf_8B_4$ | 25400 | 14500 |
| 110 | $Fe_{87}Hf_9B_4$ | 12100 | 14000 |
| 111 | $Fe_{91}Zr_4Hf_3B_2$ | 27800 | 16500 |

As can be understood from Table 7, the effective magnetic permeability of the Fe—Hf—B alloy system is equivalent to that of the Fe—Zr—B alloy system if the quantity of Hf ranges from 4 to 9 atom %.

The magnetic characteristics of a $Fe_{91}Zr_4Hf_3B_2$ alloy shown in Table 7 are equivalent to those of the Fe—Zr—B alloy system according to Example 2. Therefore, it has been found that Zr in the Fe—Zr—B alloy system according to Example 2 can be partially or fully substituted by Hf in its composition range of 4 to 9 atom %.

Example 4

An example in which a portion of Zr and Hf in the Fe—(Zr, Hf)—B alloy system according to Example 2 and Example 3 is substituted by Nb will now be described.

Results of cases where a portion of Zr in the Fe—Zr—B alloy system is substituted by 1 to 5 atom % Nb are shown in Table 8.

TABLE 8

| Sample No. | Composition of Alloy (atom %) | Magnetic Permeability (1 KHz) | Saturation Magnetic Flux Density Bs (G) |
|---|---|---|---|
| 112 | $Fe_{90}Zr_6Nb_1B_3$ | 21000 | 16600 |
| 113 | $Fe_{89}Zr_5Nb_2B_4$ | 14000 | 16200 |
| 114 | $Fe_{88}Zr_6Nb_2B_4$ | 12500 | 15400 |
| 115 | $Fe_{87}Zr_7Nb_2B_4$ | 7600 | 14500 |
| 116 | $Fe_{86}Zr_8Nb_2B_4$ | 2300 | 14000 |
| 117 | $Fe_{89}Zr_6Nb_3B_2$ | 8200 | 15900 |
| 118 | $Fe_{88}Zr_6Nb_4B_2$ | 4100 | 14500 |
| 119 | $Fe_{87}Zr_6Nb_5B_2$ | 1800 | 14000 |
| 120 | $Fe_{86}Ni_1Zr_4Nb_3B_6$ | 17900 | 15400 |

Note) Sample Nos. 116, 118 and 119 are comparative examples.

As can be understood from the results shown in Table 8, the quantity of Zr+Nb enabling a high magnetic permeability to be easily obtained is 4 to 9 atom % which is the same as the case for Zr in the Fe—Zr—B alloy system and Nb has an effect of addition which is similar to that of Zr. Therefore, a portion of Zr and that of Hf of the Fe—(Zr, Hf)—B alloy system can be substituted by Nb.

Example 5

An example in which a portion of Nb in the Fe—(Zr, Hf)—Nb—B alloy system according to Example 4 is substituted by Ti, V, Ta, Mo or W will now be described.

As an example, the magnetic characteristics of a Fe—Zr—M'—B (where M' is an element selected from a group consisting of Ti, V, Ta, Mo and W) alloy system are shown in Table 9.

TABLE 9

| Sample No. | Composition of Alloy (atom %) | Magnetic Permeability μ (1 KHz) | Saturation Magnetic Flux Density Bs (G) |
|---|---|---|---|
| 121 | $Fe_{89}Zr_6Ti_2B_3$ | 12800 | 15800 |
| 122 | $Fe_{89}Zr_6V_2B_3$ | 11100 | 15800 |
| 123 | $Fe_{89}Zr_6Ta_2B_3$ | 15600 | 15200 |
| 124 | $Fe_{89}Zr6_7Mo_2B_3$ | 12800 | 15300 |
| 125 | $Fe_{89}Zr_6W_2B_3$ | 13100 | 15100 |
| 126 | Fe—Si—B amorphous alloy | 5000 | 14100 |
| 127 | Iron-Silicon Steel (Si: 6.5 wt %) | 2400 | 18000 |
| 128 | Fe—Si—Al | 20000 | 11000 |
| 129 | Fe—Ni Alloy (permalloy) | 15000 | 8000 |
| 130 | Co—Fe—Si—B amorphous alloy | 65000 | 8000 |

Each sample shown in Table 9 has excellent magnetic characteristics having an effective magnetic permeability superior to that of 5000 which is usually obtained from a Fe-base amorphous alloy (sample No. 126) or that of 2400 of Iron-silicon steel (sample No. 127) serving as comparative examples. Further, saturation magnetic flux densities superior to that of a Fe—Si—Al alloy (sample No. 128), that of a Fe—Ni alloy (sample No. 129) and that of a Co-base amorphous alloy (sample No. 130). Therefore, a fact can be understood that the alloy according to this embodiment has high magnetic permeability and the high saturation magnetic flux density superior to those of the alloys according to the comparative examples. Hence, Nb of Fe—(Zr, Hf)Nb—B alloy system can be substituted by Ti, V, Ta, Mo or W.

Example 6

The reason why the quantity of Co and that of Ni in the alloys according to a sixth aspect of the present invention are so determined will now be described.

Figure 9:
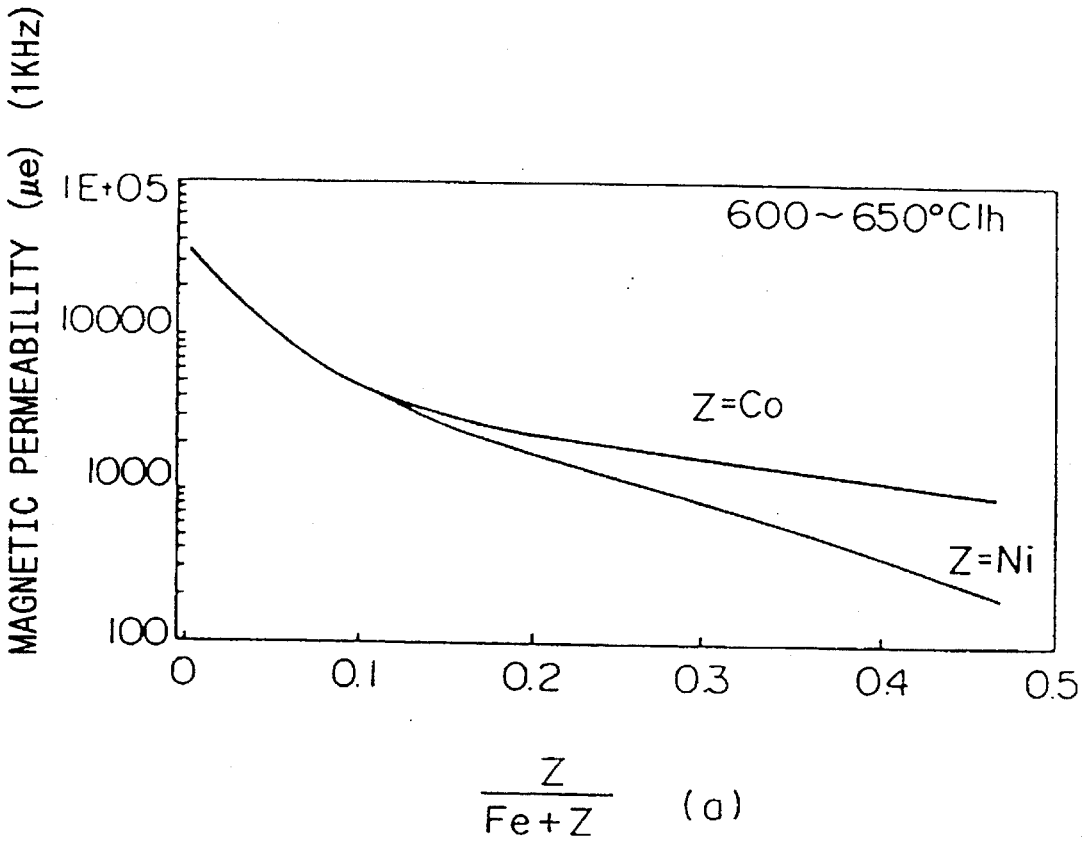
FIG. 9 is a single logarithmic graph which shows the relationship between the quantity of Co or that of Ni and the magnetic permeability of an example of an alloy system according to the present invention.

As an example, the relationship between the quantities of Co and Ni (a) of an alloy system (Z=Co, Ni), the composition of which is expressed by $(Fe_{1-a}Za)_{91}Zr_7B_2$ and the magnetic permeability is shown in FIG. 9.

As can be understood from results shown in FIG. 9, effective permeabilities of 5000 or more can be obtained, which are higher than that of the Fe amorphous alloy if the quantities of Co and Ni (a) are in a range of 0.1 or less. However, if the quantities are higher than 0.1, a practical problem arises because the effective magnetic permeability deteriorates rapidly. Therefore, the quantities of Co and Ni (a) in the alloy according to the foregoing claims is determined to be 0.1 or less. Further, it is preferable that a 0.05 or less to obtain an effective magnetic permeability of 10000 or more.

Example 7

The effect of the heat treatment acting on the magnetic characteristics and the structure claimed in according to a seventh aspect of the present invention will now be described in such a manner that a $Fe_{86}Zr_7B_6Cu_1$ alloy which is one of the basic composition of the foregoing alloy is explained as an example. The temperature at which the crystallization of the $Fe_{86}Zr_7B_6Cu_1$ alloy obtained from a differential thermal analysis at a heating rate of 10° C./minute was 503° C.

Figure 10:
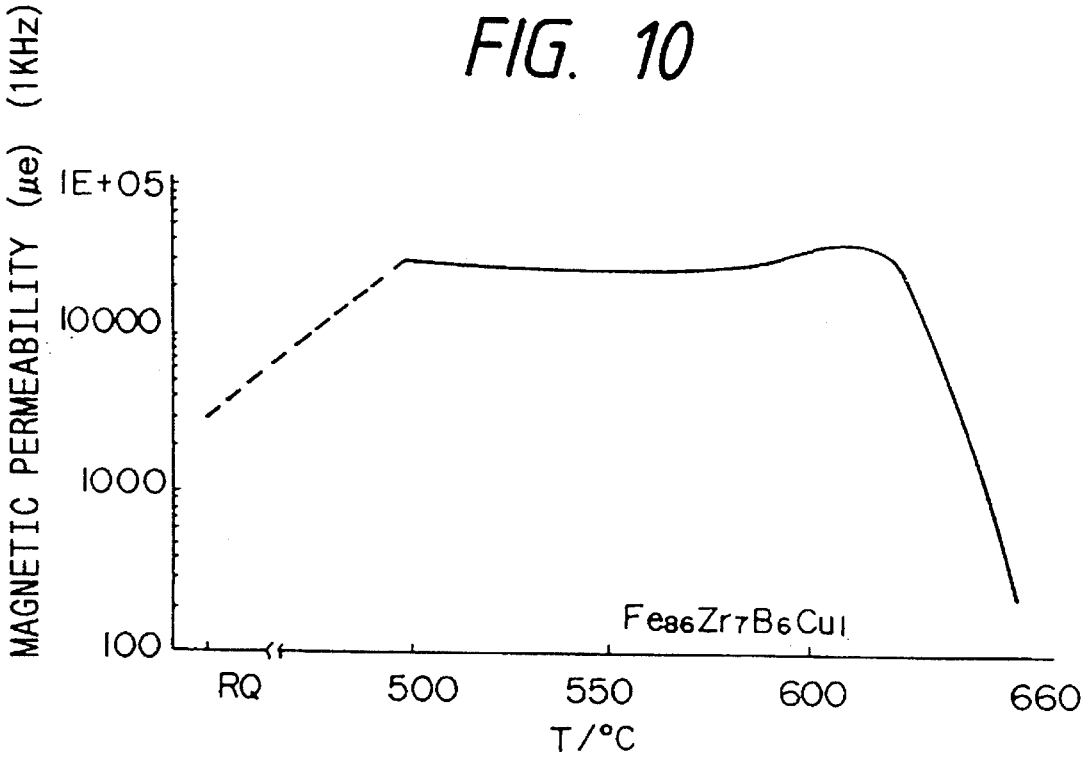
FIG. 10 is a graph which shows the relationship between the effective magnetic permeability and the annealing temperature of an example of an alloy according to the present invention.

FIG. 10 illustrates an effect of annealing (maintained at each temperature for one hour) upon the effective magnetic permeability of the $Fe_{86}Zr_7B_6Cu_1$ alloy.

As can be understood from the results shown in FIG. 10, the effective magnetic permeability of the alloy according to the present invention in a rapidly solidified state (RQ) is a low value equivalent to that of the Fe-base amorphous alloy. However, the effective magnetic permeability is increased to a value about 10 times the value in the rapidly solidified state. The dependency of the magnetic permeability upon the frequency was examined by using a sample having a thickness of about 20 μm and subjected to heat treatment set to 600° C., resulting in that excellent soft magnetic characteristics were attained even if the measuring frequency was high, such that a magnetic permeability of 32000 was obtained at 1 KHz, a magnetic permeability of 25600 was obtained at 10 KHz and a magnetic permeability of 8330 was obtained at 100 KHz.

The magnetic characteristics of the alloy according to the present invention can be adjusted by adequately selecting the heat treatment conditions, such as the heating rate. Further, the magnetic characteristics can be improved by performing annealing or the like in the magnetic field.

Then, the change in the structure of the $Fe_{86}Zr_7B_6Cu_1$ alloy subjected to the heat treatment was examined by an X-ray analysis method, and the structure formed after the heat treatment had been performed was observed by using a transmission electronic microscope. Results of the examination is shown in FIGS. 11 and 12.

Figure 11:
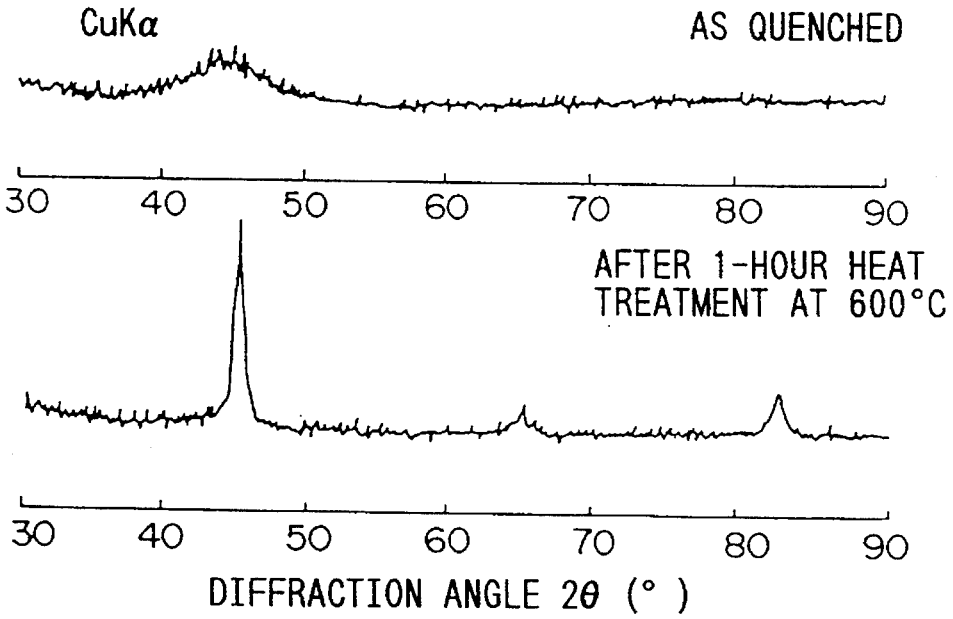
FIG. 11 is a graph which shows results of an X-ray diffractometry showing the structural change of an alloy according to the present invention taken place before and after the heat treatment.

As can be understood from FIG. 11, a halo diffraction pattern corresponding to the amorphous was observed in a rapidly solidified state, and a diffraction pattern corresponding to a body-centered cubic structure was observed after the heat treatment had been performed. Therefore, it has been understood that the structure of the alloys according to the present invention has been changed from amorphous to the body-centered cubic structure.

Figure 12:
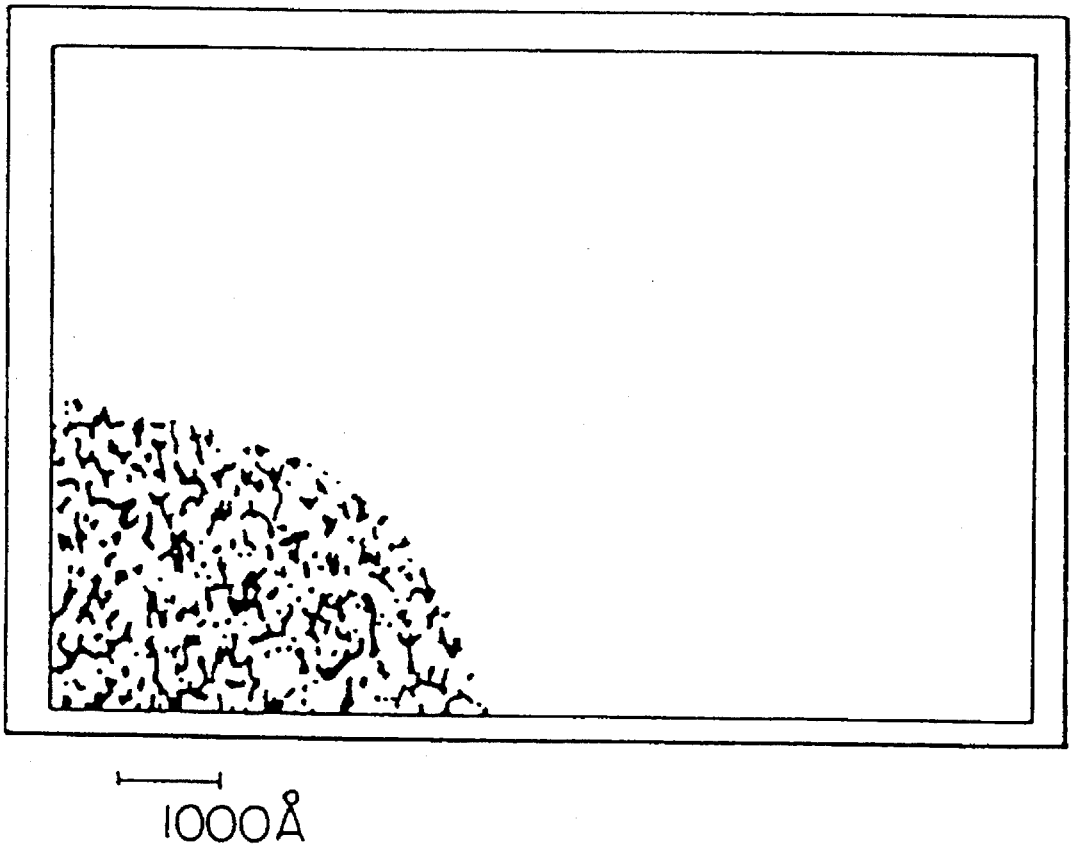
FIG. 12 is a schematic view of a microscope photograph showing the structure of an example of an alloy according to the present invention after the heat treatment has been performed.

FIG. 12 is a schematic view of a photograph of the transmission electronic microscope, from which the structure realized after the heat treatment had been performed was composed of fine grains, the grain size of which was about 10 nm.

The change of the hardness of the $Fe_{86}Zr_7B_6Cu_1$ alloy before and after the heat treatment was examined, resulting in that the Vickers hardness was, due to the heat treatment performed at 650° C., improved from 740 DPN in the rapidly solidified state to 1390 DPN, which is excellent hardness that cannot be obtained from a conventional material. Therefore, the foregoing alloy is suitable as the material for the magnetic head.

As described above, the alloys according to this embodiment has a structure mainly composed of very small grains by crystallizing the amorphous alloys having the foregoing composition by the heat treatment. Therefore, excellent characteristics can be attained such that the saturation magnetic flux density is very high, excellent soft magnetic characteristics, satisfactory hardness and excellent heat stability are attained.

Examples in which the quantities of Zr and B in the foregoing alloys according to the seventh aspect of the present invention will now be described. Table 10 and FIG. 13 show the magnetic characteristics realized after annealing has been performed.

TABLE 10

| Sample No. | Composition of Alloy (atom %) | Magnetic Permeability μe (1k) | Coercive Force Hc (Oe) | Saturation Magnetic Flux Density Bs (KG) |
|---|---|---|---|---|
| 131 | $Fe_{85}Zr_4B_{10}Cu_1$ | 9250 | 0.150 | 14.9 |
| 132 | $Fe_{83}Zr_4B_{12}Cu_1$ | 7800 | 0.170 | 14.2 |
| 133 | $Fe_{88}Zr_5B_6Cu_1$ | 15500 | 0.190 | 16.7 |
| 134 | $Fe_{86}Zr_5B_8Cu_1$ | 23200 | 0.032 | 15.2 |
| 135 | $Fe_{84}Zr_5B_{10}Cu_1$ | 21100 | 0.055 | 14.5 |
| 136 | $Fe_{82}Zr_5B_{12}Cu_1$ | 12000 | 0.136 | 13.9 |
| 137 | $Fe_{89}Zr_6B_4Cu_1$ | 30300 | 0.038 | 17.0 |
| 138 | $Fe_{88}Zr_6B_5Cu_1$ | 15200 | 0.052 | 16.3 |
| 139 | $Fe_{87}Zr_6B_6Cu_1$ | 18300 | 0.040 | 15.7 |
| 140 | $Fe_{86}Zr_6B_7Cu_1$ | 15400 | 0.042 | 15.2 |
| 141 | $Fe_{91}Zr_7B_1Cu_1$ | 20700 | 0.089 | 17.1 |
| 142 | $Fe_{90}Zr_7B_2Cu_1$ | 32200 | 0.030 | 16.8 |
| 143 | $Fe_{89}Zr_7B_3Cu_1$ | 32400 | 0.036 | 16.2 |
| 144 | $Fe_{88}Zr_7B_4Cu_1$ | 31300 | 0.102 | 15.8 |
| 145 | $Fe_{87}Zr_7B_5Cu_1$ | 31000 | 0.082 | 15.3 |
| 146 | $Fe_{86}Zr_7B_6Cu_1$ | 32000 | 0.044 | 15.0 |
| 147 | $Fe_{84}Zr_7B_8Cu_1$ | 25700 | 0.044 | 14.2 |
| 148 | $Fe_{82}Zr_7B_{10}Cu_1$ | 19200 | 0.038 | 13.3 |
| 149 | $Fe_{80}Zr_7B_{12}Cu_1$ | 23800 | 0.044 | 12.5 |
| 150 | $Fe_{78}Zr_7B_{14}Cu_1$ | 13300 | 0.068 | 11.8 |
| 151 | $Fe_{76}Zr_7B_{16}Cu_1$ | 10000 | 0.20 | 11.0 |
| 152 | $Fe_{88}Zr_8B_3Cu_1$ | 29800 | 0.084 | 15.4 |
| 153 | $Fe_{85}Zr_8B_6Cu_1$ | 28000 | 0.050 | 14.2 |
| 154 | $Fe_{84}Zr_8B_7Cu_1$ | 20400 | 0.044 | 13.8 |
| 155 | $Fe_{88}Zr_9B_2Cu_1$ | 11700 | 0.112 | 15.1 |
| 156 | $Fe_{86}Zr_9B_4Cu_1$ | 12900 | 0.160 | 14.3 |
| 157 | $Fe_{84}Zr_9B_6Cu_1$ | 11800 | 0.108 | 13.1 |
| 158 | $Fe_{85}Zr_{10}B_4Cu_1$ | 6240 | 0.210 | 12.8 |
| 159 | $Fe_{83}Zr_{10}B_6Cu_1$ | 5820 | 0.220 | 12.0 |

Figure 13:
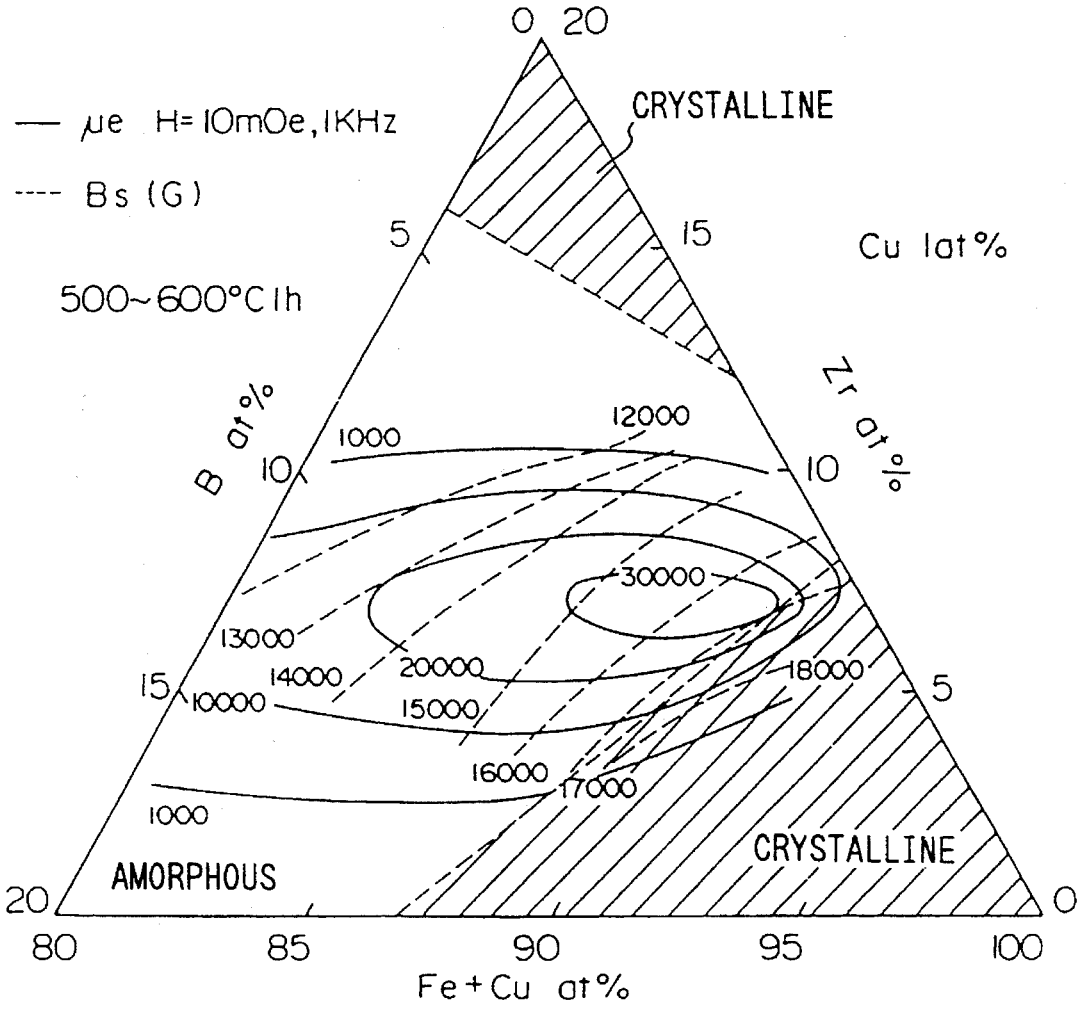
FIG. 13 is a triangular composition view which shows an example of an alloy system according to the present invention in a case where the quantities Fe+Cu, the quantity of B and that of Zr are changed.

As can be understood from Table 10, and FIG. 13, high magnetic permeability can easily be obtained if the quantity of Zr ranges from 4 to 10 atom %. If the quantity of Zr is 4 atom % or less, an effective magnetic permeability of 5000 to 10000 or more cannot be obtained. If the quantity is larger than 10 atom %, the magnetic permeability is rapidly lowered and the saturation magnetic flux density is also lowered. Therefore, the range of the quantity of Zr in the alloys according to the present invention is made to be 4 to 10 atom %.

As for the quantity of B, a fact was found that high magnetic permeability of 5000 or more of an effective magnetic permeability, preferably 10000 or more, can easily be obtained in a range from 0.5 atom % to 18 atom %. Therefore, the quantity of B is determined to be 0.5 to 18 atom %. If the quantity of Fe is larger than 93 atom %, high magnetic permeability cannot be obtained although the quantities of Zr and B are in the foregoing ranges. Therefore, the basic quantity of Fe+Co to be contained in the alloys according to the seventh aspect is determined to be 93 atom %.

Example 8

A Fe—Hf—B—Cu alloy system obtained by substituting Zr of the Fe—Zr—B—Cu alloy system according to Example 7 by Hf will now be described.

Figure 14:
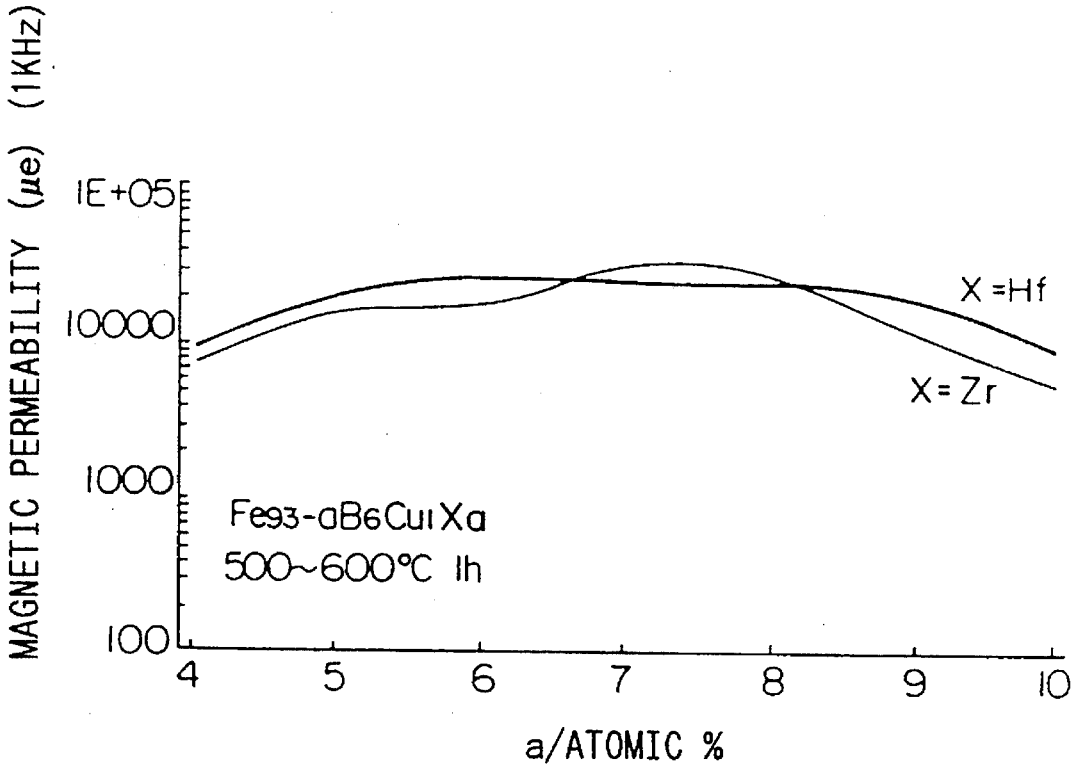
FIG. 14 is a single logarithmic graph which shows the relationship between the quantity of Hf and the magnetic permeability of an alloy system according to the present invention.

Results of measurements of the magnetic characteristics of alloys each having a constant composition that the quantity of B was 6 atom % and that of Cu was 1 atom % are shown in Table 11. FIG. 14 shows the permeabilities realized by changing the quantity of Hf in a range from 4 to 10 atom %. FIG. 14 also shows an effective magnetic permeability of the Fe—Zr—$B_6$—$Cu_1$ alloy system for comparison.

TABLE 11

| Sample No. | Composition of Alloy | Magnetic Permeability | Coercive Force | Saturation Magnetic Flux Density |
|---|---|---|---|---|
| 160 | $Fe_{89}Hf_4B_6Cu_1$ | 9350 | 0.150 | 16.1 |
| 161 | $Fe_{88}Hf_5B_6Cu_1$ | 20400 | 0.048 | 15.7 |
| 162 | $Fe_{87}Hf_6B_6Cu_1$ | 26500 | 0.028 | 15.2 |
| 163 | $Fe_{86}Hf_7B_6Cu_1$ | 25200 | 0.028 | 14.7 |
| 164 | $Fe_{85}Hf_8B_8Cu_1$ | 25200 | 0.038 | 14.1 |
| 165 | $Fe_{84}Hf_9B_6Cu_1$ | 19600 | 0.068 | 13.5 |
| 166 | $Fe_{83}Hf_{10}B_6Cu_1$ | 9860 | 0.104 | 12.8 |
| 167 | $Fe_{86}Zr_4Hf_3B_6Cu_1$ | 39600 | 0.032 | 14.8 |

As can be understood from Table 11 and FIG. 14, the effective magnetic permeability of the Fe—Hf—B—Cu alloy system is equivalent to that of the Fe—Zr—B—Cu alloy system if the quantity of Hf ranges from 4 to 10 atom %. The magnetic characteristics of a $Fe_{86}Zr_4Hf_3B_6Cu_1$ alloy shown in Table 11 are equivalent to those of the Fe—Zr—B—Cu alloy system according to Example 7. Therefore, it has been found that Zr in the Fe—Zr—B—Cu alloy system according to Example 7 can be partially or fully substituted by Hf in its composition range of 4 to 10 atom %.

Example 9

An example in which a portion of Zr and Hf in the Fe—(Zr, Hf)—B—Cu alloy system according to Example 7 and Example 8 is substituted by Nb will now be described.

Figure 15:
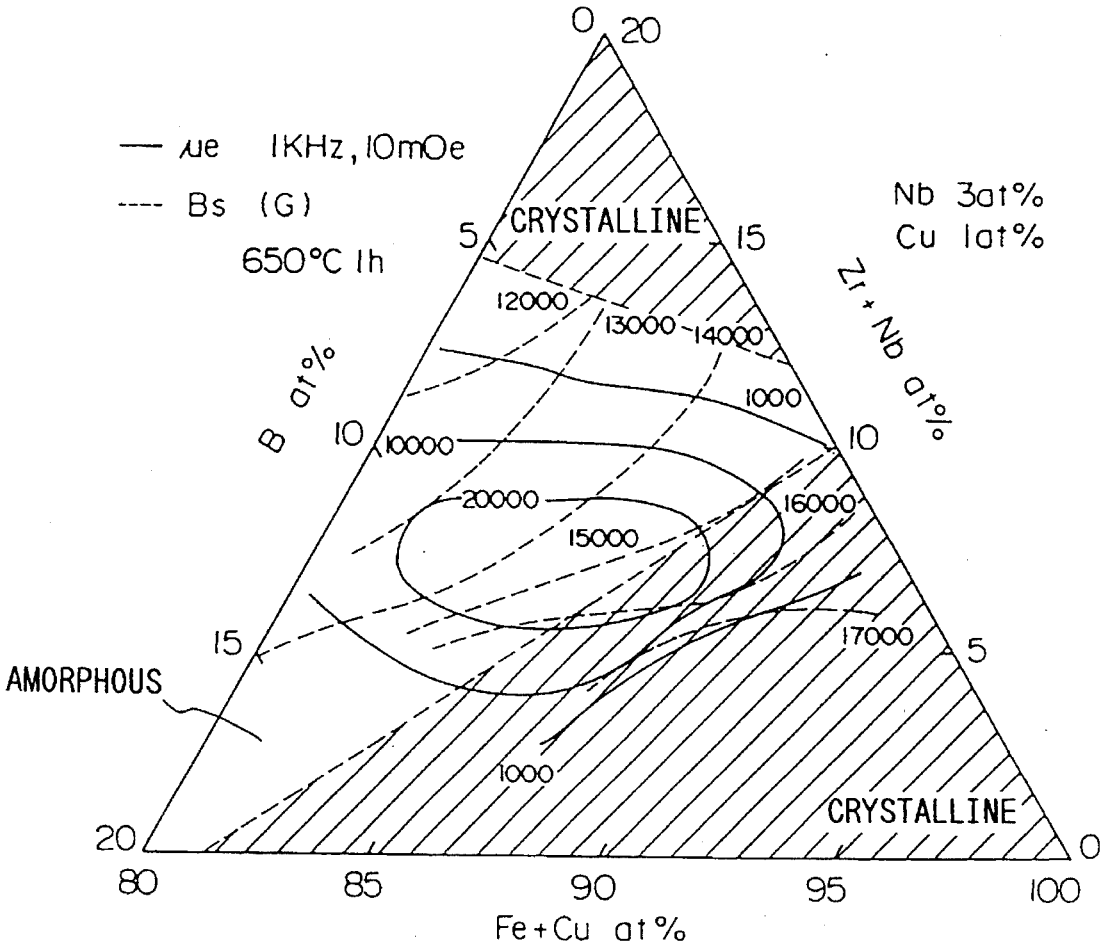
FIG. 15 is a triangle composition view which shows the magnetic characteristics of an alloy system according to the present invention in a case where the quantity of B, the quantity of Zr+Nb and the quantity of Fe+Cu are changed.

Results of cases where a portion of Zr in the Fe—Zr—B—Cu alloy system is substituted by 1 to 5 atom % Nb are shown in Table 12. FIG. 15 shows the magnetic characteristics of the Fe—Zr—Nb—B—Cu alloy system containing Nb by 3 atom %.

TABLE 12

| Sample | Composition of Alloy (atom %) | Magnetic permeability μe (1k) | Coercive Force Hc (Oe) | Saturation Magnetic Flux Density Bs (KG) |
|---|---|---|---|---|
| 168 | $Fe_{88}Zr_4Nb_1B_6Cu_1$ | 11300 | 0.108 | 16.9 |
| 169 | $Fe_{87}Zr_4Nb_2B_6Cu_1$ | 37400 | 0.042 | 15.9 |
| 170 | $Fe_{86}Zr_4Nb_3B_6Cu_1$ | 35700 | 0.046 | 15.3 |
| 171 | $Fe_{85}Zr_4Nb_4B_6Cu_1$ | 30700 | 0.050 | 14.3 |
| 172 | $Fe_{84}Zr_4Nb_5B_6Cu_1$ | 14600 | 0.092 | 13.7 |
| 173 | $Fe_{86}Zr_2Nb_3B_8Cu_1$ | 14900 | 0.108 | 16.6 |
| 174 | $Fe_{84}Zr_2Nb_3B_{10}Cu_1$ | 15900 | 0.085 | 16.2 |
| 175 | $Fe_{87}Zr_3Nb_3B_6Cu_1$ | 33800 | 0.048 | 16.0 |
| 176 | $Fe_{85}Zr_3Nb_3B_8Cu_1$ | 24100 | 0.095 | 15.5 |
| 177 | $Fe_{88}Zr_4Nb_3B_4Cu_1$ | 16900 | 0.076 | 15.6 |
| 178 | $Fe_{84}Zr_4Nb_3B_8Cu_1$ | 38700 | 0.038 | 14.6 |
| 179 | $Fe_{86}Zr_5Nb_3B_5Cu_1$ | 24200 | 0.048 | 14.8 |
| 180 | $Fe_{84}Zr_5Nb_3B_7Cu_1$ | 21700 | 0.038 | 14.0 |
| 181 | $Fe_{84}Zr_6Nb_3B_6Cu_1$ | 17300 | 0.110 | 13.9 |
| 182 | $Fe_{82}Zr_6Nb_3B_8Cu_1$ | 20400 | 0.045 | 13.2 |
| 183 | $Fe_{79}Zr_7Nb_3B_{10}Cu_1$ | 10800 | 0.125 | 12.4 |

As can be understood from the results shown in Table 12 and FIG. 15, the quantity of Zr+Nb enabling a high magnetic permeability to be easily obtained is 4 to 10 atom % which is the same as the case for Zr in the Fe—Zr—B—Cu alloy system. In the foregoing range, a high effective magnetic permeability similarly to that of the Fe—Zr—B—Cu alloy system was obtained. Therefore, a portion of Zr and that of Hf of the Fe—(Zr, Hf)—B—Cu alloy system can be substituted by Nb.

Example 10

An example in which Nb in the Fe—(Zr, Hf)—Nb—B—Cu alloy system according to Example 9 is substituted by Ti, V, Ta, Mo or W will now be described. As an example, the magnetic characteristics of a Fe—Zr—M'—B—$Cu_1$ (where M'=Ti, V, Ta, Mo or W) alloy system are shown in Table 13.

TABLE 13

| Sample | Composition of Alloy (atom %) | Magnetic permeability μe (1k) | Coercive Force Hc (Oe) | Saturation Magnetic Flux Density Bs (KG) |
|---|---|---|---|---|
| 184 | $Fe_{80}Zr_1Ti_6B_{12}Cu_1$ | 13800 | 0.105 | 12.8 |
| 185 | $Fe_{86}Zr_4Ti_3B_6Cu_1$ | 12700 | 0.110 | 14.7 |
| 186 | $Fe_{84}Zr_4V_5B_6Cu_1$ | 6640 | 0.201 | 13.5 |
| 187 | $Fe_{86}Zr_4Ta_3B_6Cu_1$ | 20900 | 0.096 | 15.1 |
| 188 | $Fe_{84}Zr_4Ta_5B_6Cu_1$ | 8310 | 0.172 | 14.0 |
| 189 | $Fe_{86}Zr_4Mo_3B_8Cu_1$ | 9410 | 0.160 | 15.3 |
| 190 | $Fe_{84}Zr_4Mo_5B_6Cu_1$ | 9870 | 0.160 | 13.7 |
| 191 | $Fe_{86}Zr_4W_3B_6Cu_1$ | 1170 | 0.098 | 14.8 |
| 192 | $Fe_{84}Zr_4W_5B_6Cu_1$ | 6910 | 0.211 | 13.2 |

Each sample shown in Table 13 has excellent magnetic characteristics having an effective magnetic permeability superior to that of 5000 which is usually obtained from a Fe-base amorphous alloy. Hence, Nb of Fe—(Zr, Hf)Nb—B—Cu alloy system can be substituted by Ti, V, Ta, Mo or W.

Example 11

The reason why the quantity of Cu in the alloys according to the seventh aspect of the present invention are so determined will now be described.

Figure 16:
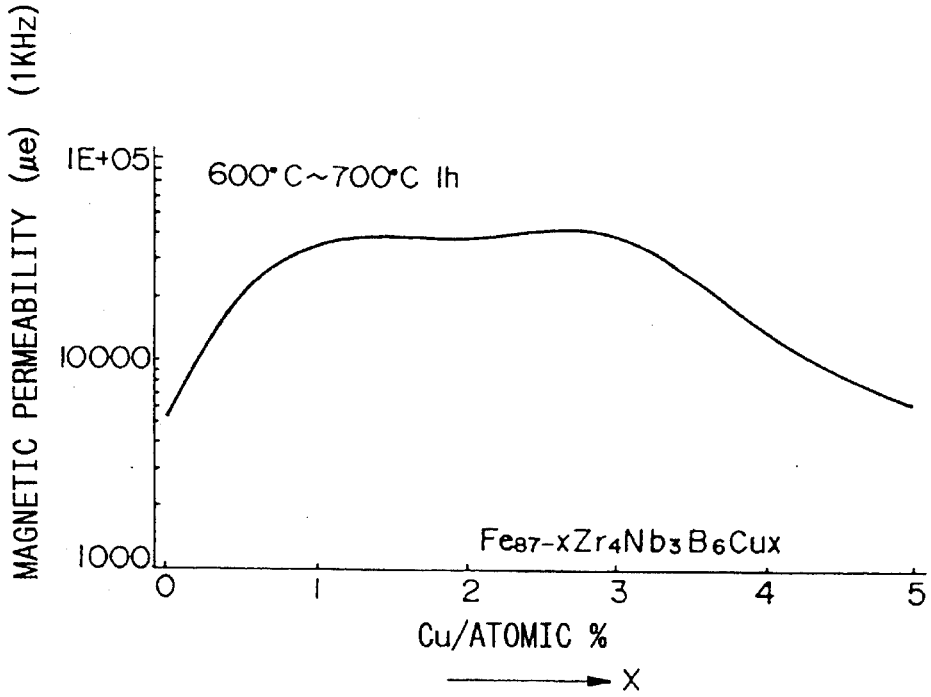
FIG. 16 is a single logarithmic graph which shows the relationship between the quantity of Cu and the effective magnetic permeability of an example of an alloy system according to the present invention.

As an example, the relationship between the quantities of Cu (z) of a $Fe_{87-x}Zr_4Nb_3B_6Cu_x$ alloy system and the magnetic permeability is shown in FIG. 16.

As can be understood from FIG. 16, effective permeabilities of 10000 or more can easily be obtained if z is in a range from 0.2 to 4.5 atom %. If z is 0.2 atom % or less, the effect of the addition of Cu cannot easily be obtained. If z is larger than 4.5 atom %, the magnetic permeability deteriorates, resulting in a practical problem to occur. If z is 0.2 atom % or less, a practical effective magnetic permeability of 5000 or more can be obtained but decrease in Cu raises the concentration of Fe, causing the saturation magnetic flux density to be raised. Therefore, Cu may be added by a quantity larger than zero and as well as in a range of 0.2 atom % or less. As a result, the range of the content of Cu in the alloys according to the present invention is determined to be 4.5 atom %.

Example 12

An example in which Cu of each alloys according to Examples 7 to 11 is substituted by Ag, Pd or Pt will now be described.

As an example, the magnetic characteristics of a $Fe_{86}Zr_4Nb_3B_6T_1$ (T=Ag, Au, Pd or Pt) alloy system are shown in Table 14.

TABLE 14

| Sample No. | Composition of Alloy (atom %) | Magnetic Permeability μe (1k) | Coercive Force Hc (Oe) | Saturation Magnetic Flux Density Bs (KG) |
|---|---|---|---|---|
| 193 | $Fe_{86}Zr_4Nb_3B_6Pd_1$ | 18800 | 0.064 | 15.4 |
| 194 | $Fe_{86}Zr_4Nb_3B_6Pt_1$ | 19900 | 0.096 | 14.8 |
| 195 | $Fe_{86}Zr_4Nb_3B_6Ag_1$ | 17800 | 0.090 | 15.3 |
| 196 | $Fe_{86}Zr_4Nb_3B_6Au_1$ | 21500 | 0.076 | 15.2 |

As can be understood from Table 14, each alloy has an excellent effective magnetic permeability of 10000 or higher which is substantially the same as that of Cu. Therefore, it can be understood that Cu in the alloys according to claims 11 and 15 can be substituted by Ag, Au, Pd or Pt.

Example 13

The reason why the content of Co in the alloy according to an eighth aspect of the present invention is so determined will now be described.

Figure 17:
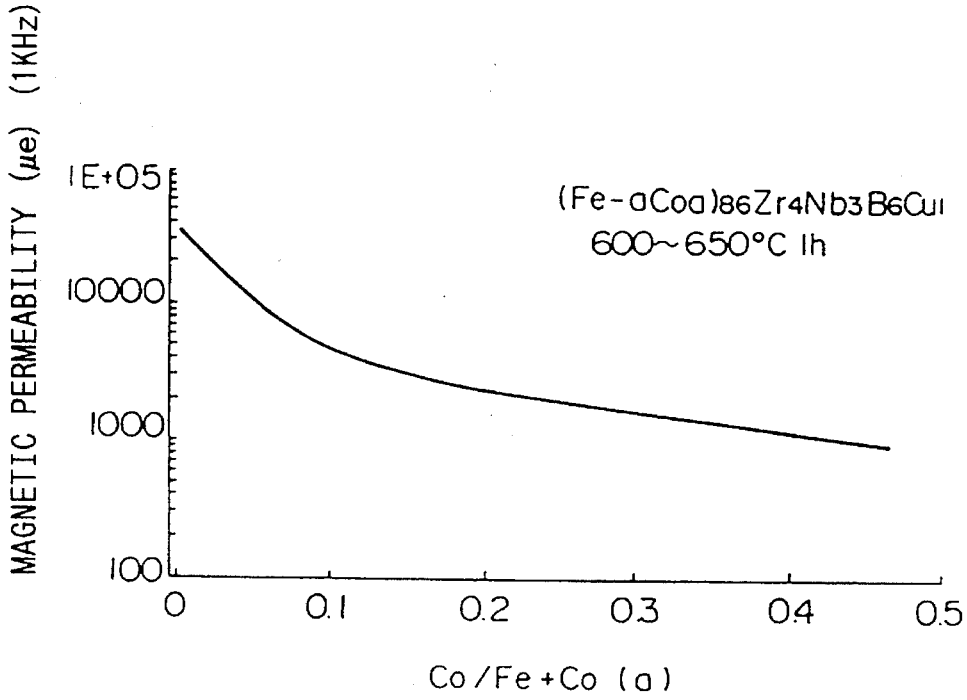
FIG. 17 is a single logarithmic graph which shows the relationship between the quantity of Co and the magnetic permeability of an example of an alloy system according to the present invention.

As an example, the relationship between the quantity (a) of Co in a $(Fe_{1-a}Co_a)_{86}Zr_4Nb_3B_6Cu_1$ alloy system and the magnetic permeability is shown in FIG. 17.

As can be seen from FIG. 17, an effective magnetic permeability of 5000 or more, which is higher than that of a Fe amorphous alloy, is attained if a ranges lower than 0.1. Therefore, the Co content (a) in the alloy according to claims 15 and 17 is determined to be 0.1 or less. In order to attain a high effective magnetic permeability of 10000 or higher, it is preferable to make the Co content to be 0.05 or less.

Example 14

An example in which a thin film of the alloy according to a ninth aspect of the present invention was manufactured by a sputtering method will now be described.

The thin film was manufactured in an Ar atmosphere by a high-frequency sputtering method. The thickness of the obtained film was 1 to 2 μm, the film being then subjected to a heat treatment set to 500° to 700° C. to measure the magnetic characteristics. Results of the magnetic characteristics are shown in Table 15.

TABLE 15

| Sample No. | Composition of Alloy (atom %) | Magnetic Permeability μe (1k) | Coercive Force Hc (Oe) | Saturation Magnetic Flux Density Bs (KG) |
|---|---|---|---|---|
| 197 | $Fe_{86}Zr_7B_6Cu_1$ | 1900 | 0.31 | 15.0 |
| 198 | $Fe_{86}Zr_4Nb_3B_6Cu_1$ | 2050 | 0.30 | 15.2 |
| 199 | $Fe_{86}Hf_7B_6Cu_1$ | 2020 | 0.28 | 14.7 |
| 200 | Fe—Al—Si | 3000 | 0.30 | 10.0 |

As can be understood from Table 15, any alloy films according to the present invention has excellent soft magnetic characteristics. Further, the alloys according to the present invention can be manufactured by the sputtering method. It should be noted that Table 15 also shows the characteristics of a Fe—Al—Si alloy film (sample No. 200) as a comparative example. In contrast with the alloy films according to the comparative example, the alloy films according to the present invention exhibiting considerably superior saturation magnetic flux density although the magnetic permeability is somewhat inferior.

Example 15

The effect of the heat treatment acting on the magnetic characteristics and the structure of the alloys having the composition according to a tenth aspect of the present invention will now be described in such a manner that a $Fe_{80}Nb_7B_{12}Cu_1$ alloy which is one of the basic composition of the alloys having the compositions according to the tenth aspect is explained as an example. The temperature at which the crystallization of the $Fe_{80}Nb_7B_{12}Cu_1$ alloy obtained from a differential thermal analysis at a heating rate of 10° C./minute was 470° C. In this case, the addition of Nb is needed, and a portion of it may be substituted by Ti or Ta to obtain similar magnetic characteristics.

Figure 18:
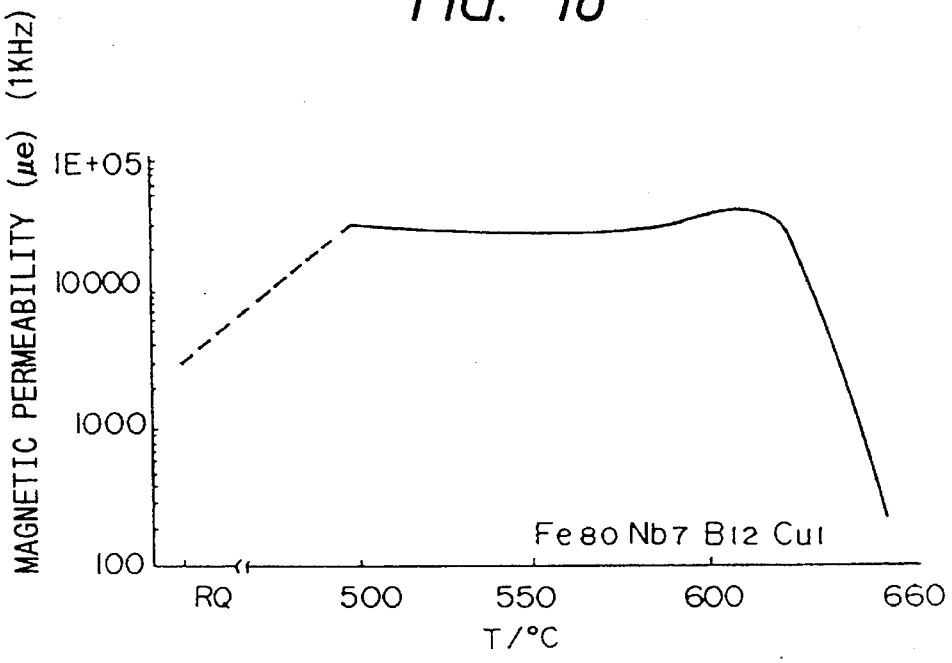
FIG. 18 is a graph which shows the relationship between the effective permeability and the annealing temperature of an example of an alloy according to the present invention.

FIG. 18 illustrates an effect of annealing (maintained at each temperature for one hour) upon the effective magnetic permeability of the $Fe_{80}Nb_7B_{12}Cu_1$ alloy.

As can be understood from FIG. 18, the effective magnetic permeability of the alloy according to the present invention in a rapidly solidified state (RQ) is a low value equivalent to that of the Fe-base amorphous alloy. However, the effective magnetic permeability is increased to a value about 10 times the value in the rapidly solidified state. The dependency of the magnetic permeability upon the frequency was examined by using a sample having a thickness of about 20 μm and subjected to heat treatment set to 600° C., resulting in that excellent soft magnetic characteristics were attained even if the measuring frequency was high, such that a magnetic permeability of 28800 was obtained at 1 KHz, a magnetic permeability of 25400 was obtained at 10 KHz and a magnetic permeability of 7600 was obtained at 100 KHz.

Figure 19:
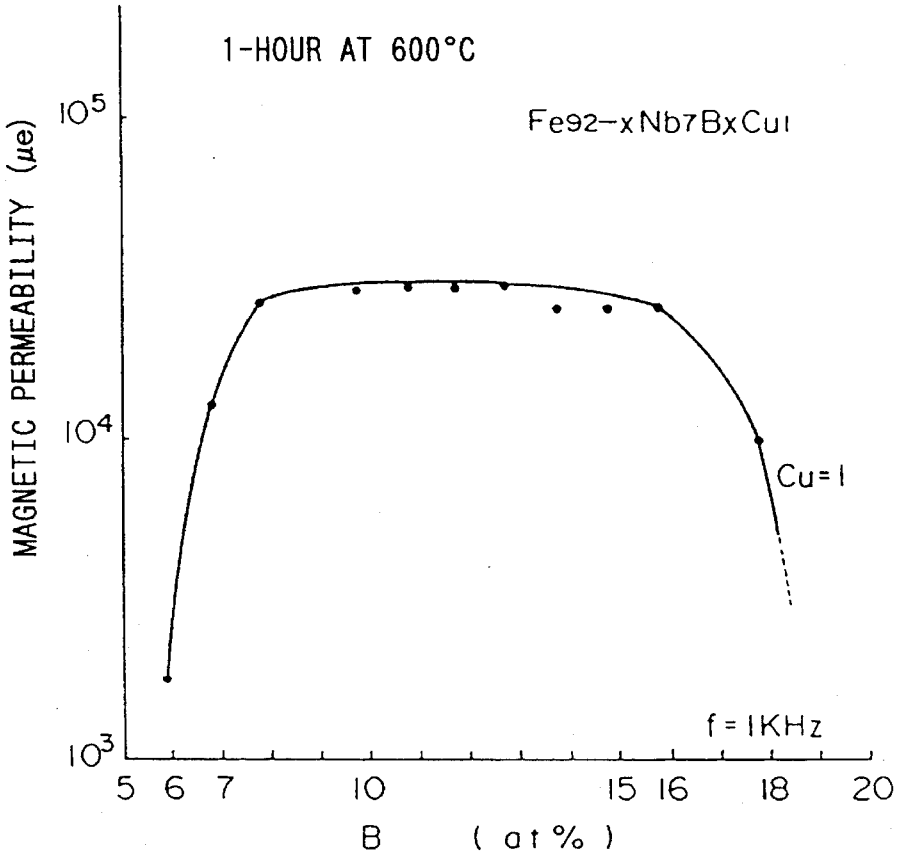
FIG. 19 is a single logarithmic graph which shows the relationship between the quantity of B and the effective magnetic permeability of an example of an alloy system according to the present invention.

FIG. 19 shows the results of influences of the content of B upon the effective magnetic permeability of the alloys, the composition of which is expressed by $Fe_{92-x}Nb_7B_xCu_1$. FIG. 19 shows the results of the measurements of the magnetic permeability performed by increasing/decreasing the content of B in a range from 6 to 18%.

A fact shown in FIG. 19 was found that excellent magnetic permeability can be obtained if the content of B ranges from 6.5 to 18 atom %. Therefore, the content of B in the alloys according to the tenth aspect is determined to be 6.5 to 18%.

Example 16

Figure 20:
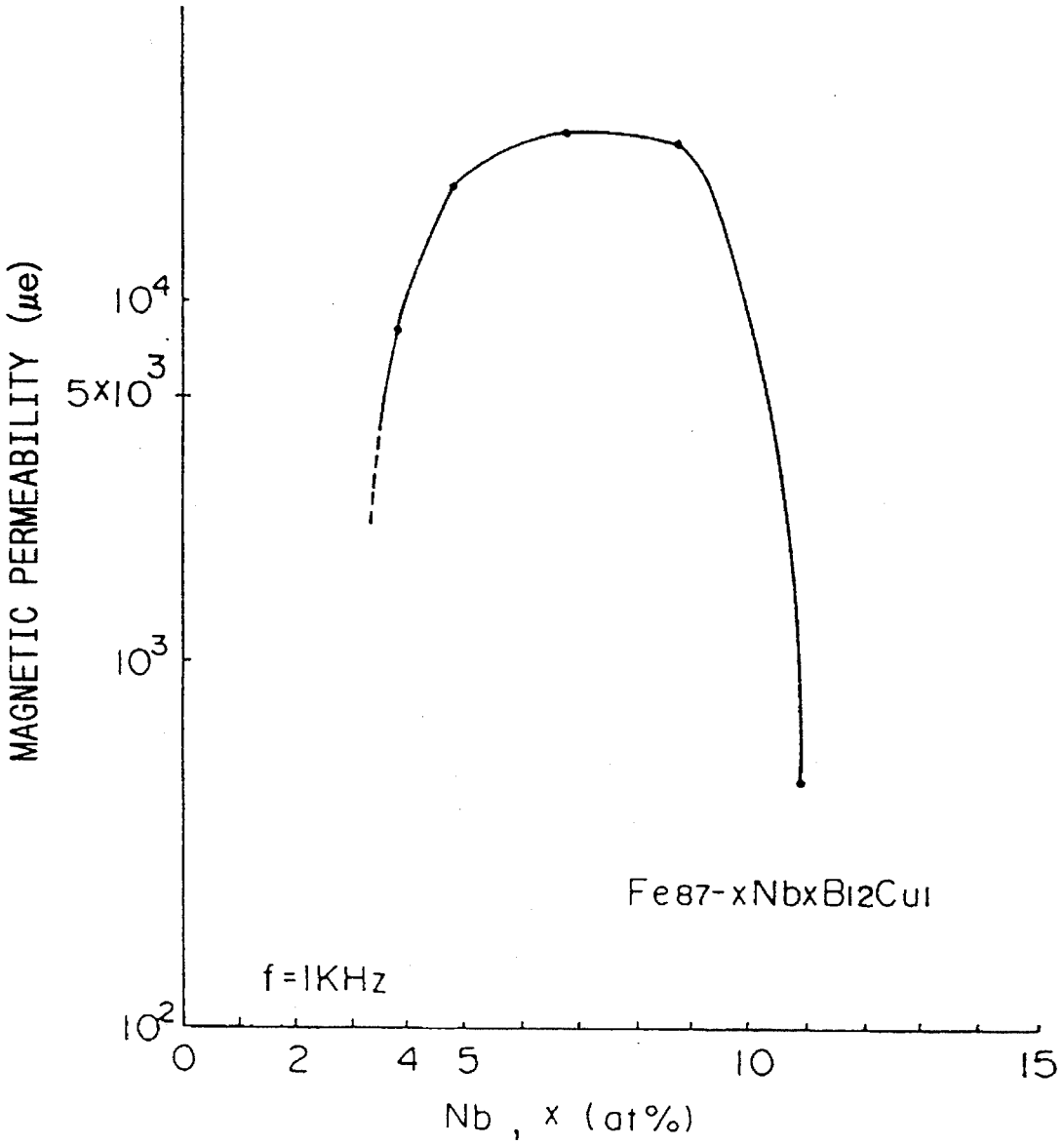
FIG. 20 is a single logarithmic graph which shows the relationship between the quantity of Nb and the effective magnetic permeability of an example of an alloy system according to the present invention.

FIG. 20 shows results of influences of the content of Nb upon the effective magnetic permeability of the alloys, the composition of which is expressed by $Fe_{87-x}Nb_xB_{12}Cu_1$. The results shown in FIG. 20 were obtained by increasing/decreasing the content of Nb in a range from 3 to 11 atom %.

As can be seen the results shown in FIG. 20, it was found that excellent magnetic permeability can be obtained if Nb is contained by a quantity ranging from 4 to 10 atom %. Therefore, the content of Nb according to the tenth aspect is determined to be 4 to 10%.

Then, the change in the structure of the $Fe_{87-x}Nb_xB_{12}Cu_1$ alloy subjected to the heat treatment was examined by an X-ray analysis method, and the structure formed after the heat treatment had been performed was observed by using a transmission electronic microscope. Results of the examination is shown in FIGS. 21 and 22.

Figure 21:
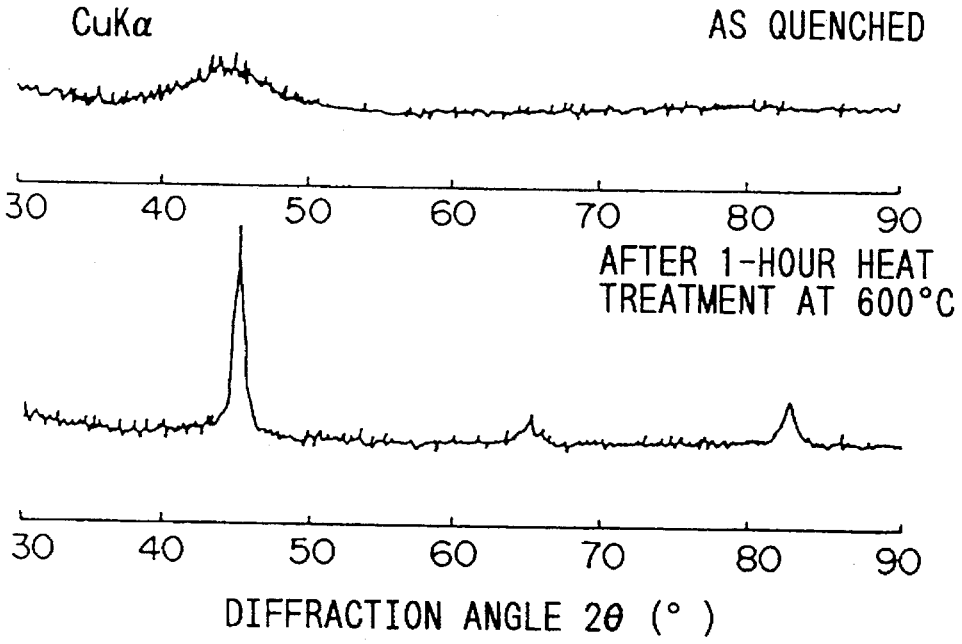
FIG. 21 is a graph which shows results of an X-ray diffractometry showing the structural change of an alloy according to the present invention taken place before and after the heat treatment.

As can be understood from FIG. 21, a halo diffraction pattern corresponding to the amorphous was observed in a rapidly solidified state, and a diffraction pattern corresponding to a crystalline structure was observed after the heat treatment had been performed. Therefore, it has been understood that the structure of the alloys according to the present invention has been changed from amorphous to the crystalline structure.

Figure 22:
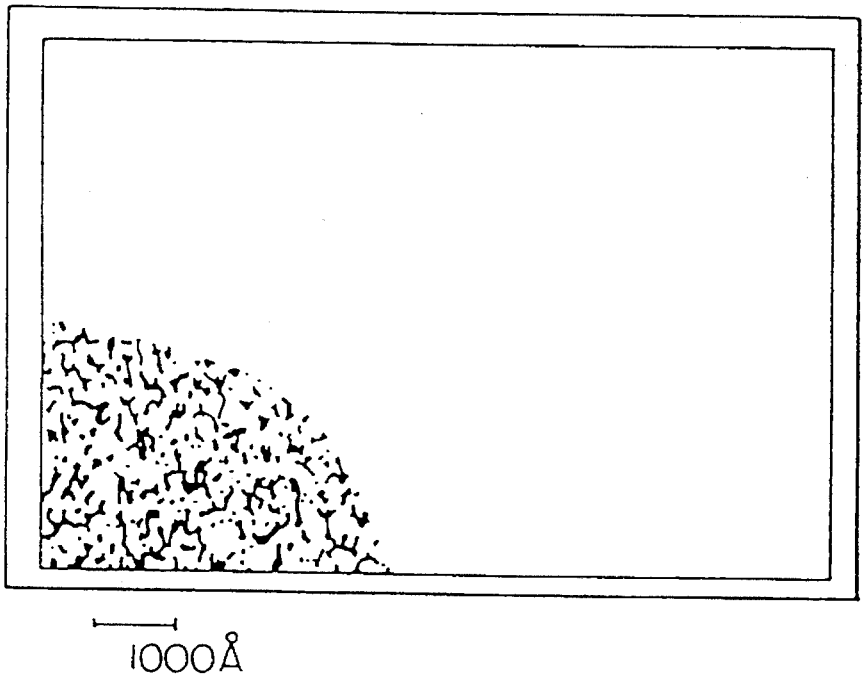
FIG. 22 is a schematic view of a microscope photograph showing the structure of an example of an alloy according to the present invention after the heat treatment has been performed.

Further, another fact can be understood from FIG. 22 that the structure realized after the heat treatment had been performed was composed of fine crystal, the grain size of which was about 10 nm.

The change of the hardness of the $Fe_{87-x}Nb_xB_{12}Cu_1$ alloy system before and after the heat treatment was examined, resulting in that the Vickers hardness was, due to the heat treatment performed at 600° C., improved from 650 DPN in the rapidly solidified state to 950 DPN. Therefore, the foregoing alloy is suitable as the material for the magnetic head.

As described above, the alloys according to the tenth aspect has a structure mainly composed of very small crystalline grains by crystallizing the amorphous alloy having the foregoing composition by the heat treatment. Therefore, excellent characteristics can be attained such that the saturation magnetic flux density is very high, excellent soft magnetic characteristics, satisfactory hardness and excellent heat stability are attained. Further, the elements mainly used in the alloys according to the present invention has a restricted tendency of generating an oxide and, accordingly, the alloys can easily be manufactured because it cannot easily be oxidized. The temperature, at which the heat treatment is performed, must be determined depending upon the composition, the temperature being ranged from 400° to 750° C.

An example in which the quantity Fe+Cu, the quantity of B and that of Nb respectively are increased/decreased in the basic composition of the soft magnetic alloys according to the tenth aspect of the present invention to measure the change in the magnetic permeability. Results of the measurements are shown in FIG. 23.

Figure 23:
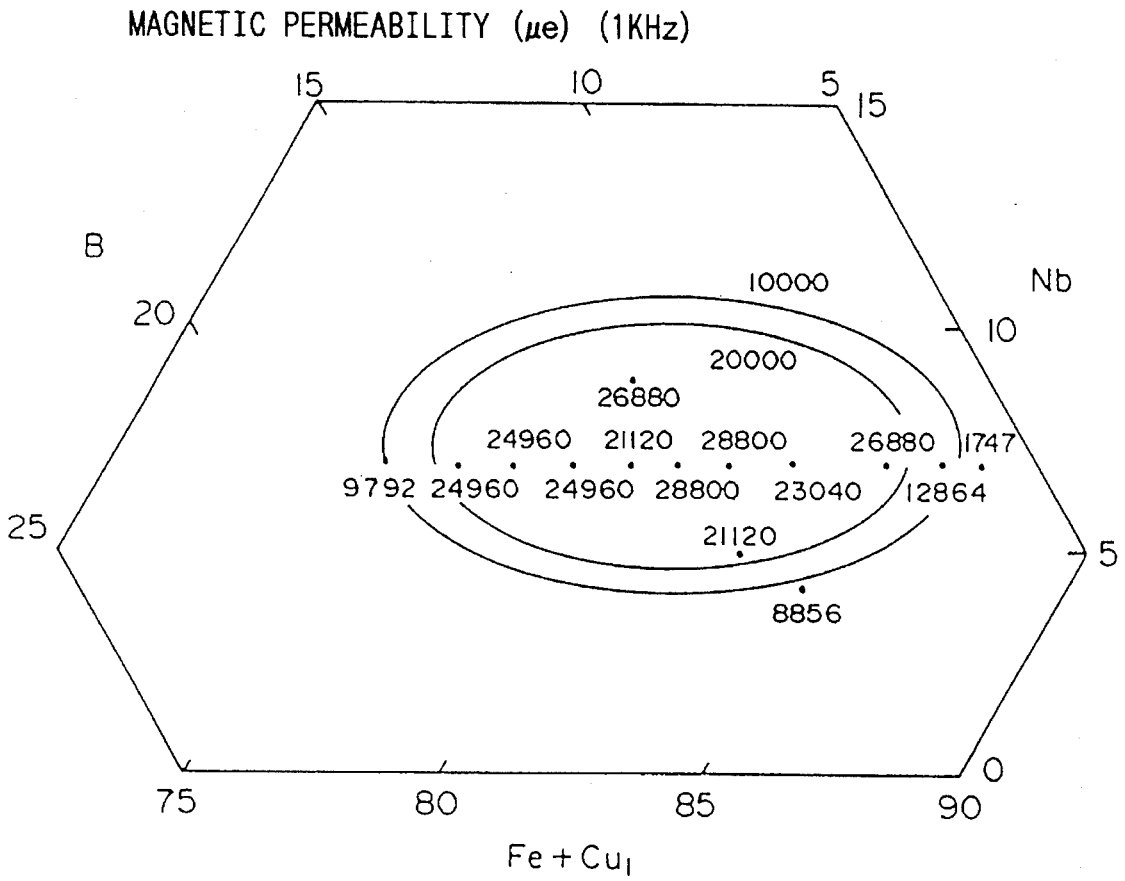
FIG. 23 is a triangle composition view which shows the magnetic permeability of an example of an alloy system according to the present invention in a case where the quantity of Fe+Cu, the quantity of B and that of Nb are changed.

As can be seen from FIG. 23, a range with which an excellent magnetic permeability of about 10000 is attained when the quantity of Nb ranges from 4 to 10 atom %. As for the quantity of B, the excellent magnetic permeability is attained when it ranges from 6.5 to 18 atom %.

An example in which the quantity Fe+Cu, the quantity of B and that of Nb respectively are increased/decreased in the basic composition of the soft magnetic alloys according to the tenth aspect of the present invention to measure the change in the saturation magnetic flux density. Results of the measurements are shown in FIG. 24.

Figure 24:
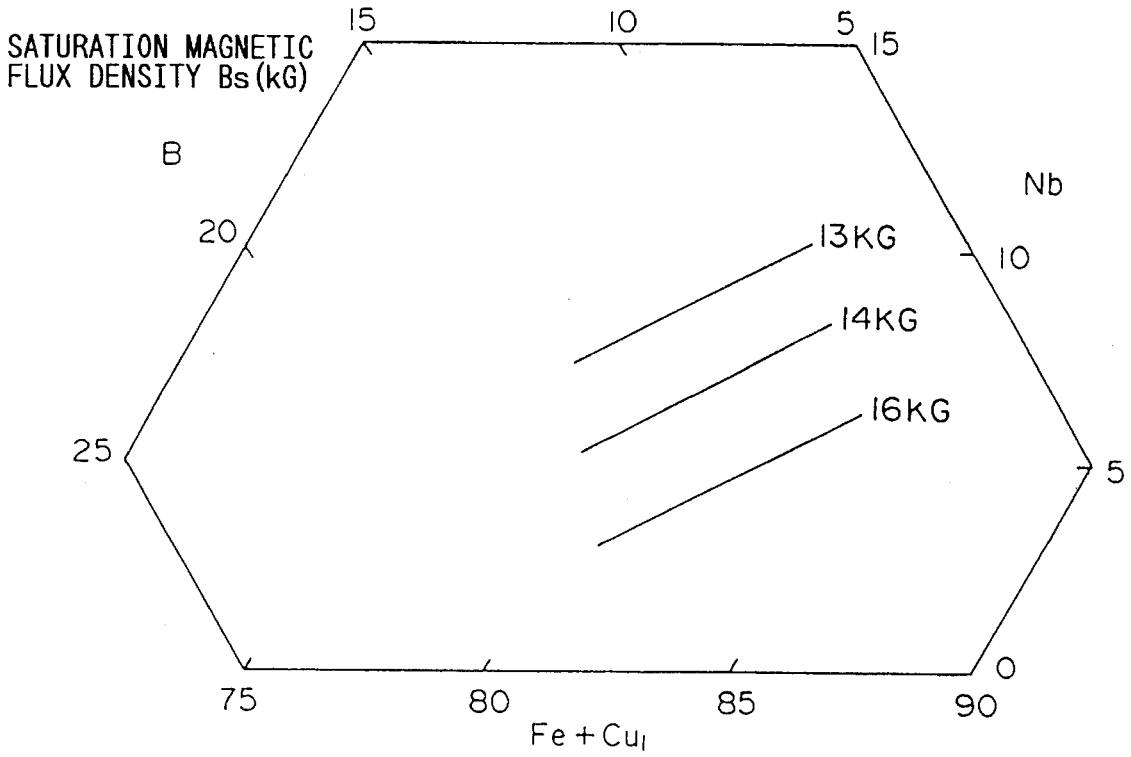
FIG. 24 is a triangle composition view which shows the saturation magnetic flux density of an alloy system according to the present invention in a case where the quantity of Fe+Cu, the quantity of B and that of Nb are changed.

As can be seen from FIG. 24, excellent values of 13 kG to 16 kG can be obtained in the range of the composition of the alloys according to the present invention.

The reason why the quantity of Cu in the alloys having the compositions according to the tenth aspect is so determined will now be described.

Figure 25:
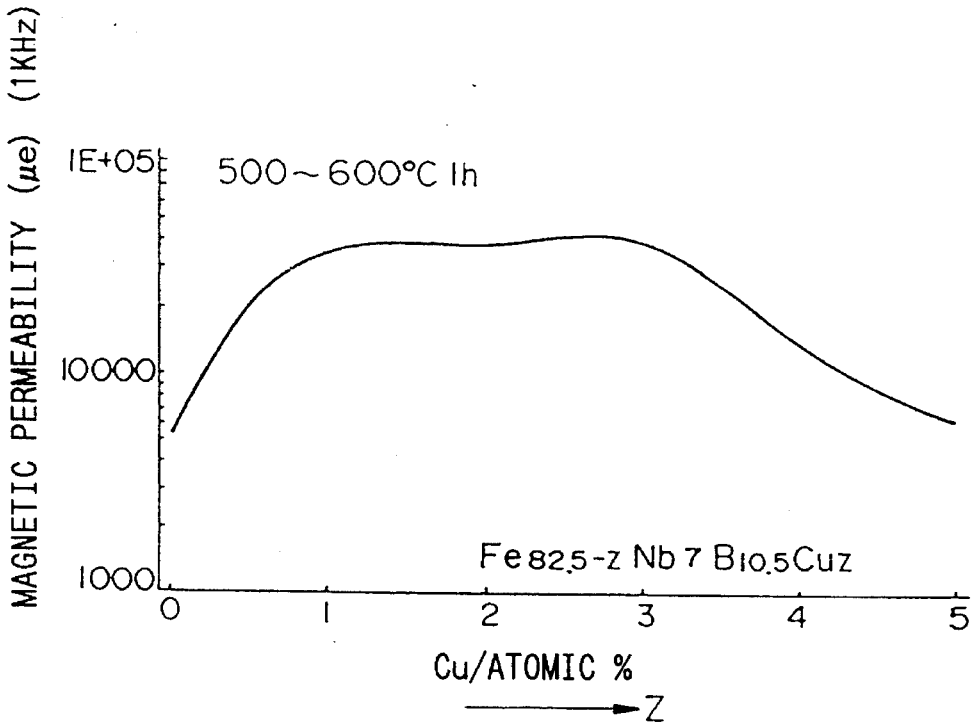
FIG. 25 is a single logarithmic graph which illustrates the quantity of Cu and the effective magnetic permeability of an example of an alloy system according to the present invention.

As an example, the relationship between the Cu quantity (z) in a $Fe_{82.5-z}Nb_7B_{10.5}Cu_z$ alloy system and the magnetic permeability is shown in FIG. 25.

As can be understood from FIG. 25, effective permeabilities can easily be obtained if the quantity of Cu is in a range from 0.2 to 4.5 atom %. If the quantity of Cu is 0.2 atom % or less, the effect of the addition of Cu cannot easily be obtained. If the quantity of Cu is larger than 4.5 atom %, the magnetic permeability deteriorates, resulting in a practical problem to occur. If the quantity of Cu is 0.2 atom % or less, a practical effective magnetic permeability of 5000 or more can be obtained and the saturation magnetic flux density can be somewhat raised. Therefore, Cu may be added by a quantity of 0.2 atom % or less. As a result, the range of the content of Cu in the alloys according to the present invention is determined to be 4.5 atom % or less.

A Fe—Nb—Ta—B—Cu alloy system, a Fe—Nb—Ti—B—Cu alloy system and Fe—Nb—Ta—Ti—B—Cu alloy system obtained by substituting Nb of the foregoing Fe—Nb—B—Cu alloy system by a plurality of elements will now be described.

Figure 26:
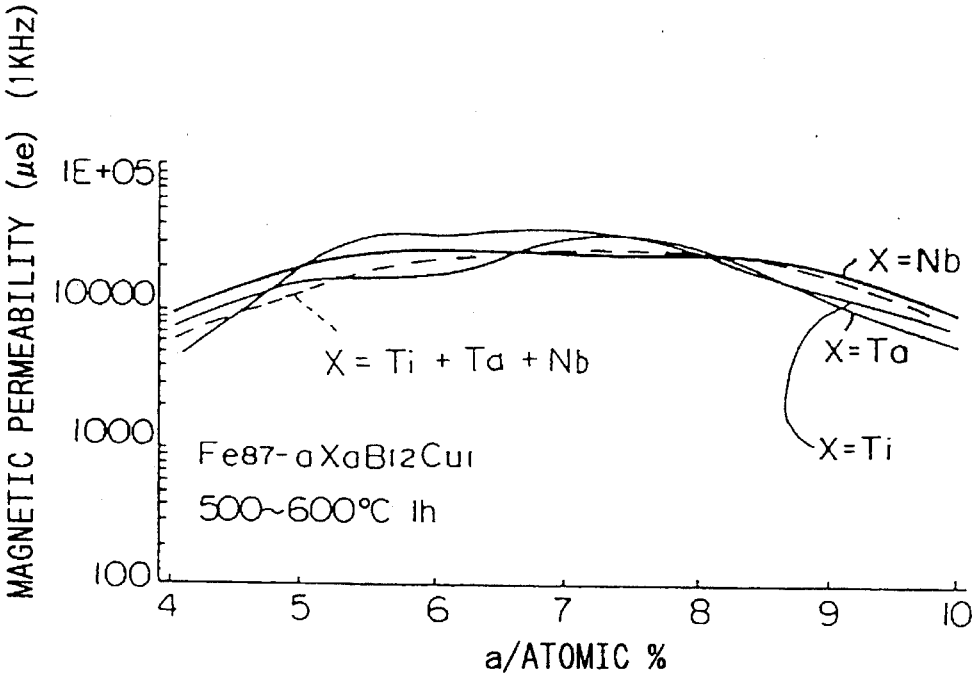
FIG. 26 is a single logarithmic graph which shows the relationship between the quantities of Nb, Ta and Ti and the magnetic permeability of an example of the alloy systems according to the present invention.

As examples, FIG. 26 shows the permeabilities of alloys realized when the quantities are increased/decreased in a range from 4 to 10 atom % in a case where the quantities of B and Cu respectively are made to be constant values of 12 atom % and 1% and Nb and a portion of Nb are substituted by Ta and Ti.

As can be understood from FIG. 26, a similar magnetic permeability was obtained from the alloys having the foregoing compositions.

Further, the saturation magnetic flux density (kG) of the alloys having the compositions shown in Table 16 was measured.

TABLE 16

| Composition of Alloy | Saturation Magnetic Flux Density | μe (1 kHz) |
|---|---|---|
| $Fe_{84}Nb_7B_8Cu_1$ | 15.3 (kG) | 31000 |
| $Fe_{80}Ta_7B_{12}Cu_1$ | 12.0 | 20000 |
| $Fe_{82}Ti_7B_{10}Cu_1$ | 14.0 | 26000 |
| $Fe_{82}Ta_4Ti_3B_{10}Cu_1$ | 14.0 | 24000 |
| $Fe_{82}Nb_3Ta_2Ti_2B_{10}Cu_1$ | 14.1 | 20000 |

As a result, it can be found that Nb of the Fe—Nb—B—Cu alloy system can be substituted by Ta and/or Ti, and Nb can be substituted by Nb and Ti, Nb can be substituted by Ta and Ti, and Nb can be substituted by Ta and Ti.

As can be understood from the explanation of the foregoing examples, the soft magnetic alloys having the composition according to the tenth aspect is an excellent material having a high magnetic permeability of 10000 or higher, an excellent saturation magnetic flux density of 12 to 15.3 kG, excellent heat resistance and satisfactory hardness.

Therefore, the soft magnetic alloys according to the present invention is a material suitable to be used in a magnetic head, a transformer or a choke coil, resulting in effects to be obtained with the foregoing units that the performance can be improved and the size and the weight can be reduced.

Example 17

The effect of the heat treatment acting on the magnetic characteristics and the structure of the alloys according to an eleventh aspect of the present invention will now be described in such a manner that a $Fe_{84}Nb_7B_9$ alloy which is one of the basic composition of the foregoing alloy is explained as an example. The temperature at which the crystallization of the foregoing alloy obtained from a differential thermal analysis at a heating rate of 10° C./minute was 490° C.

Figure 27:
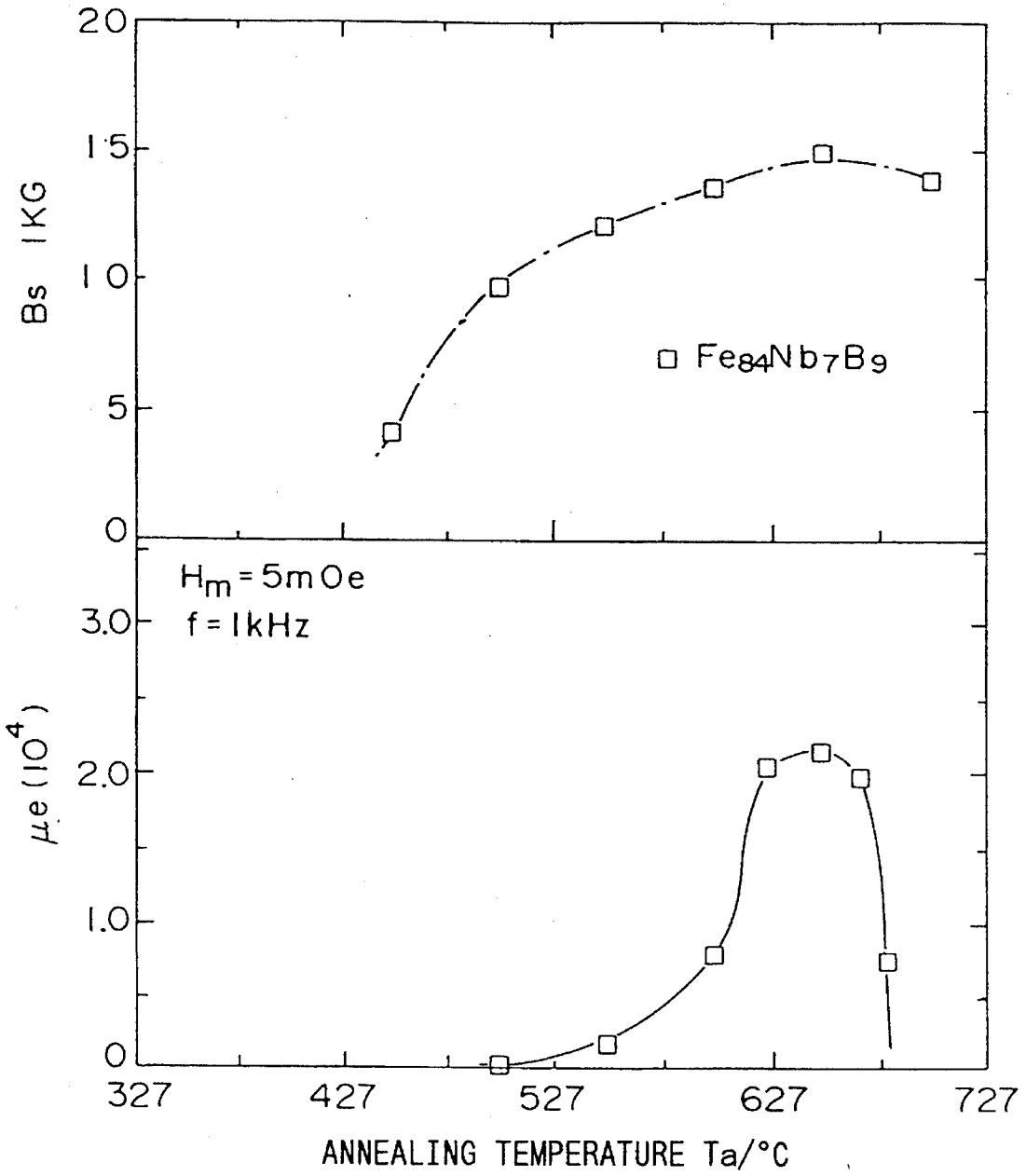
FIG. 27 is a graph which shows both the relationship between the saturation magnetic flux density and the annealing temperature and the relationship between the effective magnetic permeability and the annealing temperature of an example of an alloy according to the present invention.

FIG. 27 illustrates an effect of annealing (maintained at each temperature for one hour) upon the effective magnetic permeability (me) and the saturation magnetic flux density (Bs) of the foregoing alloy.

As can be understood from the results shown in FIG. 27, the effective magnetic permeability of the alloy according to the present invention in a rapidly solidified state (RQ) is a low value. However, the effective magnetic permeability is rapidly increased due to annealing set to 550° to 680° C. The dependency of the magnetic permeability upon the frequency was examined by using a sample having a thickness of about 20 μm and subjected to heat treatment set to 650° C., resulting in that excellent soft magnetic characteristics were attained even if the measuring frequency was high, such that a magnetic permeability of 22000 was obtained at 1 KHz, a magnetic permeability of 19000 was obtained at 10 KHz and a magnetic permeability of 8000 was obtained at 100 KHz. The magnetic characteristics of the alloys according to the present invention can be adjusted by adequately selecting the heat treatment conditions, such as the heating rate. Further, the magnetic characteristics can be improved by performing annealing or the like in the magnetic field.

Figure 28:
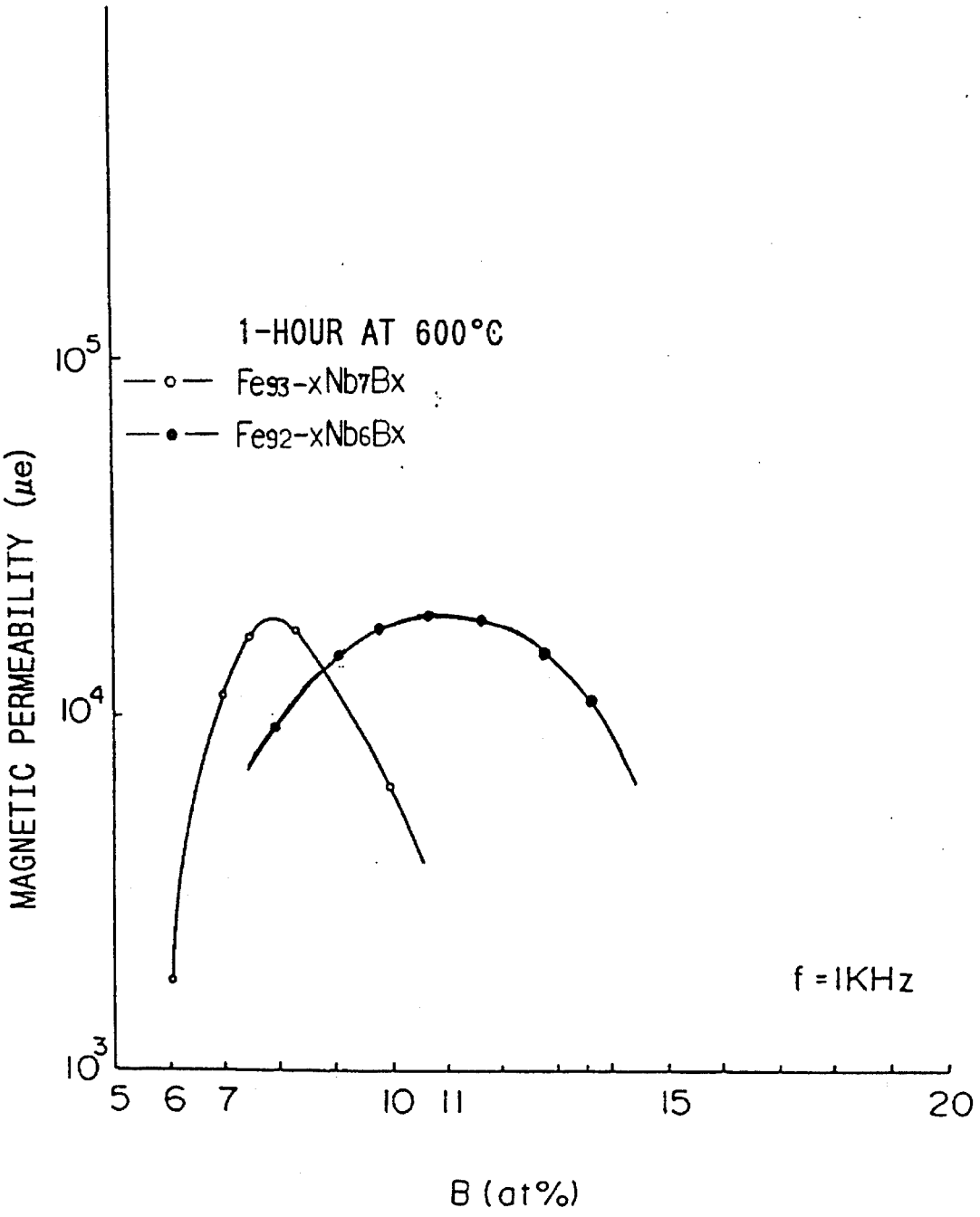
FIG. 28 is a single logarithmic graph which shows the relationship between the quantity of B and the effective magnetic permeability of an example of an alloy system according to the present invention.

FIG. 28 shows results of influences of the content of B upon the effective magnetic permeability of the alloy, the composition of which is expressed by $Fe_{93-x}Nb_7B_x$ and $Fe_{92-x}Nb_6B_x$. The results shown in FIG. 28 were obtained by increasing/decreasing the content of B in a range from 6 to 10 atom % and 8 to 14 atom % for $Fe_{93-x}Nb_7B_x$ and $Fe_{92-x}Nb_6B_x$, respectively.

As can be seen the results shown in FIG. 28, it was found that excellent magnetic permeability can be obtained if B is contained by a quantity ranging from 6.5 to 14 atom %. Therefore, the content of B according to the eleventh aspect is determined to be 6.5 to 14%.

Figure 29:
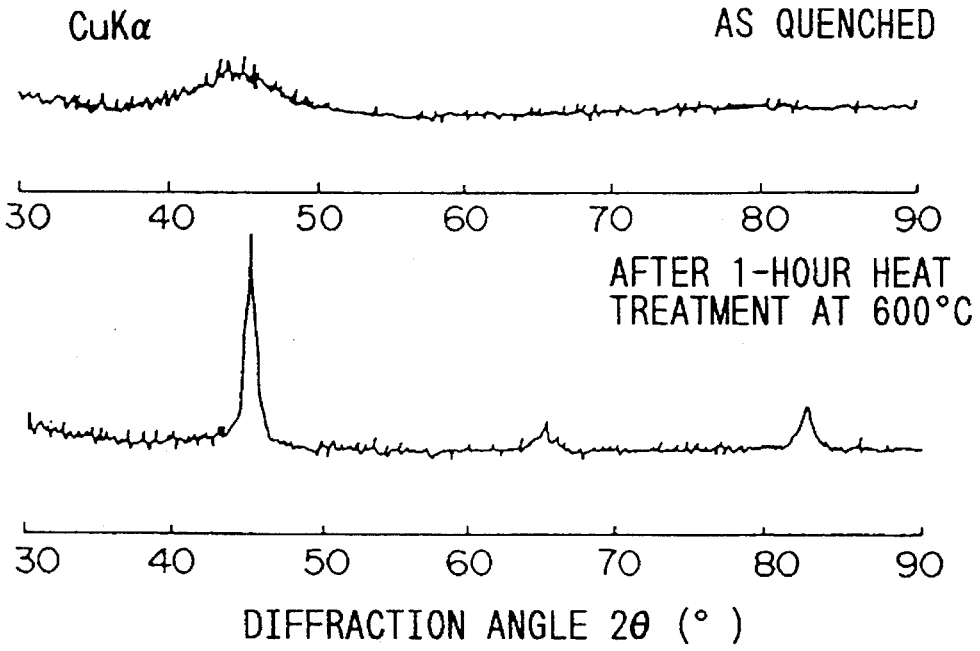
FIG. 29 is a graph which shows results of an X-ray diffractometry showing the structural change of an alloy according to the present invention taken place before and after the heat treatment.

Then, the change in the structure of the $Fe_{93-x}Nb_7B_x$ alloy system subjected to the heat treatment was examined by an X-ray analysis method, and the structure formed after the heat treatment had been performed was observed by using a transmission electronic microscope. Results of the examination is shown in FIGS. 29 and 30.

Figure 30:
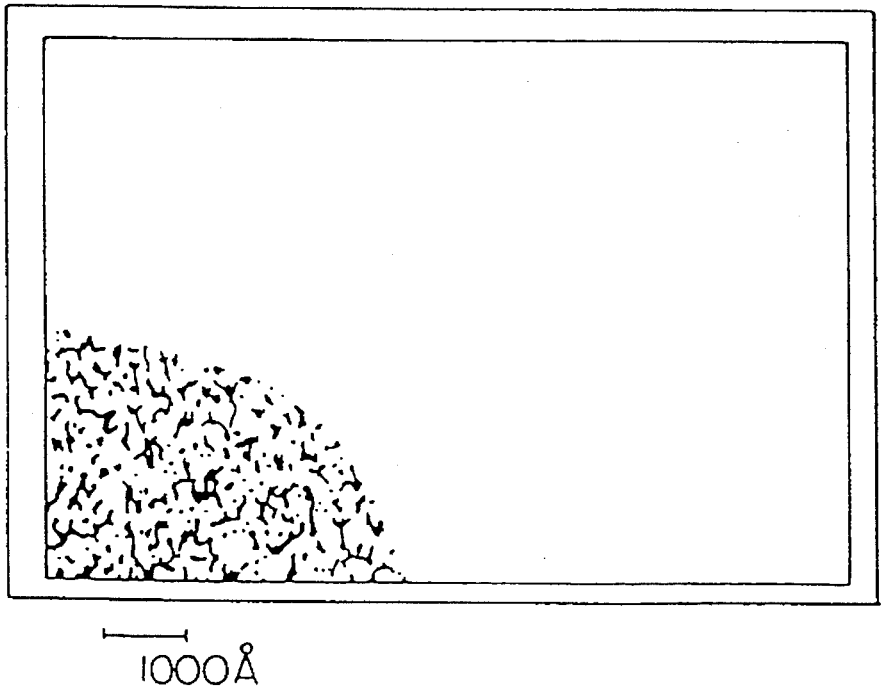
FIG. 30 is a schematic view of a microscope photograph showing the structure of an example of an alloy according to the present invention after the heat treatment has been performed.

As can be understood from FIG. 30, a halo diffraction pattern corresponding to the amorphous was observed in a rapidly solidified state, and a diffraction pattern corresponding to a crystalline structure was observed after the heat treatment had been performed. Therefore, it has been understood that the structure of the alloys according to the present invention has been changed from amorphous to the crystalline structure.

Further, another fact can be understood from FIG. 30 that the structure realized after the heat treatment had been performed was composed of fine grains, the grain size of which was about 10 to 20 nm.

The change of the hardness of the $Fe_{84}Nb_7B_9$ alloy before and after the heat treatment was examined, resulting in that the Vickers hardness was, due to the heat treatment set to 650° C., improved from 650 DPN in the rapidly solidified state to 950 DPN. Therefore, the foregoing alloy is suitable as the material for the magnetic head.

As described above, the alloys according to the eleventh aspect has a structure mainly composed of very small crystalline grains by crystallizing the amorphous alloy having the foregoing composition by the heat treatment. Therefore, excellent characteristics can be attained such that the saturation magnetic flux density is very high, excellent soft magnetic characteristics, satisfactory hardness and excellent heat stability are attained. Further, the elements mainly used in the alloys according to the present invention has a restricted tendency of generating an oxide and, accordingly, the alloys can easily be manufactured because it cannot easily be oxidized.

Figure 33A:
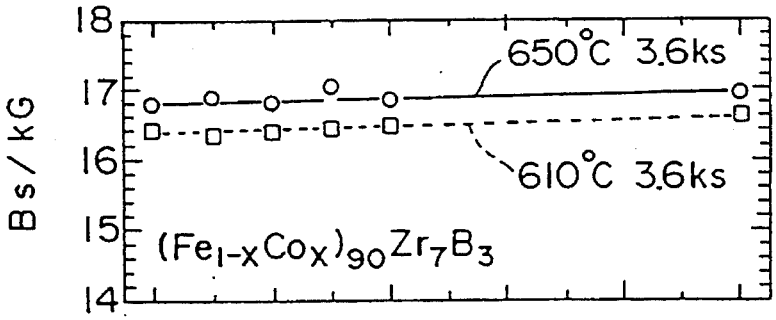
FIG. 33 (*a*) is a graph which shows the relationship between the quantity of Co and the saturation magnetic flux density of an example of an alloy system according to the present invention.
Figure 33B:
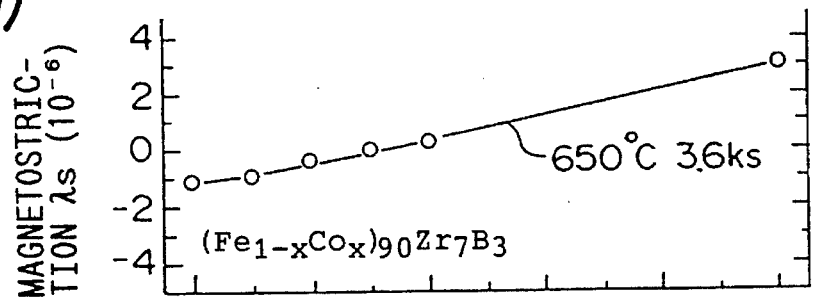
Figure 33C:
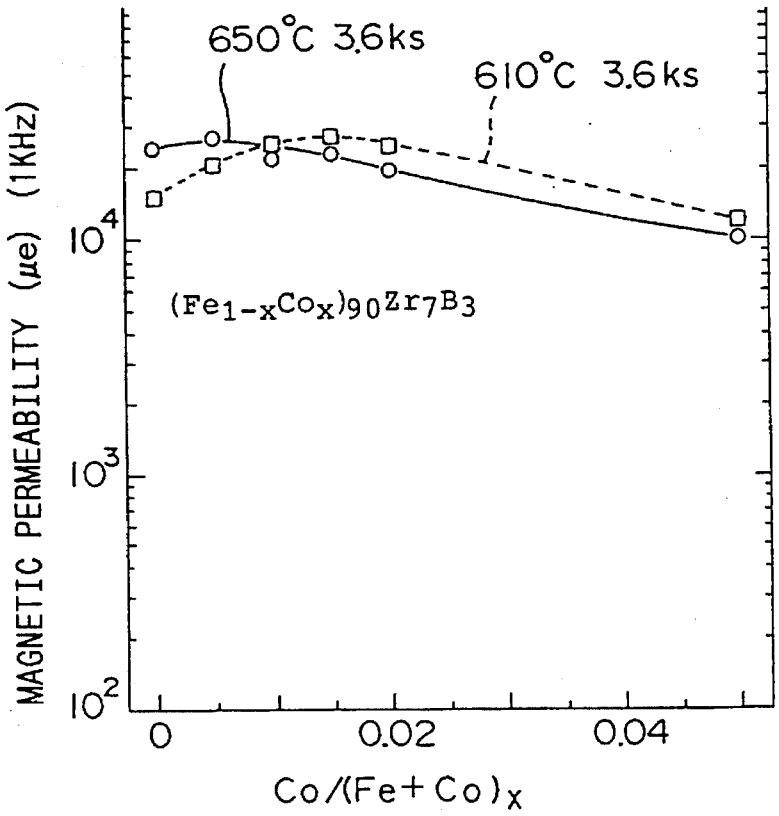

An example in which the quantity of Fe, the quantity of B and that of Nb respectively are increased/decreased in the basic composition of the soft magnetic alloys according to the present invention to measure the change in the magnetic permeability. Results of the measurements are shown in FIG. 33.

Figure 31:
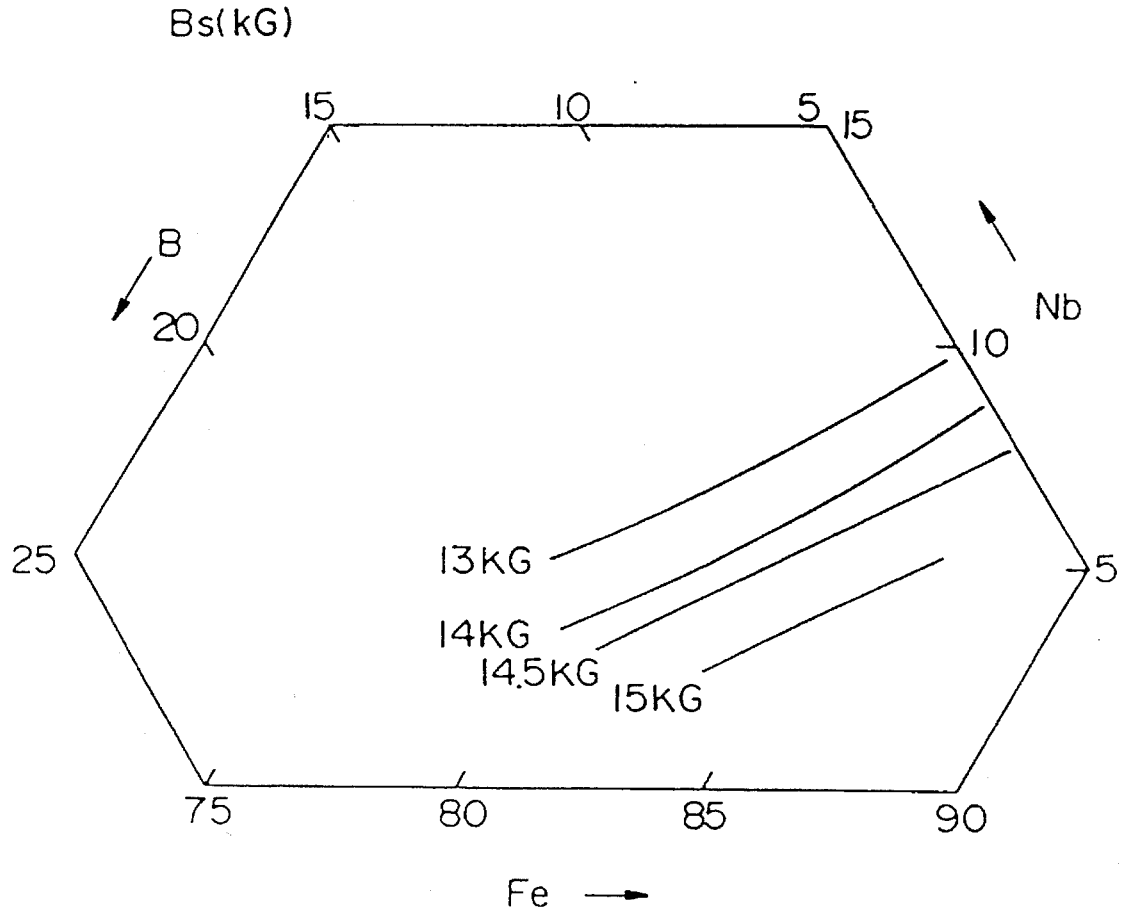
FIG. 31 is a triangle composition view which shows the saturation magnetic flux density of an example of an alloy system according to the present invention in a case where the quantities Fe, B and Nb are changed.

As can be seen from FIG. 31, the composition of the alloys according to the present invention enables an excellent value to 13 kG to 15 kG to be obtained.

The reason why the quantities of Co and Ni in the alloys according to the eleventh aspect of the present invention are so determined will now be described.

Figure 32:
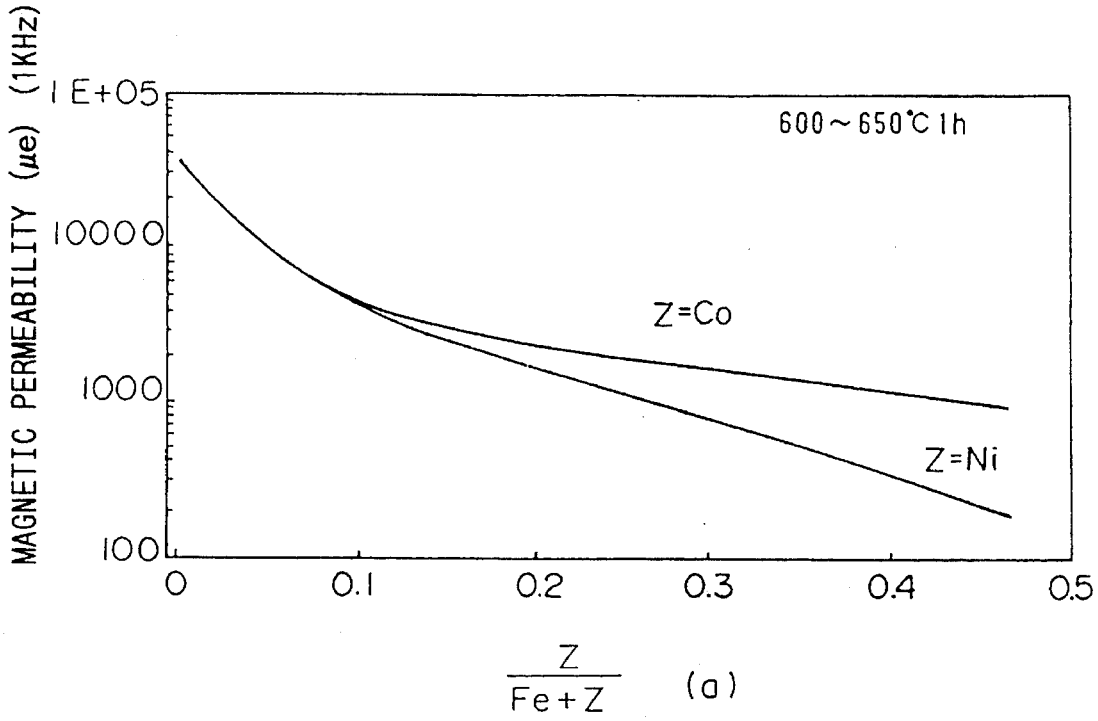
FIG. 32 is a single logarithmic graph which shows the relationship between the quantity of Co or that of Ni and the magnetic permeability of an example of an alloy system according to the present invention.

As an example, the relationship between the quantity of Co and the Ni quantity (a) in a $(Fe_{1-a}Z_a)_{84}Nb_7B_9$ alloy system and the magnetic permeability is shown in FIG. 32.

As can be understood from FIG. 32, an excellent magnetic permeability equivalent to that of the Fe amorphous alloy can be obtained if the quantity of Co and the Ni quantity (a) are in a range of 0.1 or lower. If the quantities are larger than 0.1, the magnetic permeability rapidly undesirably deteriorates. Therefore, the quantities of Co and Ni are determined to be 0.1 or less in the present invention.

Table 17 shows results of measurements of the magnetic characteristics of soft magnetic alloys obtained by subjecting Fe—Nb—Ta—B—Cu alloy system, a Fe—Nb—Ti—B alloy system and Fe—Nb—Ta—Ti—B alloy system obtained by substituting Nb of the foregoing Fe—Nb—B alloy by a plurality of elements to heat treatment at a heating rate of 80° to 100° C./minute.

TABLE 17

| Composition | μe (1 kHz) | Bs (kG) |
|---|---|---|
| $Fe_{84}Nb_7B_9$ | 23500 | 15.3 |
| $Fe_{84}Nb_4Ta_2Ti_1B_9$ | 12000 | 15.0 |
| $Fe_{84}Nb_6Ti_1B_9$ | 12500 | 15.0 |
| $Fe_{84}Nb_6Ta_1B_9$ | 11000 | 14.9 |

As can be understood from the results shown in Table 17, the foregoing alloys enabled similar magnetic permeability and saturation magnetic flux density to be obtained.

As a result, it can be found that Nb of the Fe—Nb—B alloy system can be substituted by Ta and/or Ti, and Nb can be substituted by Nb and Ti, Nb can be substituted by Nb and Ti, and Nb can be substituted by Nb, Ta and Ti.

As can be understood from the explanation of the foregoing examples, the soft magnetic alloys having the composition according to the eleventh aspect is an excellent material having a high magnetic permeability equivalent to or superior to that of the Fe amorphous alloy, an excellent saturation magnetic flux density of about 15 kG, excellent heat resistance and satisfactory hardness.

Therefore, the soft magnetic alloys according to the eleventh aspect of the present invention is a material suitable to be used in a magnetic head, a transformer or a choke coil, resulting in effects to be obtained with the foregoing units that the performance can be improved and the size and the weight can be reduced.

Example 18

FIGS. 33 (*a*), (*b*) and (*c*) show the relationship among measured magnetic permeability (μe), the magnetostriction (λs) and the saturation magnetic flux density (Bs) while changing the quantity of Co in samples having compositions $(Fe_{1-x}Co_x)_{90}Zr_7B_3$. The foregoing measurements were performed under similar conditions according to the foregoing examples.

As can be seen from the results shown in FIG. 33, a magnetic permeability of 20000 or higher can be obtained if the Co quantity (a) ranges from 0.01 to 0.03. As for the saturation magnetic flux density, an excellent value of 16.4 kG to 17 kG is attained even if the Co quantity is changed. Another fact was found that, since the magnetostriction varies in a range from $-1\times10^{-6}$ to $+3\times10^{-6}$ in accordance with the change of the Co quantity, the magnetostriction can be adjusted by substituting a portion of Fe by Co and by selecting an adequate composition. Therefore, the magnetostriction can be adjusted while considering the influence of the pressure applied at the time of molding the resin upon the magnetostriction.

Example 19

Figure 34:
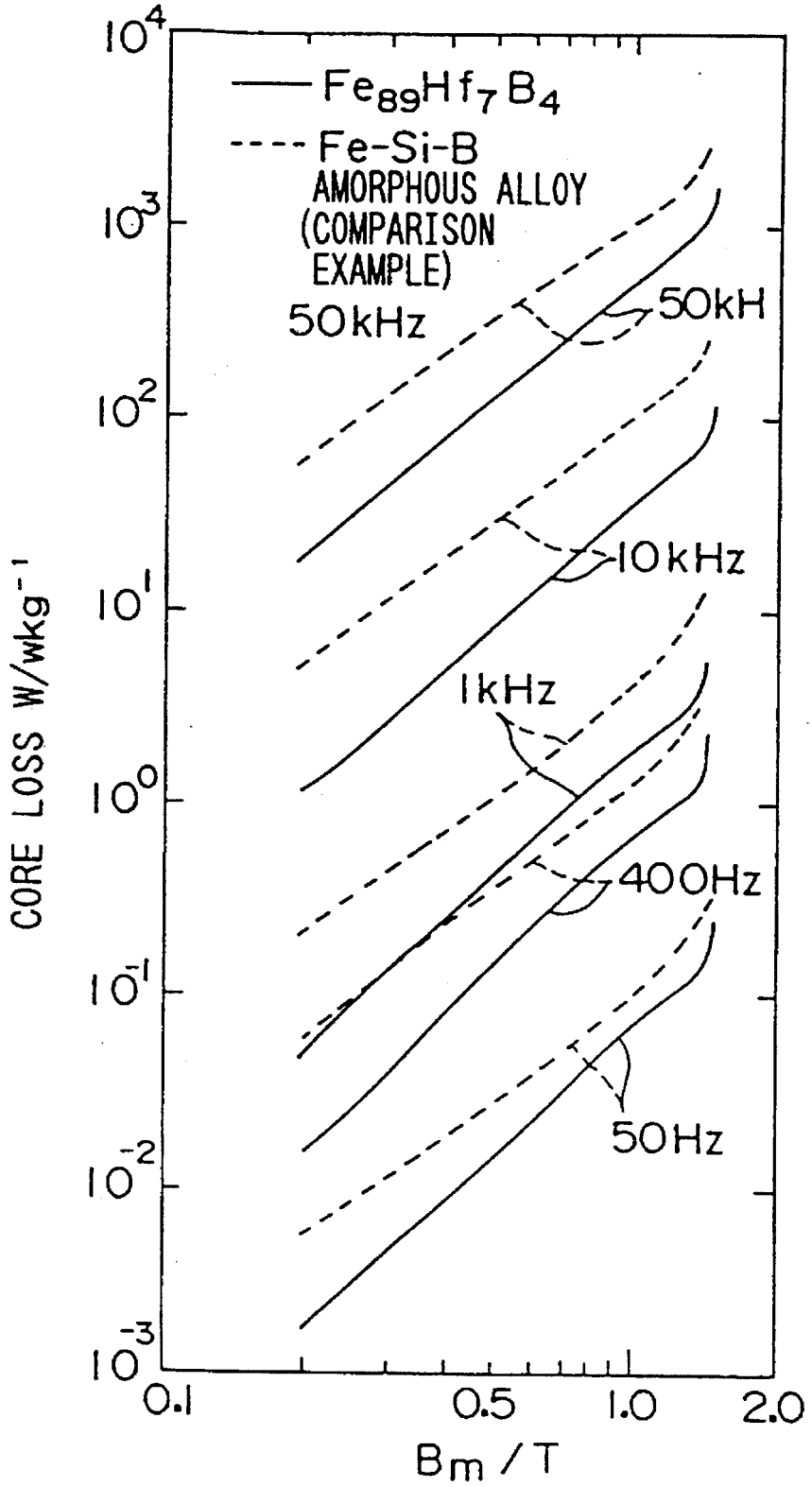
FIG. 34 is a graph which shows the relationship between the core loss and the maximum magnetic induction of an example of an alloy according to the present invention.

FIG. 34 shows results of measurements of the core loss of an alloy having the composition expressed by $Fe_{89}Hf_7B_4$ according to the present invention and that of a Fe—Si—B amorphous alloy according to a comparative example. The core loss was measured under conditions that annular samples were manufactured, a coil is fastened around each sample, a sine wave electric current is applied, and a Sin B-mode was employed in which Fourier transformation is performed to calculate numerals.

As can be seen from results shown in FIG. 34, the alloys having the composition according to the present invention displayed reduced core loss as compared with the amorphous alloy according to the comparative example at each of frequencies 50 Hz, 400 Hz, 1 kHz, 10 kHz and 50 kHz.

Example 20

Samples of alloys having the compositions according to the present invention were manufactured to measure the relationship between the heating rate at the time of manufacturing the samples and the magnetic permeability of the manufactured samples, resulting in as shown in FIGS. 35 to 38.

Figure 35:
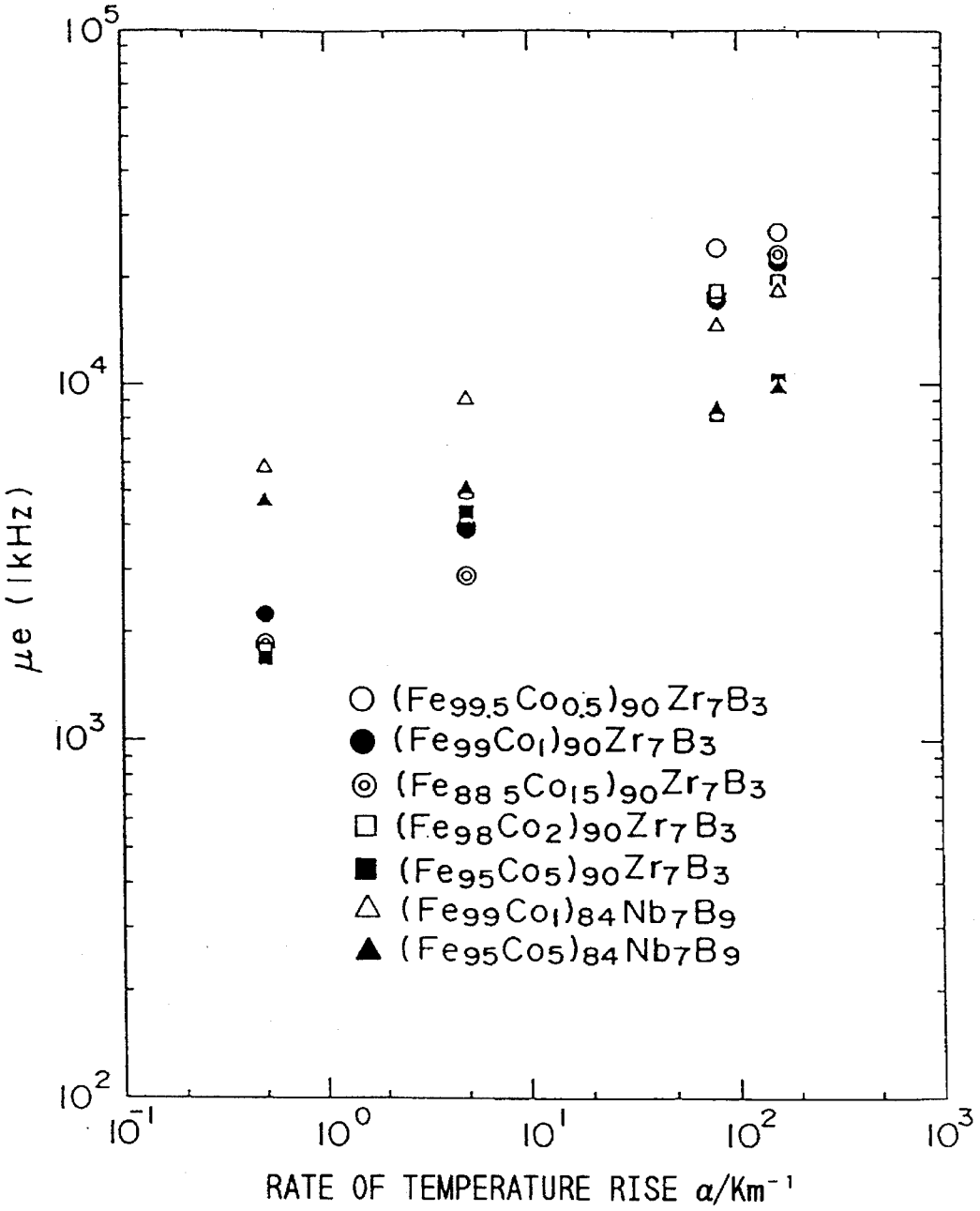
FIG. 35 is a graph which shows the relationship between the heating rate and the magnetic permeability of a first example of the alloy systems according to the present invention.
Figure 36:
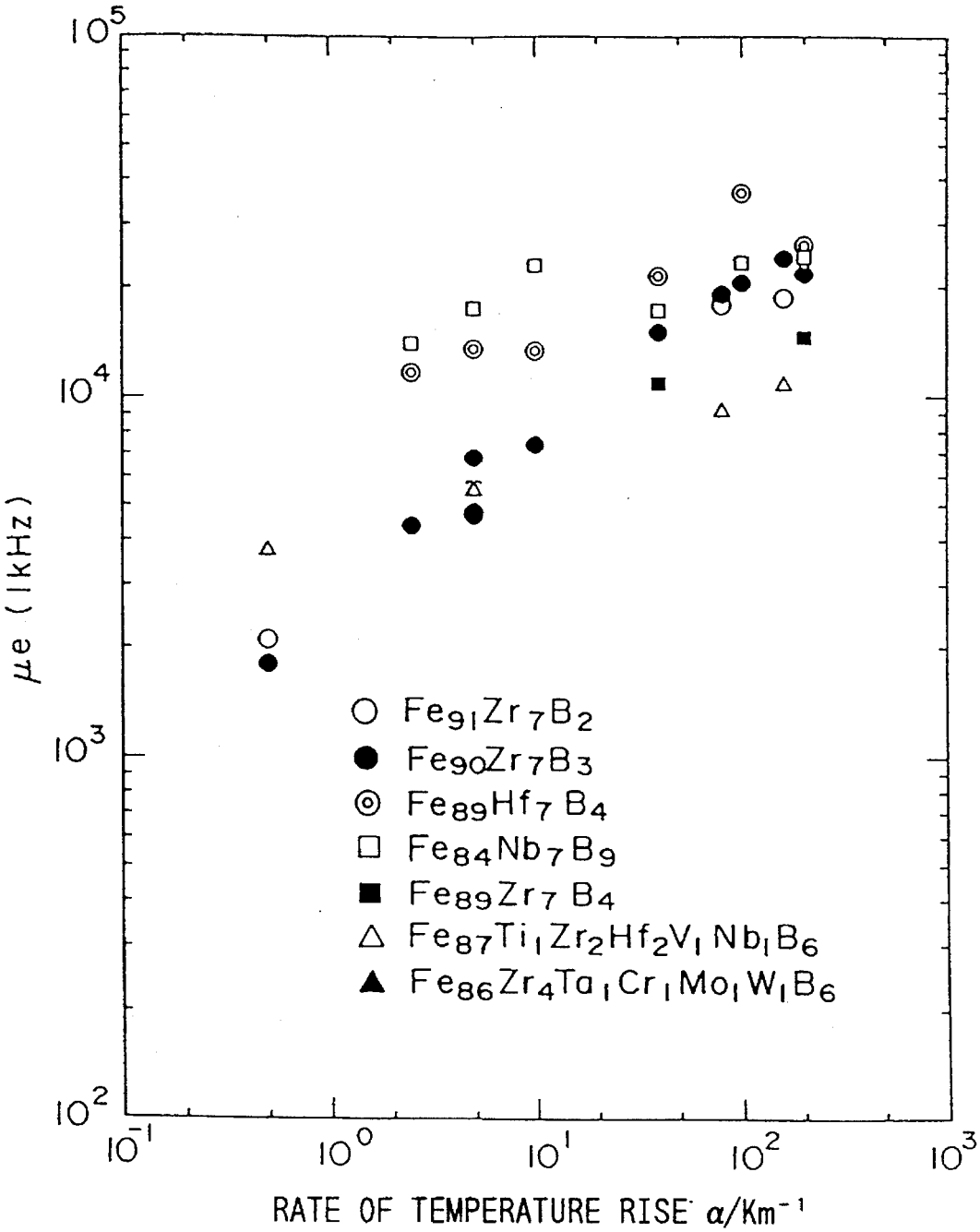
FIG. 36 is a graph which shows the relationship between the heating rate and the magnetic permeability of a second example of the alloy systems according to the present invention.
Figure 37:
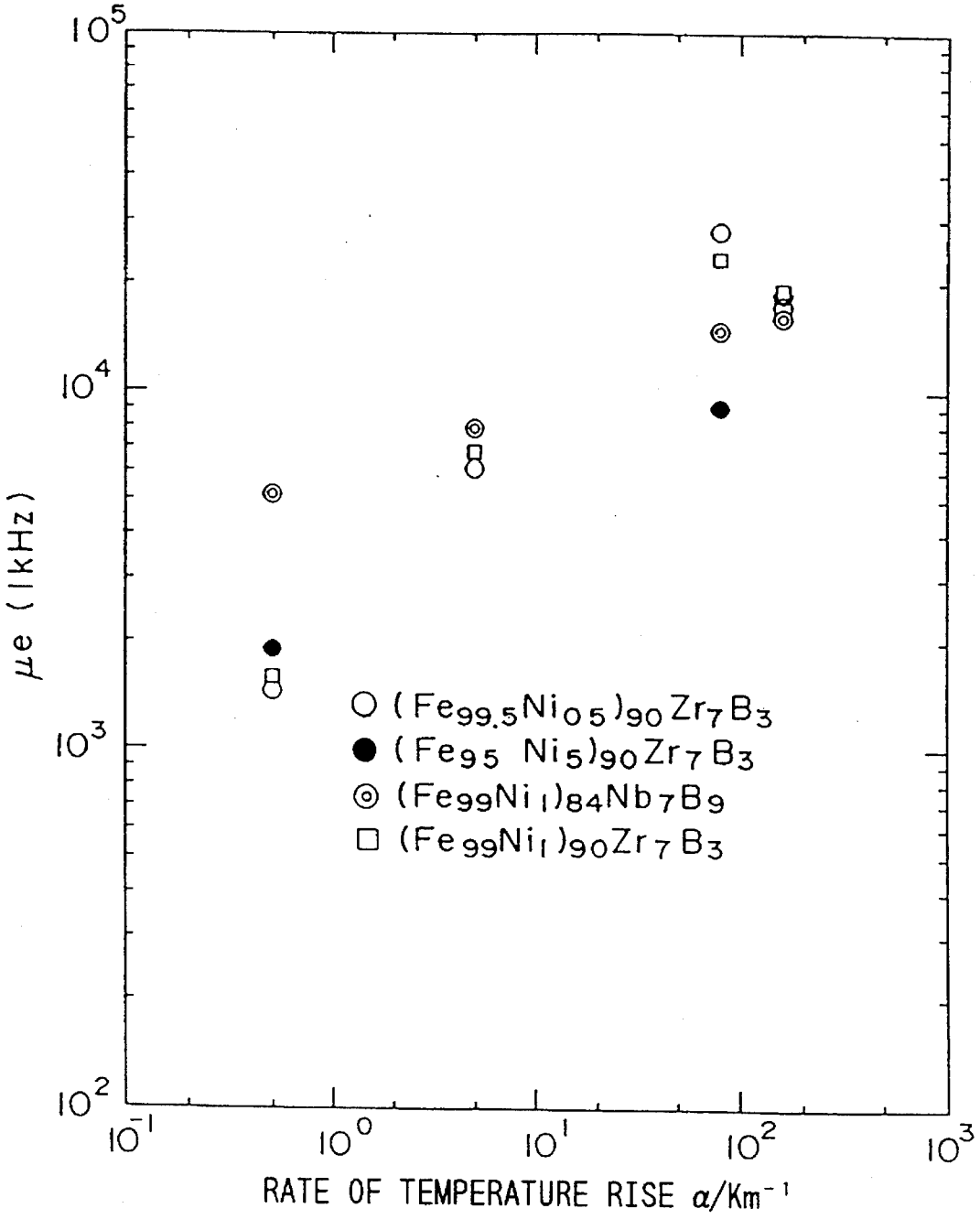
FIG. 37 is a graph which shows the relationship between the heating rate and the magnetic permeability of a third example of the alloy systems according to the present invention.
Figure 38:
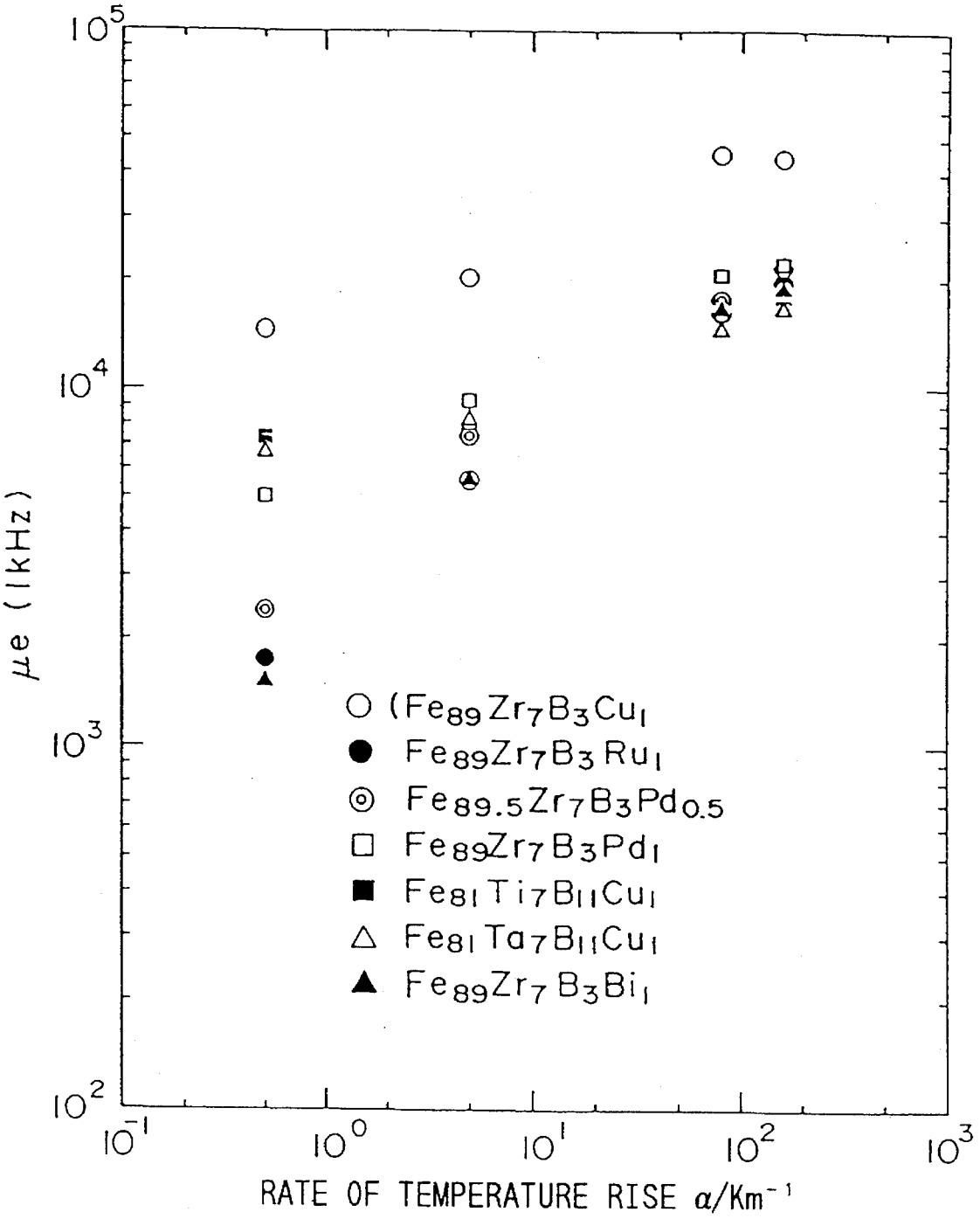
FIG. 38 is a graph which shows the relationship between the heating rate and the magnetic permeability of a fourth example of the alloy systems according to the present invention.

FIG. 35 shows, by plotting, the relationship between the heating rate and the magnetic permeability of plural samples selected from among the samples the compositions of which are shown in Table 2. FIG. 36 shows results of similar measurements obtained by using the samples shown in Table 3. FIG. 37 shows results of similar measurements obtained by using the samples shown in Table 4. FIG. 38 shows results of similar measurements obtained by using the samples shown in Table 5.

As can be seen from results shown in FIGS. 35 to 38, each of the alloys having the compositions according to the present invention has a tendency of improving the magnetic permeability when the heating rate is improved.

Example 21

Figure 39:
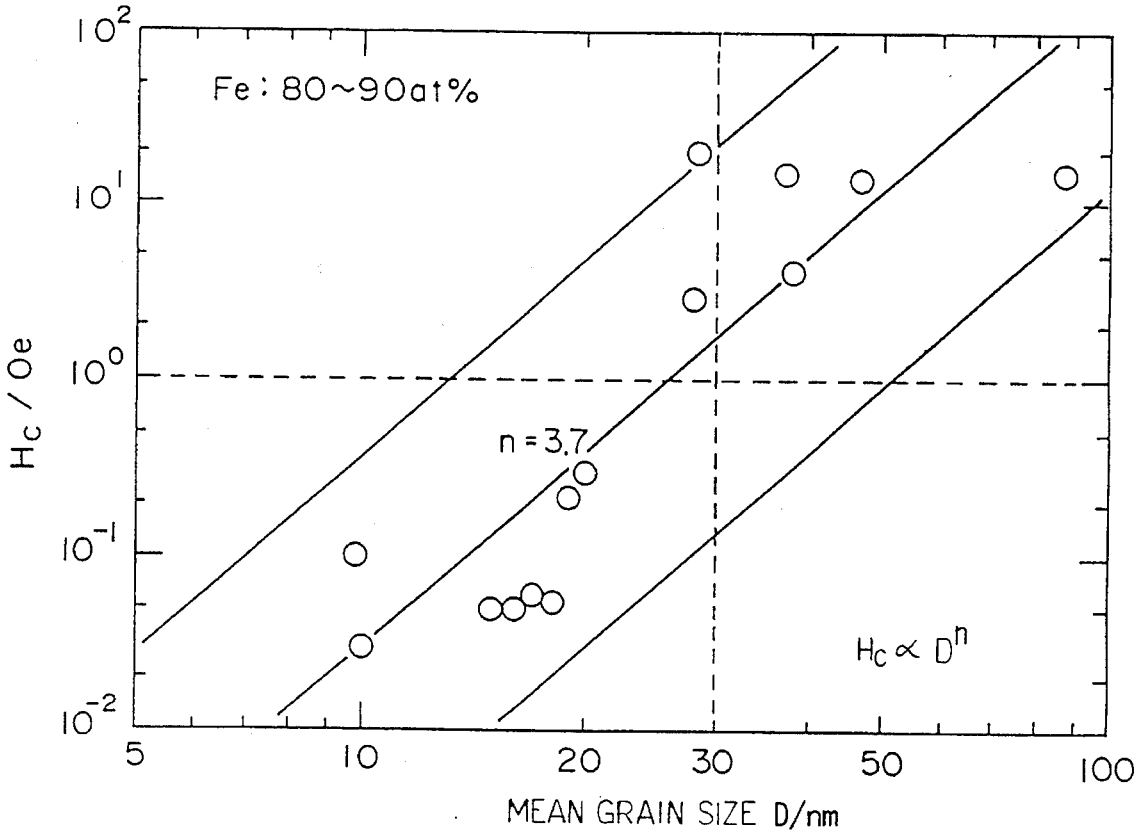
FIG. 39 is a plot of the data shown in Table 18, showing the relationship between the average grain size and the coercive force of the example of the alloy systems according to the present invention.

FIG. 39 shows the relationship between the average grain size of the crystal and the coercive force of the samples having the compositions shown in the following Table 18.

TABLE 18

| Composition | Average Crystalline Grain Size (nm) | Coercive Force (Oe) |
|---|---|---|
| $Fe_{84}Nb_7B_9$ | 10 | 0.1 |
| $Fe_{86}Zr_7B_6Cu_1$ | 10 | 0.03 |
| $Fe_{89}Hf_7B_4$ | 15 | 0.07 |

TABLE 18-continued

| Composition | Average Crystalline Grain Size (nm) | Coercive Force (Oe) |
|---|---|---|
| $(Fe_{0.99}Co_{0.01})_{90}Zr_7B_3$ | 15 | 0.07 |
| $Fe_{91}Zr_7B_2$ | 18 | 0.09 |
| $Fe_{86}B_{14}$ | 28.8 | 4.0 |
| $Fe_{79}Cr_7B_{14}$ | 37.2 | 15.0 |
| $Fe_{79}V_7B_{14}$ | 46.9 | 13.8 |
| $Fe_{83}W_7B_{10}$ | 87.2 | 14.9 |

As can be seen from Table 18, excellent coercive force can be obtained by making the average grain size of crystal to be 30 nm or less.

As a result, the inventors of the present invention have attempted to improve the magnetic characteristics by forming a finer structure by improving the heat treatment process to which the alloy is subjected. While considering the theory of crystallization of the amorphous alloy (theory of nucleation and growth), a small grain size can be obtained if conditions are satisfied with which a high nuclei generation speed and a low growth speed are obtained. In usual, the nuclei generation speed and the growth speed are the functions of the temperature, and the foregoing conditions have been considered that the conditions can be met by lengthening the heat treatment period in a low temperature region. However, the inventors of the present invention considered that the heating rate is raised on the contrary to the foregoing conventional concept as a result of the following examples.

Example 22

Figure 40:
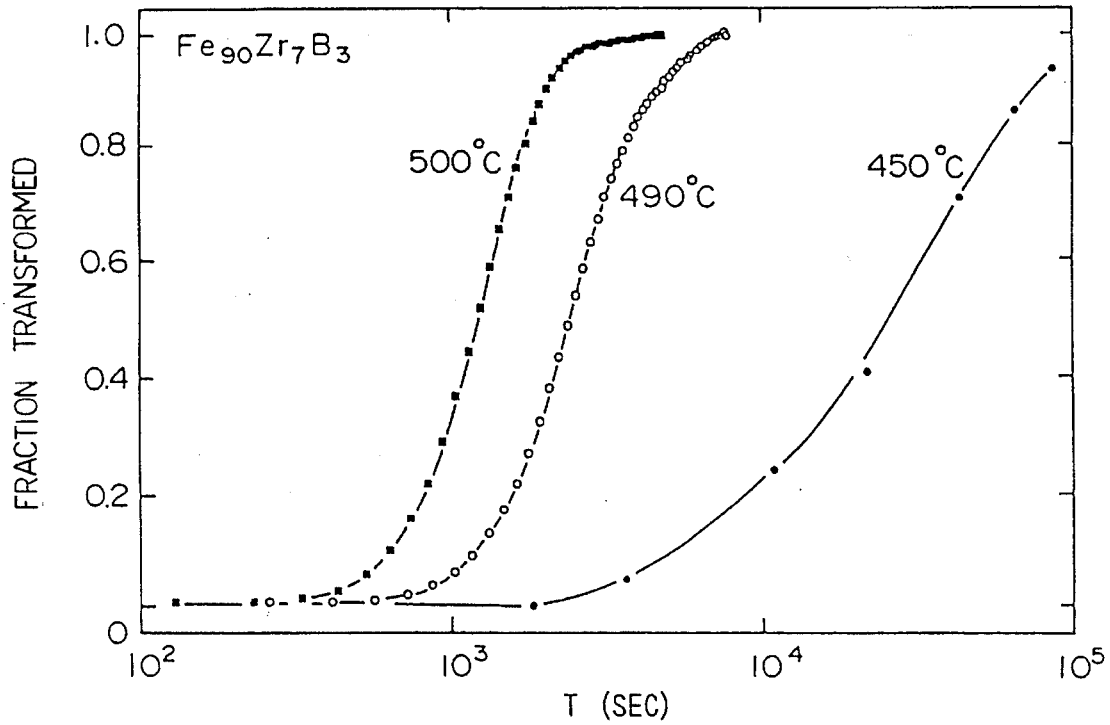
FIG. 40 is a graph which shows the fraction transformed for the crystallization reaction of an example of an alloy according to the present invention.

FIG. 40 shows the relationship between the measured time t and the fraction transformed (crystal volume fraction) realized when crystallization is performed at a constant temperature by using a sample, the composition of which is expressed by $Fe_{90}Zr_7B_3$. The time t shown by the axis of abscissa of FIG. 40 will now be described. It has been known that the volume fraction of the crystal x and the time t hold the relationship expressed by an equation known as a JMA (Johnson-Mehl-Avrami)'s equation:

$$x=1-\exp(-kt^n)$$

where exponent n is a parameter varying depending upon the crystal deposition mechanism.

Figure 41:
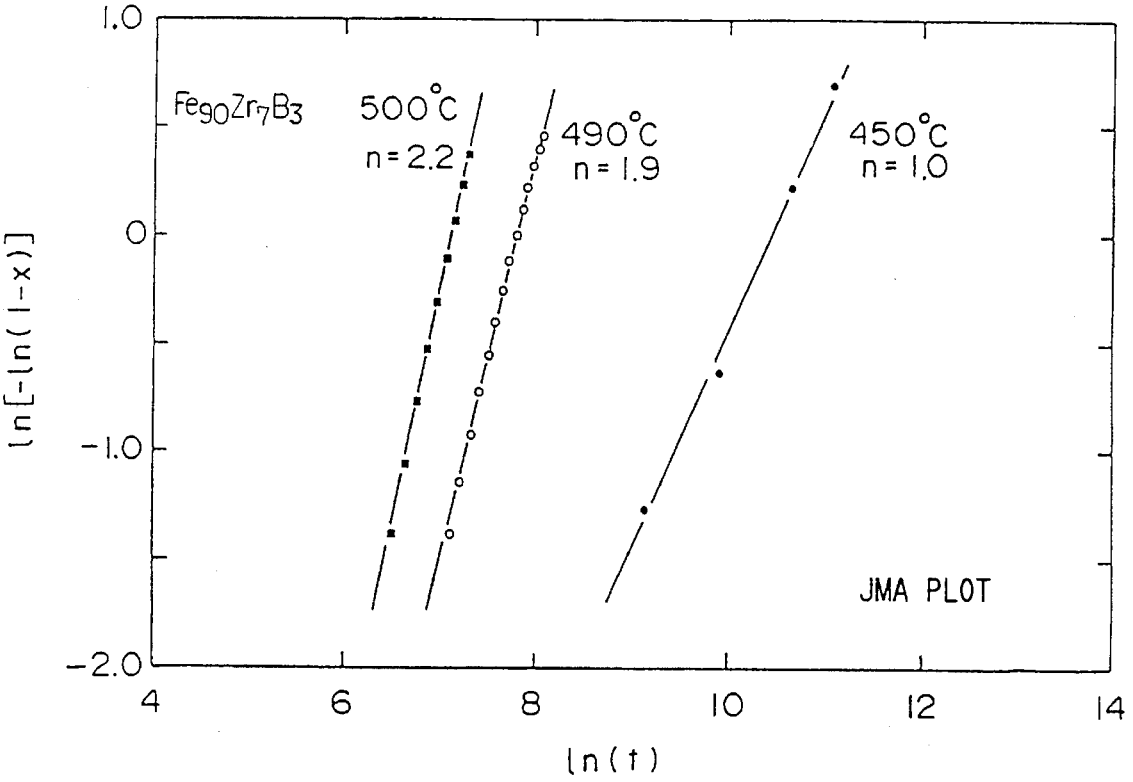
FIG. 41 is a graph which illustrates a JMA plot of the example shown in FIG. 40.

In accordance with the foregoing relationship, the logarithm of the crystallization fraction shown in FIG. 40 is taken and plotted as shown in FIG. 41. The operation for obtaining the illustrated relationship is usually called "JMA plotting".

If spherical deposition is generated uniformly, it has been known that the value of n is 1.5 to 3. If crystallization takes place at 490° C. or higher in the case shown in FIG. 41, the value of n is 1.9 to 2.2, resulting in that substantially uniform bcc (body centered cubic) crystal is precipitated. At a low temperature of 450° C., the value of n is 1.0 and a fact is shown that the state of the precipitation of the bcc crystal is nonuniform. As a result, a fact can be understood that the crystallization performed at a higher temperature is effective to obtain a uniform and precise structure. Since the crystallization temperature of amorphous is usually raised in proportion to the heating rate, uniform fining of the structure is expected by raising the heating rate.

Figure 42:
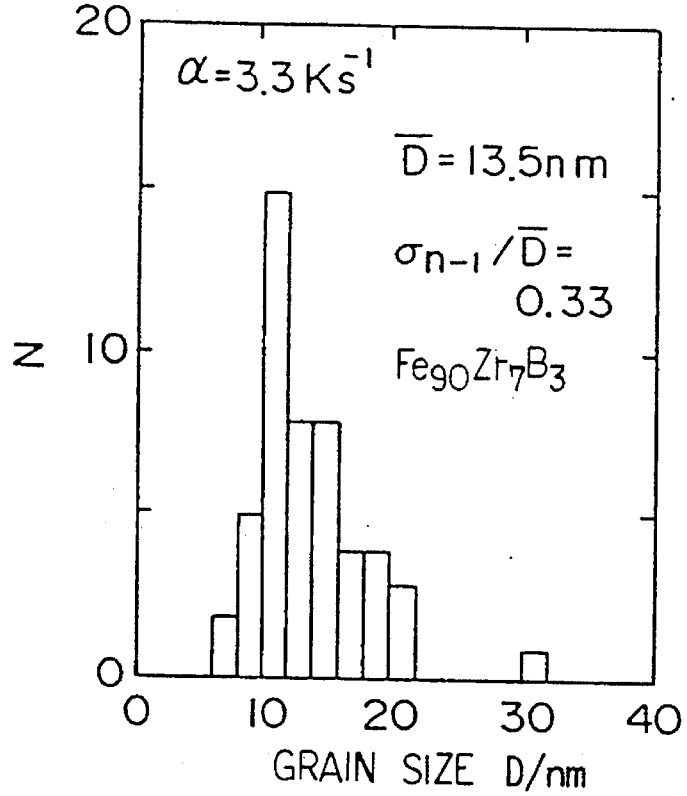
FIG. 42 is a graph which shows the size distribution of the bcc grains of an example of an alloy according to the present invention.
Figure 43:
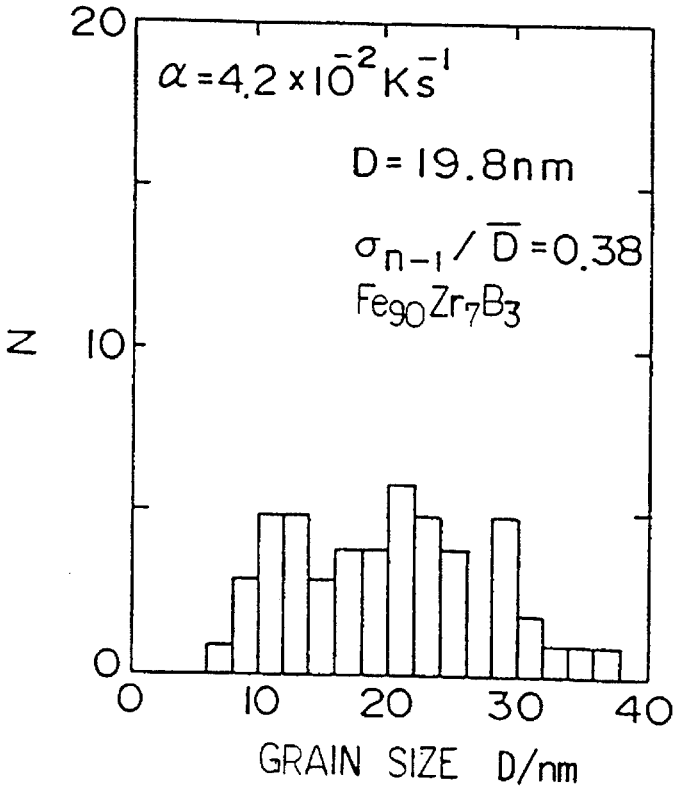
FIG. 43 is a graph which shows the size distribution of the bcc grains of a comparative example of an alloy according to the present invention.

FIG. 42 shows the results of measurements of the grain size of the crystal of the sample of the alloy having a composition expressed by $Fe_{90}Zr_7B_3$ obtained by raising the heating rate α=200° C./minute under the conditions according to the present invention. FIG. 43 shows results of measurements of the grain size of the crystal of the sample of the alloy having the same composition obtained by raising the temperature at a heating rate α=2.5° C./minute.

As can be seen from the results of the measurements of the grain size distribution of bcc crystal, the sample, the temperature of which was raised at a condition α=200° C./minute, has a small average grain size while realizing a sharp grain size distribution and concentrated grain size distribution in a small region. In contrast with this, the sample, the temperature of which is raised at a heating rate of 2.5° C./minute has a large average grain size and displays a broad grain size distribution.

As can be understood from the above explanation, the average grain size of crystal can be reduced by raising the heating rate on the contrary to the conventional wisdom.

Example 23

Figure 44:
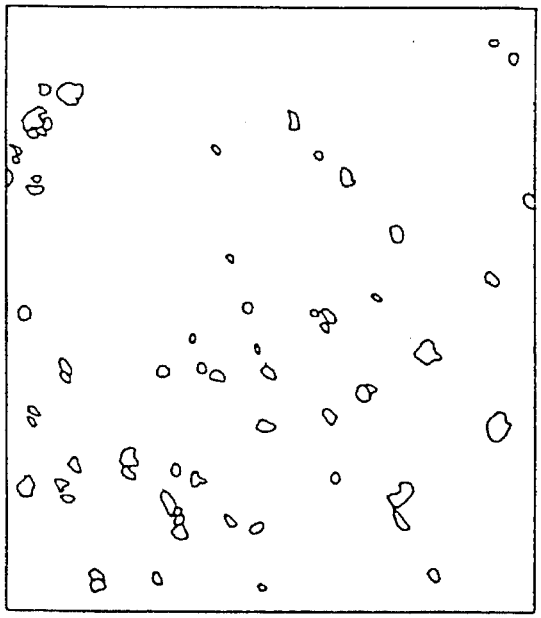
FIG. 44 is a schematic view of an electron microscope photograph which shows the results of tests carried out for determining the size of the bcc grains of an alloy subjected to heat treatment set to a heating rate of 200° C./minute according to the present invention.
Figure 45:
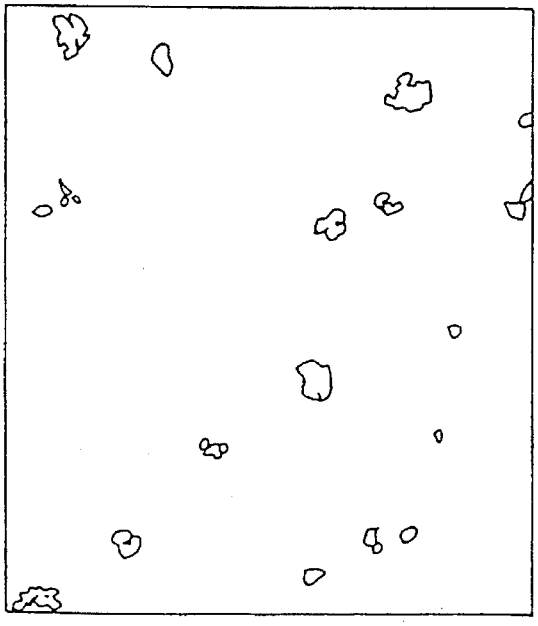
FIG. 45 is a schematic view of a microscope photograph which shows the results of tests carried out for determining the size of the bcc grains of an alloy subjected to heat treatment set to a heating rate of 2.5° C./minute according to the present invention.

FIGS. 44 and 45 show results of examinations of structures by using a transmission electronic microscope to examine the grain size of crystal of the alloy, structure of which is expressed by $Fe_{90}Zr_7B_3$.

Since the structure was observed by looking the dark visual field, only specific crystal grains are shown. However, the actual structure is occupied with similar crystal grains.

As can be understood from FIGS. 44 and 45, a fact was easily confirmed that the alloy according to the present invention has a finer structure in the case where the heating rate was raised.

Example 24

Samples having the compositions shown in the following Table 19 were manufactured and the corrosion resistance of the samples were tested. The corrosion resistance was measured under conditions of 40° to 60° C., 95% RH and 96 hours. In table 19, samples having no rust were indicated with O, samples having rust for 1% or less of the overall area were indicated with Δ and samples having rust over 1% of the overall area were indicated with x.

TABLE 19

| Composition | Magnetic Permeability | State of Corrosion |
|---|---|---|
| $Fe_{89}Zr_7B_3Ru_1$ | 19800 | Δ |
| $Fe_{82.5}Zr_4Nb_3B_{6.5}Cu_1Ru_3$ | 24000 | o |
| $Fe_{84.5}Zr_7B_5Cu_1Cr_{0.5}Ru_2$ | 28000 | o |
| $Fe_{85}Zr_{3.5}Nb_{3.5}B_7Cu_1$ (Comparative example) | 32000 | X |
| $Fe_{80}Zr_7B_6Cu_1Cr_6$ (Comparative example) | 800 | o |

As can be understood from Table 19, it was found that the samples having the compositions according to the present invention exhibit excellent corrosion resistance. A fact was found from the results of the experiments, the corrosion resistance of the alloys having the composition according to the present invention can be improved while maintaining realized magnetic characteristics by adding Ru and Cr by 5 atom % or less.

Example 25

Samples of amorphous alloys having compositions shown in the following Table 20 were manufactured and the core loss, the magnetostriction (λs) and the specific resistance (ρ) of the samples were measured, resulting in as shown in the table. The thickness (t) of each sample is shown in Table 20. The samples according to the present invention were measured under conditions that: the heating rate was 80° to 100° C./minute and the heat treatment temperature was 650° C. However, the Fe—Si—B amorphous alloy was subjected to heat treatment set to 370° C.

TABLE 20

| Structure | $Fe_{90}Zr_7B_3$ bcc | $Fe_{89}Hf_7B_4$ bcc | $Fe_{84}Nb_7B_9$ bcc | Fe—Si—B amorphous alloy amorphous |
|---|---|---|---|---|
| $^{w}14/50^{a}$ (w/kg) | 0.21 | 0.14 | 0.19 | 0.24 |
| $^{w}10/400^{a}$ (w/kg) | 0.82 | 0.61 | 0.97 | 1.22 |
| $^{w}10/1k^{a}$ (w/kg) | 2.27 | 1.70 | 2.50 | 3.72 |
| $^{w}2/100k^{a}$ (w/kg) | 79.7 | 59.0 | 75.7 | 168 |
| $\lambda s \times 10^6$ | −1.1 | −1.2 | 0.1 | 27 |
| $p \times 10^8$ (Ωm) | 44 | 48 | 58 | 137 |
| t (μm) | 18 | 17 | 22 | 20 |

a $^{w}\alpha/\beta$: core loss ($\alpha \times 10^{-1}$ T and β Hz.)
b f = 1 kHz; Hm = 5 mOe As can be understood from Table 20, the samples of the alloys according to the present invention has a core loss lower than that of the Fe—Si—B amorphous alloy according to the comparative example and also has a reduced magnetostriction.

As described above, the manufacturing method according to the present invention is able to manufacture the Fe-base soft magnetic alloys having soft magnetic characteristics equivalent to or superior to those of the conventional practical alloy, superior magnetic permeability and saturation magnetic flux density. Further, the soft magnetic alloys according to the present invention has excellent mechanical strength and satisfactory heat stability.

By performing the heat treatment set at the heating rate of 1.0° C./minute or higher, the magnetic permeability can stably be improved.

Since Nb and Ta which are elements to be added to the alloys according to the present invention are thermally stable elements, the fear of denaturing due to the oxidation or reduction reaction at the time of the manufacturing process can be eliminated. Therefore, an advantage can be realized that the manufacturing conditions can be made easy.

As a result, the Fe-base soft magnetic alloys obtained by the method according to the present invention can be suitably used in a magnetic head which must be adapted to the trend of enlarging the coercive force of a magnetic recording medium, and a transformer and a choke coil each of which is required to have a smaller size. If the present invention is adapted to the foregoing purpose, the performance of the foregoing units can be improved and the size and the weight of the same can be reduced.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A method of manufacturing a Fe-base soft magnetic alloy comprising a step of:

forming an amorphous alloy ribbon mainly composed of Fe;

subjecting the amorphous alloy ribbon to heat treatment in which said amorphous alloy ribbon is heated at a heating rate of 10° C./minute or higher so that at least 50% or more of the structure of said amorphous alloy ribbon is made of fine crystalline grains formed into a body-centered cubic structure and having an average grain size of crystal of 30 nm or smaller.

2. A method of manufacturing a Fe-base soft magnetic alloy according to claim 1, wherein said heat treatment is so arranged that said heating at said heating rate is performed and then the temperature is maintained at 400° to 750° C.

3. A method of manufacturing a Fe-base soft magnetic alloy according to claim 2, wherein said Fe-base soft magnetic alloy is composed as expressed by the following formula:

$$Fe_bB_xM_y$$

where M is one or more elements selected from a group consisting of Ti, Zr, Hf, V, Nb, Ta, Mo and W and contains Zr and/or Hf, $75 \leqq b \leqq 93$ atom %, $0.5 \leqq x \leqq 10$ atom % and $4 \leqq y \leqq 9$ atom %.

4. A method of manufacturing a Fe-base soft magnetic alloy according to claim 2, wherein said Fe-base soft magnetic alloy is composed as expressed by the following formula:

$$Fe_bB_xM_yX_u$$

where M is one or more elements selected from a group consisting of Ti, Zr, Hf, V, Nb, Ta, Mo and W and contains Zr and/or Hf, X is one or more elements selected from a group consisting of Cr, Ru, Rh and Ir, $75 \leqq b \leqq 93$ atom %, $0.5 \leqq x \leqq 10$ atom %, $4 \leqq y \leqq 9$ atom % and $u \leqq 5$ atom %.

5. A method of manufacturing a Fe-base soft magnetic alloy according to claim 2, wherein said Fe-base soft magnetic alloy is composed as expressed by the following formula:

$$(Fe_{1-a}Z_a)_bB_xM_y$$

where Z is Co and/or Ni, M is one or more elements selected from a group consisting of Ti, Zr, Hf, V, Nb, Ta, Mo and W and contains Zr and/or Hf, $a \leqq 0.1$, $75 \leqq b \leqq 93$ atom %, $0.5 \leqq x \leqq 10$ atom % and $4 \leqq y \leqq 9$ atom %.

6. A method of manufacturing a Fe-base soft magnetic alloy according to claim 2, wherein said Fe-base soft magnetic alloy is composed as expressed by the following formula:

$$(Fe_{1-a}Z_a)_bB_xM_yX_u$$

where Z is Co and/or Ni, M is one or more elements selected from a group consisting of Ti, Zr, Hf, V, Nb, Ta, Mo and W and contains Zr and/or Hf, X is one or more elements selected from a group consisting of Cr, Ru, Rh and Ir, $a \leqq 0.1$, $75 \leqq b \leqq 93$ atom %, $0.5 \leqq x \leqq 10$ atom %, $4 \leqq y \leqq 9$ atom % and $u \leqq 5$ atom %.

7. A method of manufacturing a Fe-base soft magnetic alloy according to claim 2, wherein said Fe-base soft magnetic alloy is composed as expressed by the following formula:

$$Fe_bB_xM'_y$$

where M' is one or more elements selected from a group consisting of Ti, V, Nb, Ta, Mo and W and contains Nb, $75 \leqq b \leqq 93$ atom %, $6.5 \leqq x \leqq 14$ atom % and $4 \leqq y \leqq 9$ atom %.

8. A method of manufacturing a Fe-base soft magnetic alloy according to claim 2, wherein said Fe-base soft magnetic alloy is composed as expressed by the following formula:

$$Fe_bB_xM'_yX_u$$

where M' is one or more elements selected from a group consisting of Ti, V, Nb, Ta, Mo and W and contains Nb, X is one or more elements selected from a group consisting of Cr, Ru, Rh and Ir, $75 \leqq b \leqq 93$ atom %, $6.5 \leqq x \leqq 14$ atom %, $4 \leqq y \leqq 9$ atom % and $u \leqq 5$ atom %.

9. A method of manufacturing a Fe-base soft magnetic alloy according to claim 2, wherein said Fe-base soft magnetic alloy is composed as expressed by the following formula:

$$(Fe_{1-a}Z_a)_bB_xM'_y$$

where Z is Co and/or Ni, M' is one or more elements selected from a group consisting of Ti, V, Nb, Ta, Mo and W and contains Nb, $a \leqq 0.1$, $75 \leqq b \leqq 93$ atom %, $6.5 \leqq x \leqq 14$ atom % and $4 \leqq y \leqq 9$ atom %.

10. A method of manufacturing a Fe-base soft magnetic alloy according to claim 2, wherein said Fe-base soft magnetic alloy is composed as expressed by the following formula:

$$(Fe_{1-a}Z_a)_bB_xM'_yX_u$$

where Z is Co and/or Ni, M' is one or more elements selected from a group consisting of Ti, V, Nb, Ta, Mo and W and contains Nb, X is one or more elements selected from a group consisting of Cr, Ru, Rh and Ir, $a \leqq 0.1$, $75 \leqq b \leqq 93$ atom %, $6.5 \leqq x \leqq 14$ atom %, $4 \leqq y \leqq 9$ atom % and $u \leqq 5$ atom %.

11. A method of manufacturing a Fe-base soft magnetic alloy according to claim 2, wherein said Fe-base soft magnetic alloy is composed as expressed by the following formula:

$$Fe_bB_xM_yT_z$$

where M is one or more elements selected from a group consisting of Ti, Zr, Hf, V, Nb, Ta, Mo and W and contains Zr and/or Hf, T is one or more elements selected from a group consisting of Cu, Ag, Au, Pd, Pt and Bi, $75 \leqq b \leqq 93$ atom %, $0.5 \leqq x \leqq 18$ atom %, $4 \leqq y \leqq 10$ atom % and $z \leqq 4.5$ atom %.

12. A method of manufacturing a Fe-base soft magnetic alloy according to claim 11, wherein $0.2 \leqq z \leqq 4.5$ atom %.

13. A method of manufacturing a Fe-base soft magnetic alloy according to claim 2, wherein said Fe-base soft magnetic alloy is composed as expressed by the following formula:

$$Fe_bB_xM_yT_zX_u$$

where M is one or more elements selected from a group consisting of Ti, Zr, Hf, V, Nb, Ta, Mo and W and contains Zr and/or Hf, T is one or more elements selected from a group consisting of Cu, Ag, Au, Pd, Pt and Bi, X is one or more elements selected from a group consisting of Cr, Ru, Rh and Ir, $75 \leqq b \leqq 93$ atom %, $0.5 \leqq x \leqq 18$ atom %, $4 \leqq y \leqq 10$ atom %, $z \leqq 4.5$ atom % and $u \leqq 5.0$ atom %.

14. A method of manufacturing a Fe-base soft magnetic alloy according to claim 13, wherein $0.2 \leqq z \leqq 4.5$ atom %.

15. A method of manufacturing a Fe-base soft magnetic alloy according to claim 2, wherein said Fe-base soft magnetic alloy is composed as expressed by the following formula:

$$(Fe_{1-a}Z_a)_bB_xM_yT_z$$

where Z is Co and/or Ni, M is one or more elements selected from a group consisting of Ti, Zr, Hf, V, Nb, Ta, Mo and W and contains Zr and/or Hf, T is one or more elements selected from a group consisting of Cu, Ag, Au, Pd, Pt and Bi, $a \leqq 0.1$, $75 \leqq b \leqq 93$ atom %, $0.5 \leqq x \leqq 18$ atom %, $4 \leqq y \leqq 10$ atom % and $z \leqq 4.5$ atom %.

16. A method of manufacturing a Fe-base soft magnetic alloy according to claim 15, wherein $0.2 \leqq z \leqq 4.5$ atom %.

17. A method of manufacturing a Fe-base soft magnetic alloy according to claim 2, wherein said Fe-base soft magnetic alloy is composed as expressed by the following formula:

$$(Fe_{1-a}Z_a)_bB_xM_yT_zX_u$$

where Z is Co and/or Ni, M is one or more elements selected from a group consisting of Ti, Zr, Hf, V, Nb, Ta, Mo and W and contains Zr and/or Hf, T is one or more elements selected from a group consisting of Cu, Ag, Au, Pd, Pt and Bi, X is one or more elements selected from a group consisting of Cr, Ru, Rh and Ir, $a \leqq 0.1$, $75 \leqq b \leqq 93$ atom %, $0.5 \leqq x \leqq 18$ atom %, $4 \leqq y \leqq 10$ atom %, $z \leqq 4.5$ atom % and $u \leqq 5$ atom %.

18. A method of manufacturing a Fe-base soft magnetic alloy according to claim 17, wherein $0.2 \leqq z \leqq 4.5$ atom %.

19. A method of manufacturing a Fe-base soft magnetic alloy according to claim 2, wherein said Fe-base soft magnetic alloy is composed as expressed by the following formula:

$$Fe_bB_xM'_yT_z$$

where M' is one or more elements selected from a group consisting of Ti, V, Nb, Ta, Mo and W and contains any one of Ti, Nb and Ta, T is one or more elements selected from a group consisting of Cu, Ag, Au, Pd, Pt and Bi, $75 \leqq b \leqq 93$ atom %, $6.5 \leqq x \leqq 18$ atom %, $4 \leqq y \leqq 10$ atom % and $z \leqq 4.5$ atom %.

20. A method of manufacturing a Fe-base soft magnetic alloy according to claim 19, wherein $0.2 \leqq z \leqq 4.5$ atom %.

21. A method of manufacturing a Fe-base soft magnetic alloy according to claim 2, wherein said Fe-base soft magnetic alloy is composed as expressed by the following formula:

$$Fe_bB_xM'_yT_zX_u$$

where M' is one or more elements selected from a group consisting of Ti, V, Nb, Ta, Mo and W and contains any one of Ti, Nb and Ta, T is one or more elements selected from a group consisting of Cu, Ag, Au, Pd, Pt and Bi, X is one or more elements selected from a group consisting of Cr, Ru, Rh and Ir, $75 \leqq b \leqq 93$ atom %, $6.5 \leqq x \leqq 18$ atom %, $4 \leqq y \leqq 10$ atom %, $z \leqq 4.5$ atom % and $u \leqq 5$ atom %.

22. A method of manufacturing a Fe-base soft magnetic alloy according to claim 21, wherein $0.2 \leqq z \leqq 4.5$ atom %.

23. A method of manufacturing a Fe-base soft magnetic alloy according to claim 2, wherein said Fe-base soft magnetic alloy is composed as expressed by the following formula:

$$(Fe_{1-a}Z_a)_bB_xM'_yT_z$$

where Z is Co and/or Ni, M' is one or more elements selected from a group consisting of Ti, V, Nb, Ta, Mo and W and contains any one of Ti, Nb and Ta, T is one or more elements selected from a group consisting of Cu, Ag, Au, Pd, Pt and Bi, $a \leqq 0.1$, $75 \leqq b \leqq 93$ atom %, $6.5 \leqq x \leqq 18$ atom %, $4 \leqq y \leqq 10$ atom % and $z \leqq 4.5$ atom %.

24. A method of manufacturing a Fe-base soft magnetic alloy according to claim 23, wherein $0.2 \leqq z \leqq 4.5$ atom %.

25. A method of manufacturing a Fe-base soft magnetic alloy according to claim 2, wherein said Fe-base soft magnetic alloy is composed as expressed by the following formula:

$$(Fe_{1-a}Z_a)_bB_xM'_yT_zX_u$$

where Z is Co and/or Ni, M' is one or more elements selected from a group consisting of Ti, V, Nb, Ta, Mo and W and contains any one of Ti, Nb and Ta, T is one or more elements selected from a group consisting of Cu, Ag, Au, Pd, Pt and Bi, X is one or more elements selected from a group consisting of Cr, Ru, Rh and Ir, $a \leqq 0.1$, $75 \leqq b \leqq 93$ atom %, $6.5 \leqq x \leqq 18$ atom %, $4 \leqq y \leqq 10$ atom %, $z \leqq 4.5$ atom % and $u \leqq 5$ atom %.

26. A method of manufacturing a Fe-base soft magnetic alloy according to claim 25, wherein $0.2 \leqq z \leqq 4.5$ atom %.

27. A method of manufacturing a Fe-base soft magnetic alloy according to claim 1, wherein the step of subjecting the amorphous alloy ribbon to heat treatment comprises heating the amorphous alloy ribbon at a heating rate of 40° C./minute or higher.

* * * * *